US006155455A

United States Patent [19]

Yajima et al.

[11] Patent Number: 6,155,455

[45] Date of Patent: Dec. 5, 2000

[54] VENDING MACHINE

[75] Inventors: Hidekazu Yajima; Akira Sugawara; Seiji Ebukuro; Takeo Igarashi; Masaki Nakayama; Hiroshi Ogomori, all of Saitama, Japan

[73] Assignee: Sanyo Electric Co., Ltd., Osaka-Fu, Japan

[21] Appl. No.: 09/434,295

[22] Filed: Nov. 5, 1999

Related U.S. Application Data

[62] Division of application No. 09/153,231, Sep. 15, 1998, Pat. No. 6,019,246, which is a division of application No. 08/724,247, Sep. 30, 1996, Pat. No. 5,848,726.

[30] Foreign Application Priority Data

| | | | |
|---|---|---|---|
| Sep. 29, 1995 | [JP] | Japan | 7-277020 |
| Sep. 29, 1995 | [JP] | Japan | 7-277021 |
| Oct. 13, 1995 | [JP] | Japan | 7-265577 |
| Oct. 13, 1995 | [JP] | Japan | 7-265578 |
| Oct. 24, 1995 | [JP] | Japan | 7-298957 |
| Oct. 30, 1995 | [JP] | Japan | 7-305052 |
| Nov. 17, 1995 | [JP] | Japan | 7-300146 |

[51] Int. Cl.[7] ..... G07F 11/00

[52] U.S. Cl. ..... 221/97; 221/130; 221/131; 221/155

[58] Field of Search ..... 221/97, 98, 99, 221/100, 130, 131, 155

[56] References Cited

U.S. PATENT DOCUMENTS

| | | | |
|---|---|---|---|
| 3,122,269 | 2/1964 | Reburn . | |
| 3,191,737 | 6/1965 | James et al. . | |
| 3,512,679 | 5/1970 | Stoltz . | |
| 4,303,179 | 12/1981 | Spring . | |
| 4,699,295 | 10/1987 | Cedrone et al. | 221/131 |
| 4,722,455 | 2/1988 | Groover | 221/131 |
| 4,948,206 | 8/1990 | Fitzpatrick . | |
| 5,080,256 | 1/1992 | Rockola . | |
| 5,335,818 | 8/1994 | Maldaris et al. | 221/131 |
| 5,372,416 | 12/1994 | Shapley et al. . | |
| 5,511,646 | 4/1996 | Maldaris et al. . | |
| 5,651,476 | 7/1997 | Percy et al. | 221/131 |
| 5,848,726 | 12/1998 | Yajima et al. | 221/131 |
| 6,019,246 | 2/2000 | Yajima et al. | 221/155 |

FOREIGN PATENT DOCUMENTS

| | | | |
|---|---|---|---|
| 3-189897 | 8/1991 | Japan . | |
| 4-52487 | 2/1992 | Japan . | |
| 4-54589 | 2/1992 | Japan . | |
| 5-94582 | 4/1993 | Japan . | |
| 405114079A | 5/1993 | Japan | 221/131 |
| 405303683A | 11/1993 | Japan | 221/131 |

*Primary Examiner*—H. Grant Skaggs
*Attorney, Agent, or Firm*—McDermott, Will & Emery

[57] ABSTRACT

There is disclosed a vending machine in which a plurality of article columns are slant to be directed to a plurality of vending mechanisms, respectively. Each of the article columns is composed of a plurality of shelves for accommodating a row of articles. Each of the article columns is provided with a vending mechanism, so that articles of different kinds can be sold dependent on the number of the article columns. For this structure, at least one vending mechanism is set for an arbitrary one of article selection buttons. Thus, when the number of the article columns for accommodating the same kind of articles is set in accordance with the sales amount of the articles, different kinds of articles are sold out at an approximately same time.

5 Claims, 52 Drawing Sheets

VENDING MACHINE

This application is a divisional of application Ser. No. 09/153,231, now U.S. Pat. No. 6,091,246, filed Sep. 15, 1998, which is a divisional of Ser. No. 08/724,247, U.S. Pat. No. 5,848,726, filed Sep. 30, 1996.

FIELD OF THE INVENTION

The invention relates to a vending machine, and more particularly to, a vending machine in which articles stored therein and the vending operation thereof are visible through an article display.

BACKGROUND OF THE INVENTION

As the vending machine of the see-through type, a vending machine for a can beverage that will below be explained is known. In the vending machine, an article display at a main door is largely tailored to an article storage which is contained in a main body of the vending machine. Also, the vending machine comprises an adiabatic door of the article storage that is implemented by a transparent material so that it is possible to see the article in the article storage through the article display. The articles are stored in article columns which are implemented by vertical two stairs and lateral four rows which are contained in the article storage. Selection buttons of a ten keys type are attached to a side of the article display in response to each of the article columns. Each of the article columns comprises a stock passageway and a vending mechanism. The stock passageway is extended, in a state of a character of S, from an article insertion at an upstream end to a whole width of depth in the article storage. The vending mechanism is attached at a downstream of the stock passageway.

Also, a person facing portion having such as a coin insertion, is positioned in a side of the article display to have a liner dimension so that the person facing portion does not prevent visibility of the article. An article stocker is formed in a space in the back of the person facing portion by using a side plate of the article storage. In addition, an advertisement content such as a name of a maker is represented an upper portion of the person facing portion that becomes an empty space. Also, article samples (sample cans) are displayed in a clearance of a turn portion of the stock passageway that is positioned in a side of the adiabatic door.

FIG. 1 shows another conventional vending machine which is capable of selecting HOT vending and COLD vending. In the vending machine, a HOT or COLD indicating plate 54 is detachable to each of button holders to which the selection buttons are attached. The HOT or COLD indicating plate 54 represents a price of the article and HOT or COLD. As shown in FIG. 1(*b*), on the HOT or COLD indicating plate 54, an indication plate 54*a* for indicating HOT and another indication plate 54*b* for indicating COLD are prepared. The indication plate 54*a* for indicating HOT comprises a back plate having a warm color (red color origin) on that a character of "HOT" is written. The indication plate 54*b* for indicating COLD comprises another back plate having a cool color (blue color origin) on that a character of "COLD" is written. When a part or whole of the article storage 55 is switched from a state of "HOT" to a state of "COLD" or from the state of "COLD" to the state of "HOT", the indication plates 54*a* and 54*b* are exchanged with each other.

On the other hand, as a typical vending machine of the see-through type in that it is possible to see articles in an inside, a showcase is known. In the showcase, it is possible to select HOT vending and COLD vending, In case that one of HOT vending and COLD vending is represented, the one of HOT vending and COLD vending, in a fixed state, is represented on such as a front surface of the showcase.

However, since the stock passageway is formed in the state of a character of S in the conventional vending machine, it is easy to cause a clearance in such as the corner of the passageway. As a result, it is impossible to mount eight article columns which are implemented by the vertical two stairs and the lateral four rows. Therefore, there is a problem that the numerals of the articles which are stored are decreased and that kinds of the articles are limited. Also, since containable numerals of the respective kinds of the articles become every numerals of the articles which are stored in the respective article columns, it is impossible to finely set numerals of the article. This is similarly caused in vending machine which has articles of serpentine type. It causes an inconvenience that while one of the kinds of the articles are wholly vended, other of the kinds of the articles are greatly remained.

Also, the articles which are stored in the article stoker are not objects which are automatically vended when the articles are left intact. Therefore, there is a problem that the containable numerals are decreased by the numerals of the article which are stored as against a size of the vending machine. Also, since a representation of the advertisement content on the upper portion of the person facing portion becomes small, the advertisement content such as the name of the maker lacks appealability.

In addition, when the stock passageway of the article rack is fully filled with the articles, it is possible to see the articles together with the article samples from front. As a result, a sense (full sense) that the inside is fully filled with the articles is given. However, when the vending of the articles advances, the numerals of the articles which are seen from the front, become small. Therefore, since the full sense is lost, there is a problem that the appealability of the article is deceased. On the other hand, in the vending machine of the type, the article display is largely formed in response to the article storage so that it is possible to see the articles which are stored. Since a center portion of the article display becomes dark when a fluorescent lamp is attached to be covered by an end portion of the article display, it is impossible to uniformly illuminate the articles which are stored.

Also, it is assumed that cooling articles and heating articles are stored in the article storages which are parted and have an adiabatic door having a transparent plate. In this event, there is a problem that a heat leakage from the transparent plate is great by a difference of heat of the both article storages and that an intensity the transparent plate is small. Therefore, it is considered that composite transparent plates, namely, two transparent plates are used. However, there is a problem that the heat is convected in internal spaces which are formed by the transparent plates by the difference of the heat of the both article storages.

In addition, it is considered that the cooling article and the heating article are stored in the article storages which are parted and have an adiabatic doors, respectively, which have transparent plates and are supported by hinges at both sides of the main body and that the heat of the article storages are insulated by an adiabatic parting member. Also, it is considered that the cooling article and the heating article are stored in the article storages which are parted and have an adiabatic doors, respectively, which have transparent plates and that the article storages have the adiabatic parting member which combines the transparent plates to become a pair of the diabetic doors. However, in those events, there is a problem that a cost is increased and that since the transparent plates and the adiabatic parting member damage an aesthetic sense, a feature of the vending machine of the see through type is lost.

On the other hand, it is assumed that develop an adiabatic door of the article storages which comprises a pair of transparent plates which covers whole of the article storages.

In this event, there is an unresolved problem that deformation and clearances are caused in portions by differences of the portions. In the vending machine of the type, it is important for fully exercising appealability that it is possible to see the articles which, in practice, are vended, from the outside and to see a vending actuation of the articles which are released by a vending mechanism. Therefore, the conventional article columns of the serpentine type are not adapted for the vending machine and the article columns of shaft boards type in vertical stairs are adapted for the vending machine. In addition, it is preferable to attach a drop passageway to a front of the article columns and to drop and release the article in a front direction. In this event, in case that the shaft boards of the article columns are positioned to hang down in the front direction, it is possible to, in order, send the article in the front direction by an empty weight and to always display the next article in a front end potion so that it is possible to see the next article from the outside even when the vending proceeds. Also, in case that the article is dropped in the front direction to be released to a take-out, it is possible to give a realism that the article which, at practice, is seen by a user is dropped.

However, in case of implementing the article columns and the drop passageway as above mentioned, since the shaft boards of the article columns hang down in the front direction when an operator sees the shaft boards, it needs to push the article in an interior direction. As a result, it is very hardly to insert the articles. Particularly, since the operator needs to stoop and carry out a insert work for pushing the article in the interior direction, the insert work is very complex. However, the problem is dissolved if the bending machine comprises a structure for loading the article from a backside of the vending machine. However, it is impossible to provide the structure for loading the article from a backside of the bending machine except that installation features of the vending machine is special.

In the conventional other vending machine shown in FIG. 1, switch of the sates is carried out in at least two times per year (summer period and winter period) or in four to times per year. Therefore, a switching work for switching the HOT or COLD indicating plate becomes complex. Also, there is a problem that the switching work is forgotten. Also, in the vending in a state that the articles have not a optimum temperature in such as just after loading, there is not a way for easily and fitly telling the vending in the state to the user. Therefore, it is only possible to consider a measure that the articles are vended in remaining intact and that a sellout is represented.

SUMMARY OF THE INVENTION

Accordingly, it is the first object of the invention to provide a vending machine which is capable of securing full contain numerals and kinds of the articles and which is capable of vending the respective kinds of the article at the about same time.

It is the second object of the invention to provide a vending machine which is capable of holding a facility as the vending machine of the see through type and which is capable of increasing numerals of the articles.

It is the third object of the invention to provide a vending machine which is capable of increasing in parallel full appealability of the article and an advertisement content such as a name of a maker.

It is the fourth object of the invention to provide a vending machine which is capable of displaying an article sample so as to give a full sensibility and which is capable of uniformly illuminating the articles which are seen through the article display.

It is the fifth object of the invention to provide a vending machine which is capable of holding an appealability that it is possible to see the articles stored and vending actuations and which is capable of easily carrying out a work of loading the article.

It is the sixth object of the invention to provide a vending machine which is capable of automatically carrying out a represent of HOT or COLD of the articles in response to a temperature of an article storage by using that an internal of side the article storage is seen from an outside.

It is the seventh object of the invention to provide a vending machine which is capable of insulating, by a pair of transparent members, heat of article storages which stores cooling articles and heating articles.

According to the first aspect of the invention, a vending machine, comprises:

a plurality of article columns having vending mechanisms;

a plurality of article selection buttons for actuating the vending mechanisms, respectively;

means for setting the plurality of article columns to be assigned to the plurality of article selection buttons;

wherein each of the Plurality of article columns, comprises:

a plurality of shelves each being slant to be directed to a corresponding one of the vending mechanisms, and having a room for accommodating articles in row relative to adjacent shelves; and the setting means is structured to set at least one of the vending mechanisms to one of the plurality of article selection buttons.

According to the construction, since a plurality of the article columns are implemented by a plurality of the shaft boards which are sloped in a direction of the vending mechanism and which are positioned to have a clearance which is capable of containing the article in a line, the numerals of the articles which are stored in the respective article columns are decreased. However, since, as the whole of the vending machine, an unless space is caused in the article columns, the numerals of the articles which are stored in the vending machines On the other hand, the vending mechanism are positioned in the respective article columns, it is possible to vend the different articles in every numerals of the articles which are stored in the respective article columns. Therefore, in case that the setting means is capable of setting at least one of the vending mechanism to optional one of the selection buttons, when it is assumed to set, in response to result of the vending, the numerals of the article columns which stores the same article, it is possible to make a vending form that the difference articles are wholly vended.

According to the second aspect of the invention, a vending machine, comprises:

a main body having a predetermined height and a predetermined width;

an article display installed on a front side of the main body to occupy a predetermined portion of the predetermined width of the main body, a plurality of article columns in an article storage and articles in the plurality of article columns being visible through the article display; and an interface installed on the front side of the main body to occupy a remaining portion of the predetermined width of the main body;

wherein the article storage is extended behind the interface to provide a plurality of additional commons.

According to the construction, since additional columns are positioned in a space which is positioned in a backside of the person facing portion and in which the storage is extended, it is possible to use the empty space as an article storage which stores the article to be vended.

According to the third aspect of the invention, a vending machine, comprises:

an article display having a transparent panel through which article stored in an article storage are visible; and an advertisement member provided between the transparent panel and the articles;

wherein an advertisement content is represented on the advertisement member, such that the articles are visible through the advertisement content.

Thus, in case that the advertisement content is represented on the signboard member in the state of permitting visibility of the article, the user can see the articles which are stored through the transparent panel and the user can see the advertisement content so that the advertisement content is piled on the articles.

Also, according to the construction, the user can see the articles which are stored through the transparent panel and the user can see the advertisement content so that the advertisement content is piled on the articles.

According to the fourth aspect of the invention, a vending machine, comprises:

an article display for displaying article samples to be lain on shelves;

wherein the article samples are arranged in plural row in a horizontal direction, and in plural columns in a vertical direction.

According to the construction, since many article samples are aligned and fallen down sideways in the article display, a state of the articles which are fully stored is always represented by the article samples.

According to the construction, since the illuminating apparatus is positioned so as to vertically cut the article display, light is uniformly illuminated to the articles which are stored are and it is hardly possible to cause contrast in the article display.

According to the fifth aspect of the invention, a vending machine, comprises:

an article display having a transparent panel through which articles stored in an article storage are visible;

an article rack having plural stages of article columns vertically installed in the article storage; and a passageway installed between a front end of the article rack and the transparent panel for dropping the articles supplied from the article columns to an article take-out;

wherein each of the article columns comprises a plurality of shelves which are slant to be lower at front ends thereof, and a plurality of vending mechanisms provided at the front ends of the plurality of shelves, respectively; and each of the plurality of the shelves are rotatively supported at a middle point thereof to be moved in upper and lower directions oppositely at both ends thereof relative to the middle point.

According to the construction, since the article rack comprises the article columns which has a plurality of stairs up and down and the respective article columns comprises the shaft boards which are sloped downward in the front direction and the vending mechanisms which are attached to front ends of the shaft boards, the forefront one of the articles which are stored in the article columns is, in order, sent in the front direction to be vended. Therefore, since the articles are always Positioned in the front portions of the article columns, namely, in the positions in which it is possible to well see the articles through the transparent panel, the articles carry out the same facility of the article sample. Also, the articles which are released are dropped through the drop passage which is positioned between the front end of the article rack and the transparent panel to be guided to the take-out, the user can see, through the transparent panel, the proceed of vending the articles which will be, at practice, vended. On the other hand, since the shaft boards on which the articles are stored are capable of carrying out a seesaw movement which have centers in the middle portions. Therefore, if the shaft boards are swung from a state of sloping downward in the front direction to a state of sloping downward in the back direction, the article which is inserted is wallowed by an empty weight to be, every when, sent to the inner part. Also, when the shaft boards are swung from a state of sloping downward in the back direction to a state of sloping downward in the front direction, the shaft boards are returned to the before vend waiting state.

According to the sixth aspect of the invention, a vending machine, comprises:

an article display through which an inside of an article storage is visible; and a thermal member for indicating a temperature of articles stored in the article storage in accordance with change of colors, the thermal member being positioned the inside of the article storage.

According to the construction, since the temperature indicating member for indicating, by a change of color, a temperature of the inside of the article storage is positioned so that the user can see the temperature indicating member through the article display, it is possible to represent the temperature of the inside in a direction of the outside. Therefore, if, for example, in case of using the temperature indicating member which represents a warm color in a heating state and which represents a cool color in a cooling state, it is possible to sensibly represent warm and cool of the article by using colors. As a result, it is possible to make the temperature indicating remember represent HOT and COLD. Also, in case that a temperature of the article (the article storage) is a middle temperature between FOOT and COLD, an other color which is not changed to the warm and cool colors is capable of representing the middle temperature. In addition, the temperature indicating member may be formed in an optional shape.

According to the seventh aspect of the invention, a vending machine, comprises:

a transparent thermal resistance door for an article storage; and an article display having a thermal transparent panel through which articles stored in the article storage is visible;

wherein the article storage is separated into a heating storage for storing heated articles and a cooling storage for storing cooled articles; and the thermal resistance door comprises two transparent panels for forming an air layer in an interior space therebetween to be opened and closed on a front plane, the interior space having a partition member preventing thermal flow between a portion of the air layer facing the heating storage and a remaining portion of the air layer facing the cooling storage.

According to the construction, since the parting member having two transparent members is positioned in the inner space, it is possible to prevent the convection of the heat of the inner space. As a result, it is possible to minimize the leakage of the heat between adjacent storages. Therefore, since a pair of the transparent members can insulate the heat between the storages which stores the heating articles and the cooling articles, it is possible to increase the aesthetic sense and to decrease the cost.

DESCRIPTION OF THE PREFERRED EMBODIMENTS

Figure 1A:
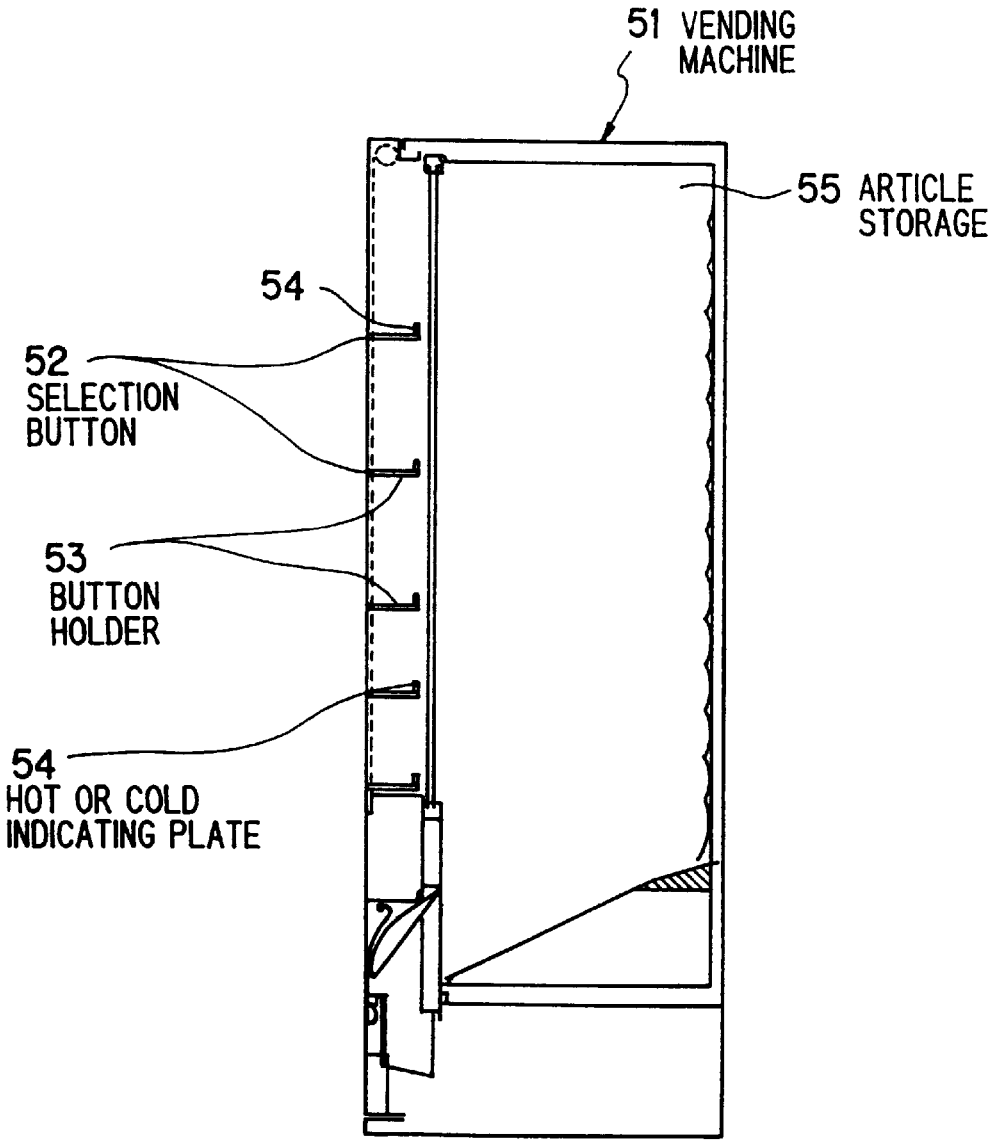
FIG. 1A PRIOR ART
FIGS. 1A and 1B are views of a construction of a conventional vending machine.
Figure 1B:
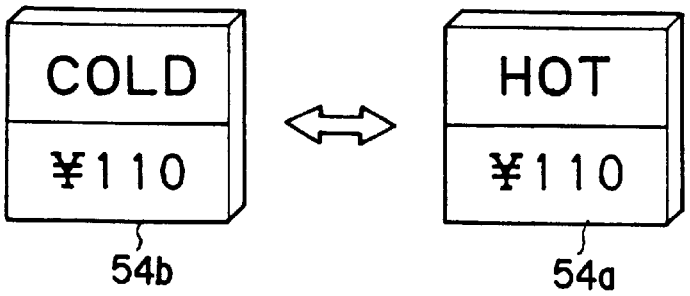
FIG. 1B PRIOR ART
Figure 2:
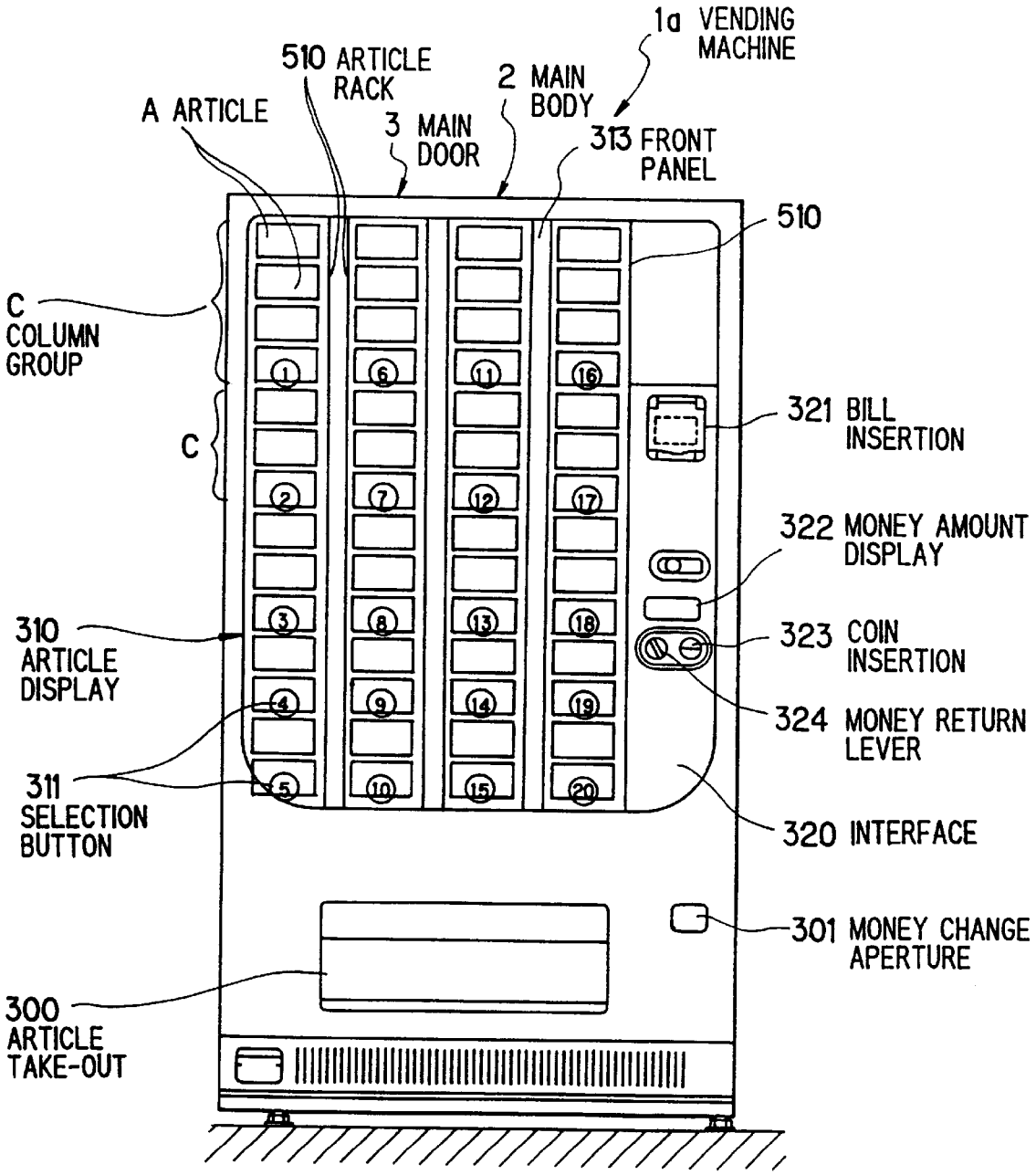
FIG. 2 is a front view of the vending machine according to the first embodiment of the invention.
Figure 3:
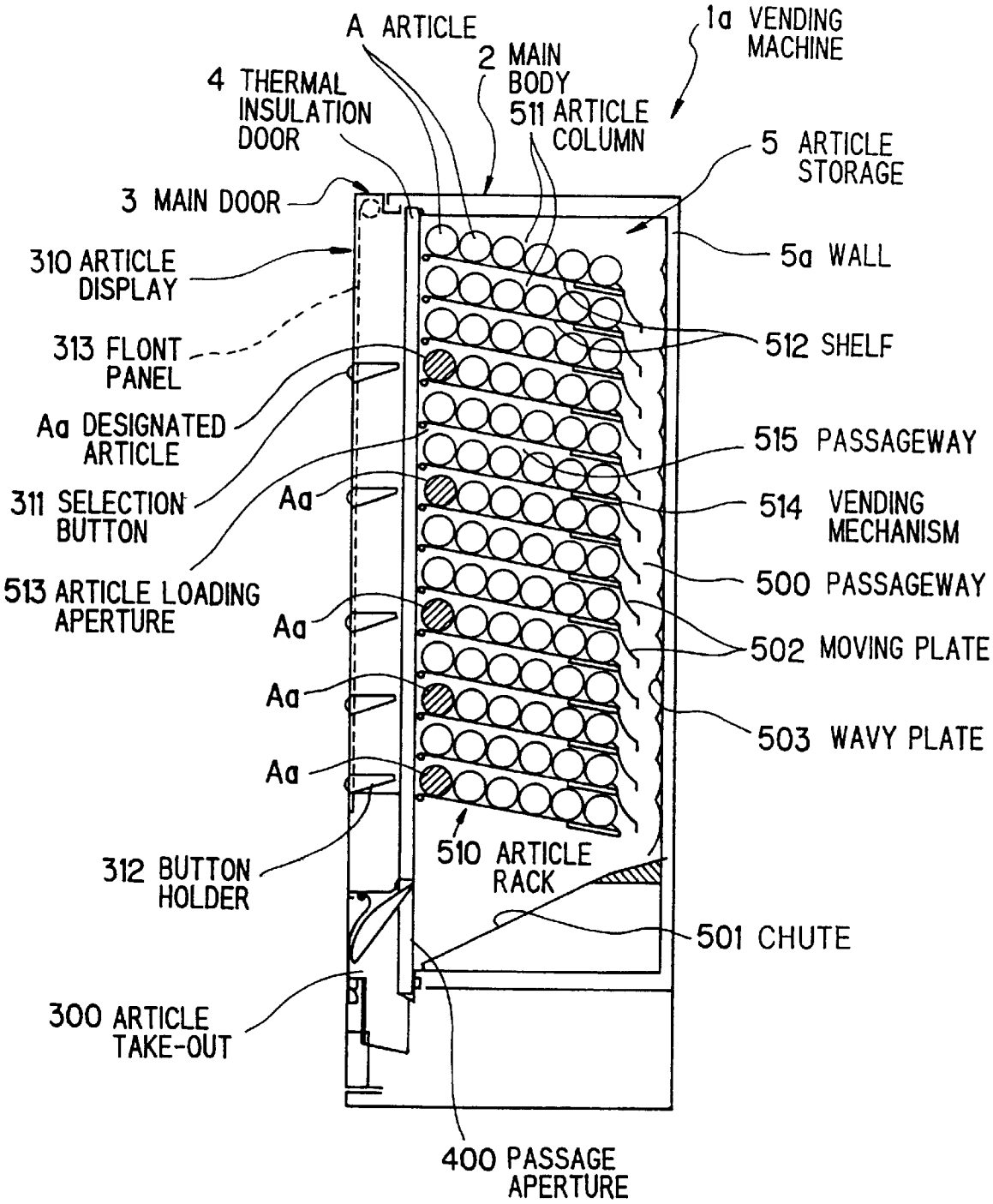
FIG. 3 is a longitudinal section view of the vending machine according to the first embodiment of the invention.

A see-through type vending machine in the first preferred embodiment according to the invention will be explained in FIGS. 2 and 3 which are a front view, a longitudinal sectional view thereof, respectively. As shown in FIGS. 2 and 3, the see-through type vending machine la comprises a main body 2 and a main door 3 which is open-operably fixed on the front side of the main body 2. In the main body 2, an article storage 5 with a thermal insulation door 4 on the front side is provided. In the article storage 5, four files of article racks 510 are disposed left to right.

In each file of article racks 510, many article columns 511 are disposed stacked up to down. Here, two to four article columns 511 are called ore column group C, where each article column group C includes like articles A. Between the rear end of the article rack 510 and the rear wall 5*a* of the article storage 5, a passageway 500 is formed. To the downstream end of the passageway 500, a chute 501 is connected which is declined to the front side. An article A sent out of each article column 511 falls along the passageway 500, then rolling down each chute 501 to reach an article take-out 300 through a passage aperture 400.

In the passageway 500, a moving plate 502 is provided which is suspended from the rear end of each article column 511 on the article lack 510 as well as a corresponding wavy plate 503 provided on the rear wall 5*a*. Thus, the falling of an article A can be controlled as in the serpentine-type passageway.

On the main door 3, an article display 310 corresponding to the thermal insulation door 4 is widely provided. To the right of the article display 310, an interface 320 is provided which includes a bill insertion 321, a money amount display 322, a coin insertion 323, money return lever 324 etc. Below the article display 310, the article take-out 300 and a money change aperture 301 are provided.

Corresponding to each column group C, i.e., an article Aa at the front of the lowest article column 511 of the column group C, a selection button 311 is provided on the front side of the article display 310. Here, the selection button 311 is attached on the front side of a button holder 312 which is disposed inside the article display 310 and the rear part of the button holder 312 is formed to be wedge-shaped so as to indicate the corresponding article Aa at the front of the lowest article column 511. Thus, an error in selecting the article A can be prevented.

A front panel 313 composing the article display 310 is made of transparent glass, acrylic resin or the like. Also, the thermal insulation door 4, which can be seen through the front panel 313, is made of multilayer-structure transparent glass, acrylic resin or the like. Therefore, in the vending machine 1*a,* the article A stored in each article column 511 can be seen through the article display 310. Namely, the vending machine la has a see-through structure such that the stored article A as well as the situation of sending out the article A when sold can be observed from outside. In addition, a shelf 512 composing each article column 511 may be also made of transparent glass, acrylic resin or the like.

On the other hand, each article rack 510 is, as shown in FIG. 3, composed of many article columns 511 which are disposed stacked up to down. These article columns 511 are formed by obliquely fixing many shelves 512 to right and left side plates(not shown) composing the article rack 510. Each article column 511, which is formed to store a row of articles A, comprises an article loading aperture 513 provided on the front end, a vending mechanism 514 provided on the rear end and a passageway 515 extending from the article loading aperture 513 to the vending mechanism 514 with declining to the rear side.

Figure 4:
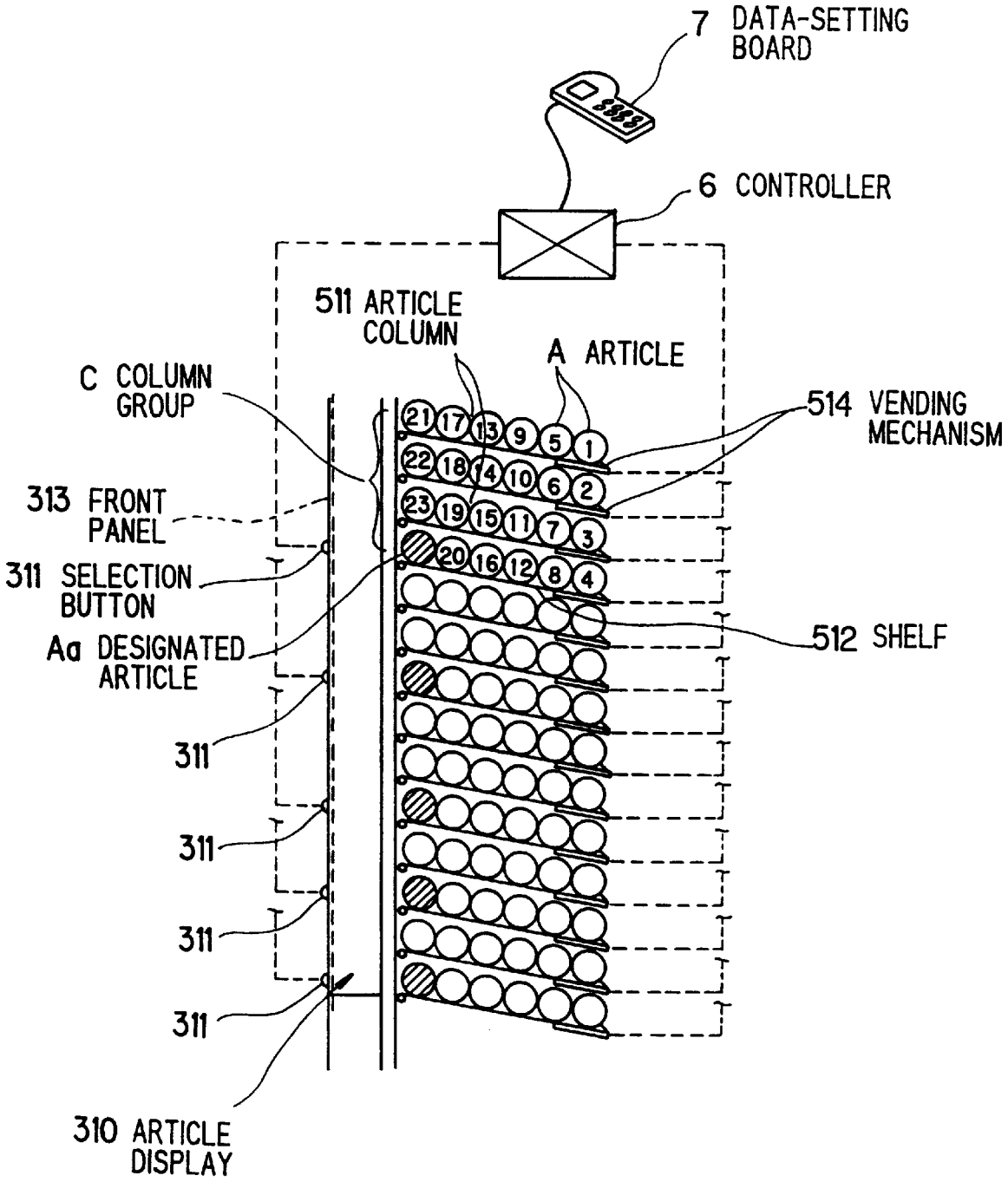
FIG. 4 is a view of explaining a column setting system of the vending machine according to the first embodiment of the invention.

The vending mechanism 514 of each article column 511 is assigned to the corresponding selection button 311 according to the above-mentioned column, group C. The assignment is set by a setting means which comprising a controller (CPU) 6 and a data-setting board 7 as shown in FIG. 4. For example, in the left-end article rack 510, the column groups C include four, three, three, two and two article columns 511, respectively, where the four article columns 511 of the top column group C correspond to a selection button 311 of number '1', the next three article columns 511 to a selection button 311 of number '2', the next three article columns 511 to a selection button 311 of number '3', the next two article columns 511 to a selection button 311 of number '4', and the next two article columns 511 to a selection button 311 of number '5'.

Though in the first embodiment the selection button 311 is located corresponding to the lowest article column 511 of each column group C, if the article A of the article column 511 located corresponding to the selection button 311 is set to be last sold, it is not necessary for the selection button 311 to be located corresponding to the lowest article column 511 of the column group C. For example, in the left-end article rack 510, without changing the location of the selection button 311, the selection button 311 can correspond to a column group C which includes article columns 511 from the top to the sixth. Here, the articles A of the top-rank article column 511 are first sold, then selling the articles A of the second, third-rank article columns 511, then selling the articles A of the sixth, fifth-rank article columns 511, finally selling the Articles A of the fourth-rank article column 511. In such way, an user can select an article A with no error, and the selection button 311 can correspond to the column group C by setting only the data-setting board 7 without changing the location of the selection button 311.

Next, the procedure for selling articles A of each column group C will be in detail explained with reference to the top column group C. As explained above, the articles A can be sold in the order of first, second, third-rank article columns, finally fourth-rank article columns. Alternatively, they may be sold such that the front article Aa of the fourth article column 511 is kept not to move by, e.g., a stopper to be left and the rear article A of the top article column 511 is first sold, then in turn selling the rear articles A of the second, third and fourth-rank article columns 511, being repeatedly conducted as such, as shown in FIG. 4. Furthermore, all the front articles A and Aa may be left. In this way, even when the article A is sold out, the front articles A and Aa can be left as article samples to enhance the appealability of the article display 310. Moreover, it can prevent an operator from erroneously loading another kind of article A into an article column 511.

As described above, in the first embodiment, since a plurality of article columns 511 with vending mechanisms 514 are optionally combined into a column group C in which only one selection button 311 is used for selling articles thereof, the number of articles A to be stored can be flexibly set to each kind of article A. Here, if the number of each kind of article A is set with the past selling records, all kinds of articles A can be almost simultaneously sold out to enhance the loading efficiency. Furthermore, since an article A to be sold and the situation of selling can be actually seen through the article display 310, article samples can be omitted and the appealability of article A can be enhanced.

Figure 5:
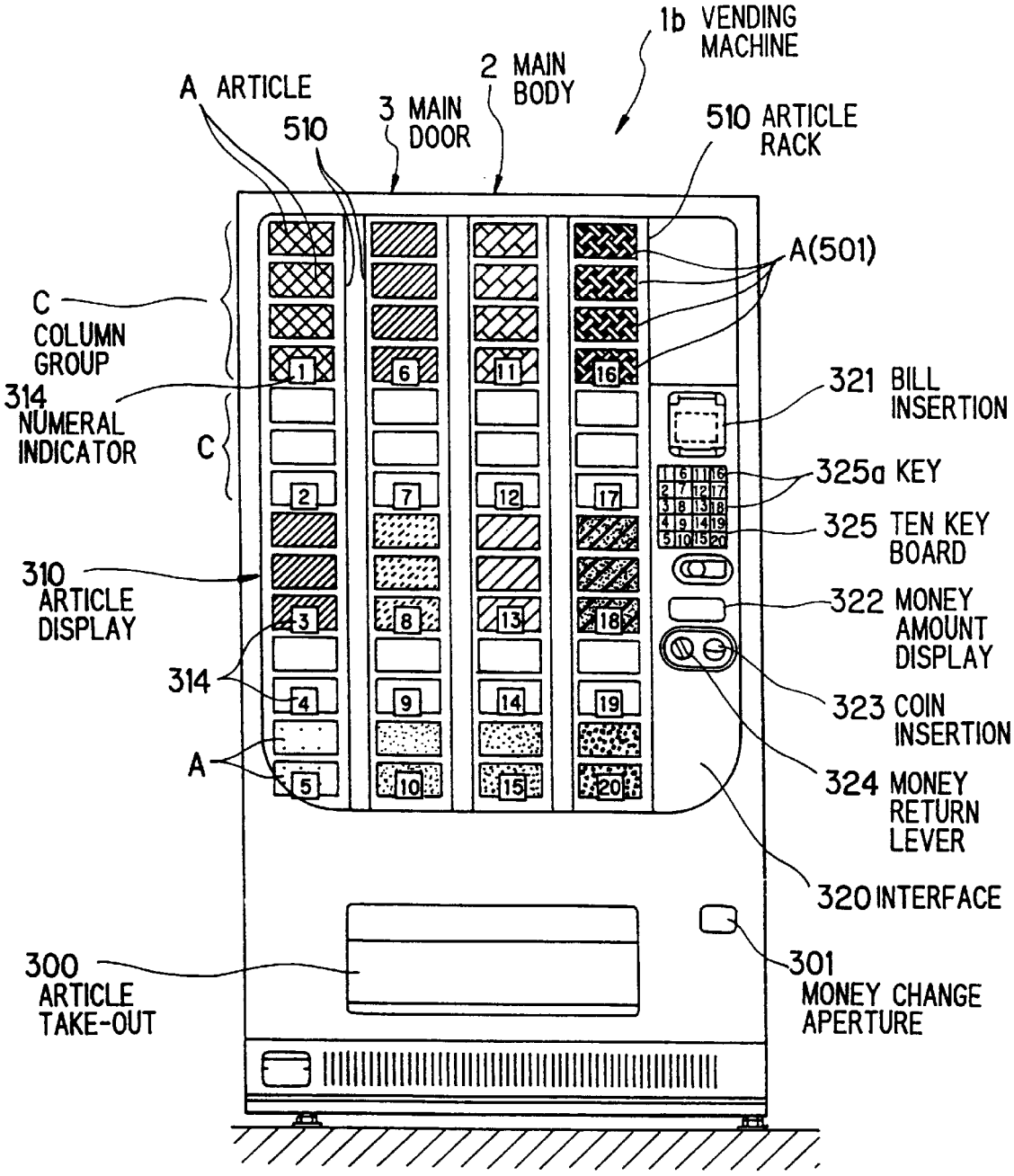
FIG. 5 is a front view of a vending machine according to the second embodiment of the invention.

A see-through type vending machine in the second preferred embodiment according to the invention will be explained in FIG. 5. In the see-through type vending machine 1*b,* the selection of article A can be carried out by a ten key, board 325 which replaces the selection button 311 in the first embodiment. The interface 320 of the main door 3 is provided with the ten key board 325 having matrix-forming keys 325*a* which are numbered one to twenty, and the front panel 313 of the article display 310 is provided with numeral indicators 314 which are numbered one to twenty corresponding to the lowest article column 511 of each column group C. In this case, the ten key board 325 and numeral indicators 314 are corresponding to the selection button 112. Each article column 511 is set to correspond to each key 325*a* of the ten key board 325 through the column group C including thereof by the data-setting board 7.

Meanwhile, the numeral indicator 314 may be composed of an adhesive sheet or the like. It can adhere to the back surface of the front panel 313 to facilitate the changing of the indication of column group C.

Figure 6:
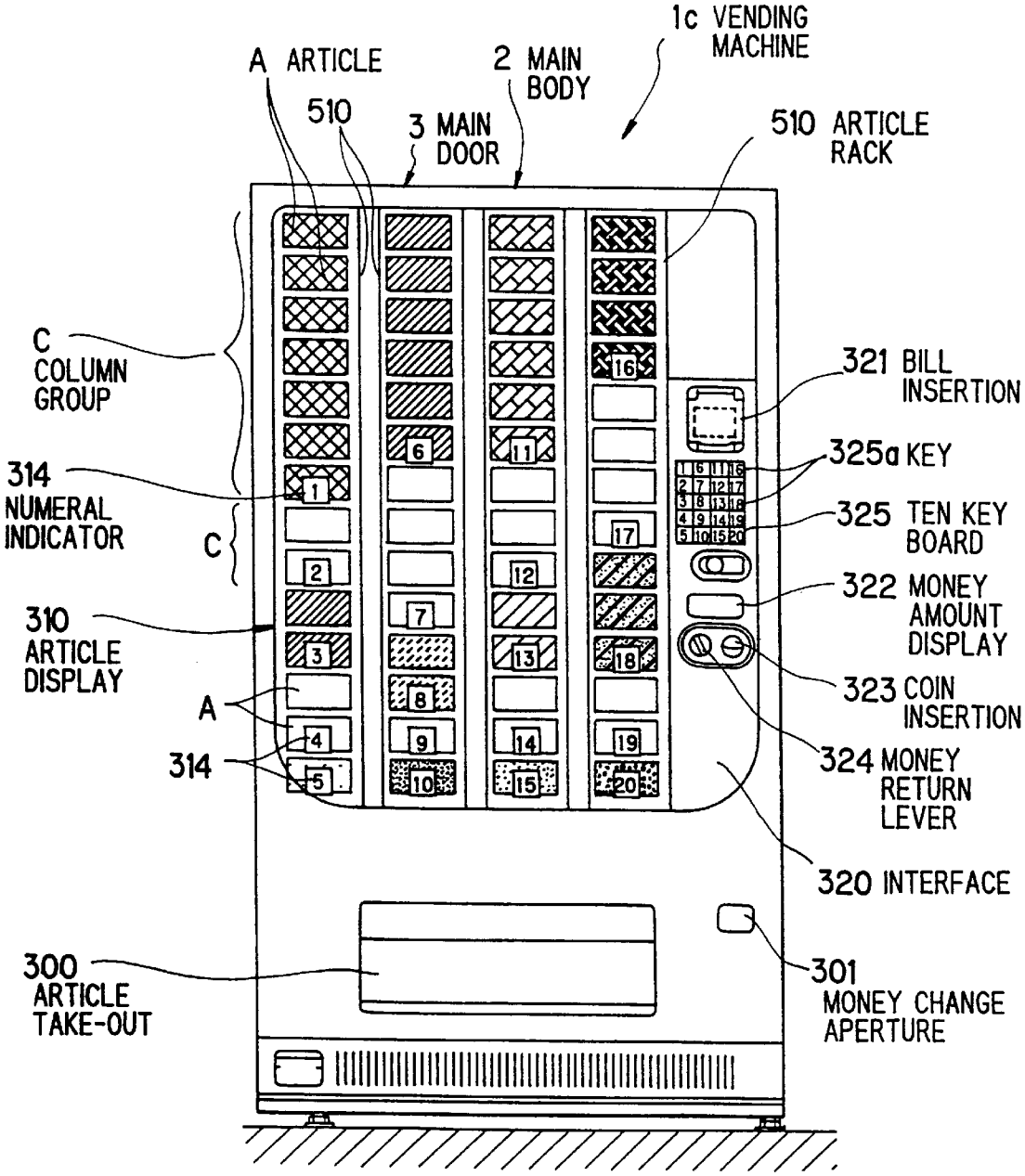
FIG. 6 is a front view of a vending machine according to the third embodiment of the invention.

A see-through type vending machine in the third preferred embodiment according to the invention will be explained in FIG. 6. In the see-through type vending machine 1*c,* utilizing that stared articles A can be seen through the article display 310, a number of the article column 511 is assigned to each column group C depending on the past selling records thereof. This assignment allows the pattern of articles seen through the article display 310 to be presented as a kind of display pattern.

In the third embodiment, though the numeral indicators 314 are not uniform, they can look as if the popularity(best seller) of article is shown by a bar graph, therefore enhancing the appealability of article A. Thus, a novel display pattern of article A can be presented which gives an incentive to buy the article A to an user.

Figure 7:
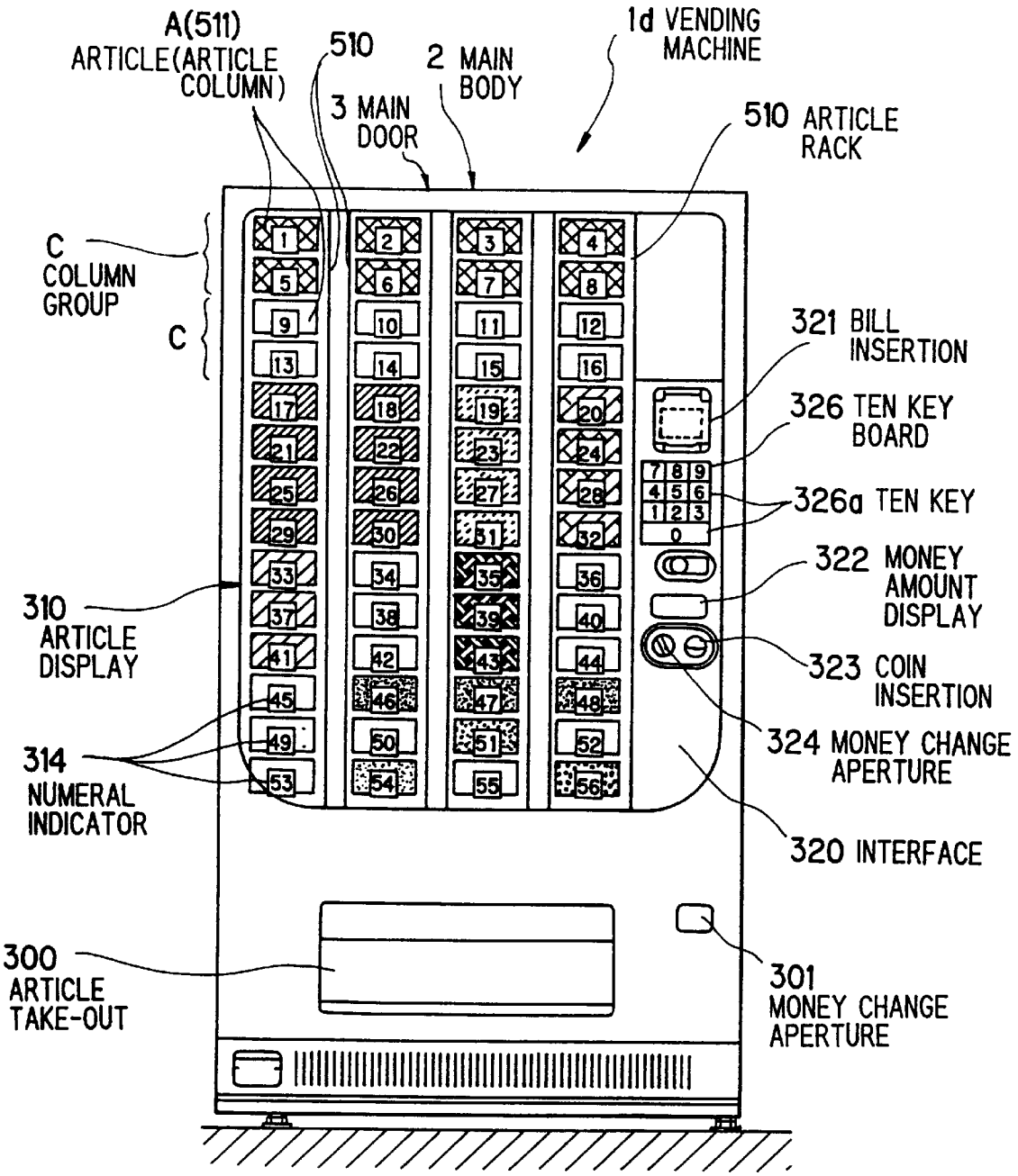
FIG. 7 is a front view of a vending machine according to the fourth embodiment of the invention.

A see-through type vending machine in the fourth preferred embodiment according to the invention will be explained in FIG. 7. In the see-through type vending machine 1*d,* all the article columns 511 have numeral indicators 314 and column groups C are assigned independent of the numeral indicators 314. Since there are in total fifty-six article columns 511 which are composed of four files and sixteen ranks, the article columns 511 have the numeral indicators 314 numbered one to fifty-six. In this case, the ten key board 326 is composed of keys 326*a* numbered zero to nine, where an article A desired can be selected by keying the number of the article A.

In the fourth embodiment, an article A to be selected is sold directly from the article column 511 with the number of the article A. Thus, the characteristic of the see-through type vending machine 1*d* that the article A and the situation of selling can be seen through can be sufficiently used.

Figure 8:
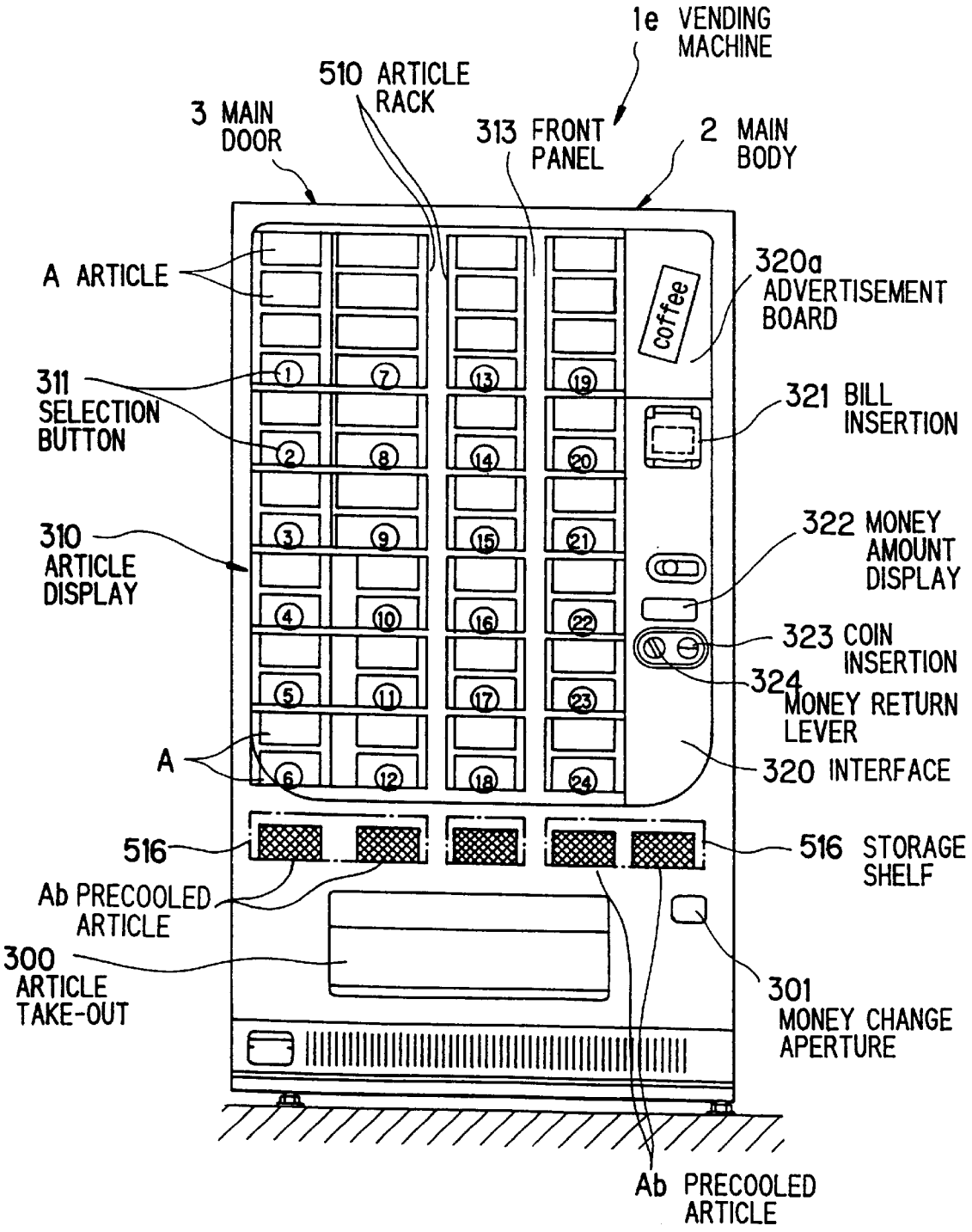
FIG. 8 is a front view of a vending machine according to the fifth embodiment of the invention.
Figure 9:
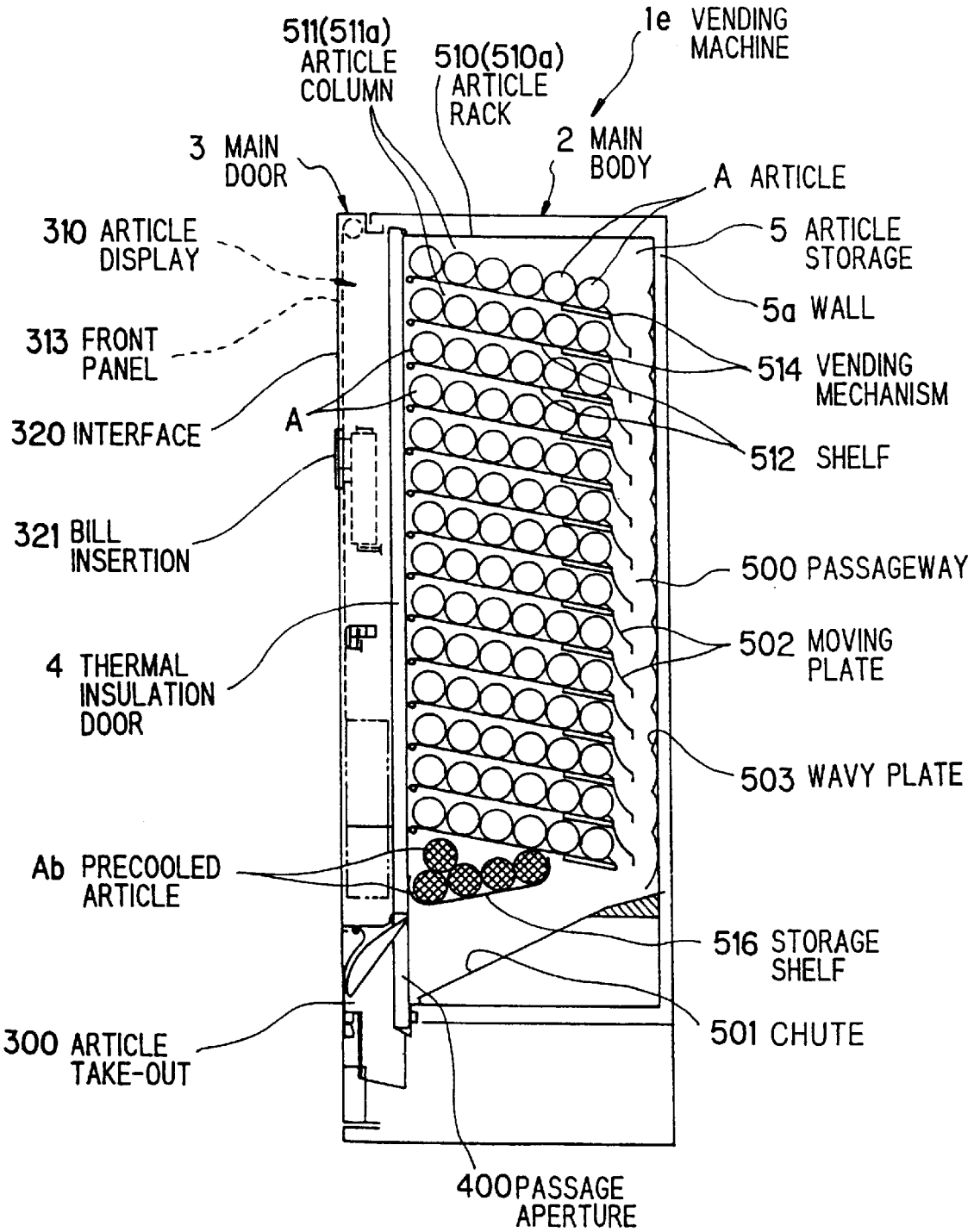
FIG. 9 is a longitudinal section view of the vending machine according to the fifth embodiment of the invention.
Figure 10:
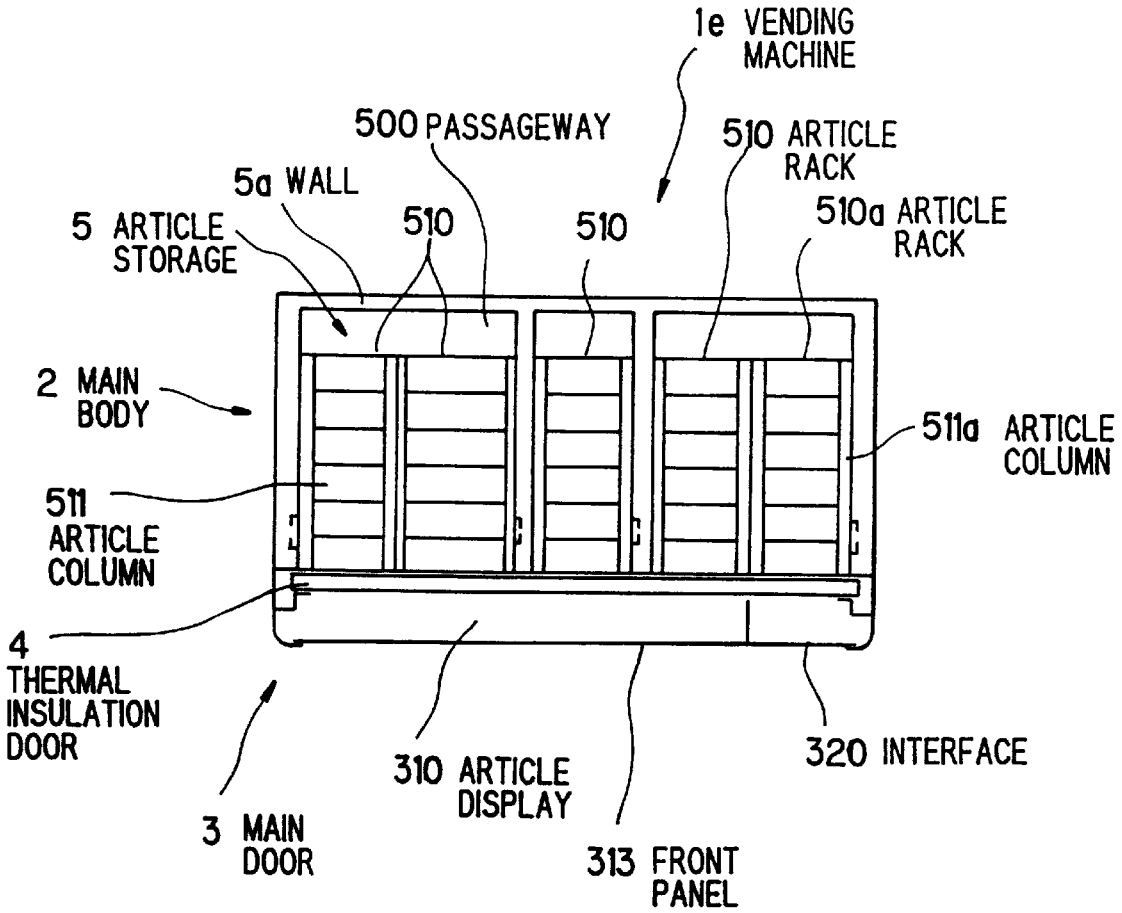
FIG. 10 is a transverse section view of the vending machine according to the fifth embodiment of the invention.

A see-through type vending machine in the fifth preferred embodiment according to the invention will be explained in FIGS. 8 to 10 which are a front view, a longitudinal sectional view and a cross sectional view thereof, respectively. In the see-through type vending machine 1*e*, the article storage 5 has five files of article racks 510 disposed left to right. The upper part of the interface 320 is used as an advertisement board 320*a*. Namely, the right-end article rack 510*a* located behind the interface 320 is covered with the interface 320 and therefore the articles A to be stored therein are not seen.

In this case, in each of the column groups C abovementioned, four or two vending mechanisms 514 for article column 511 can be optionally actuated by one selection button 311. A selection button 311 is assigned to the article columns 511*a* of the article rack(extended rack) 510*a* which are located behind the interface 320 to actuate the vending mechanisms thereof. Namely, the article columns 511*a* located behind the interface 320 are belonging to some column groups C, and in each article column 511*a* the same articles A as that of the corresponding column group C are stored as supplements. Here, as shown in FIG. 9, one article column 511*a* can store six articles A and the number of the supplements can therefore be set using an unit of six articles A. This means that the number of articles to be stored can be flexibly set to each kind of article A and therefore the number of remainders can be controlled to be constant among different kinds of article.

On the other hand, in the part observed from outside, there are column groups C each of which includes adjacent four or two article columns 511 and includes like articles A. In each column group C, the vending mechanism 514 of each article column 511 is controlled to carry out the selling of article A by a control means(not shown). For example, in the column group C including the top four article columns 511, an article A of the top-rank article column 511 is first sold, then in turn selling the article A of the second-rank, third-rank article columns 511, and finally selling the article A of the fourth-rank article column 511 where the selection button 311 is provided. Herein, these articles A are preferably sold after selling the articles A of the article column 511*a* located behind the interface 320.

Alternatively, the front article A of the fourth-rank article column 511 may be kept not to move by, e.g., a stopper to be left until sold-out. Namely, the article A corresponding to the selection button 311 is always left as an article sample. In this way, even after the article A is sold out, the front article A to be left functions to appeal to customers. Moreover, it can prevent an operator from erroneously loading another kind of article A into an article column 511.

In the fifth embodiment, each article column 511 is formed to decline to the rear side and the chute 501 is formed to decline to the front side. Therefore, below the front part of the bottom shelf 512, there is a space. Utilizing this space, storage shelves 516 for storing precooled articles Ab are, as shown in FIG. 9, provided below the front parts of the bottom shelves 512 of the article racks 511. The storage shelf 516 is placed to give a sufficient clearance between the chute 501 and itself where an article A rolls down. Thus, the space inside the article storage 5 can be efficiently used.

As described above, in the fifth embodiment, the article column 512*a* provided at the space behind the interface 320, where articles A are not seen from outside, the space can be efficiently used.

Figure 11:
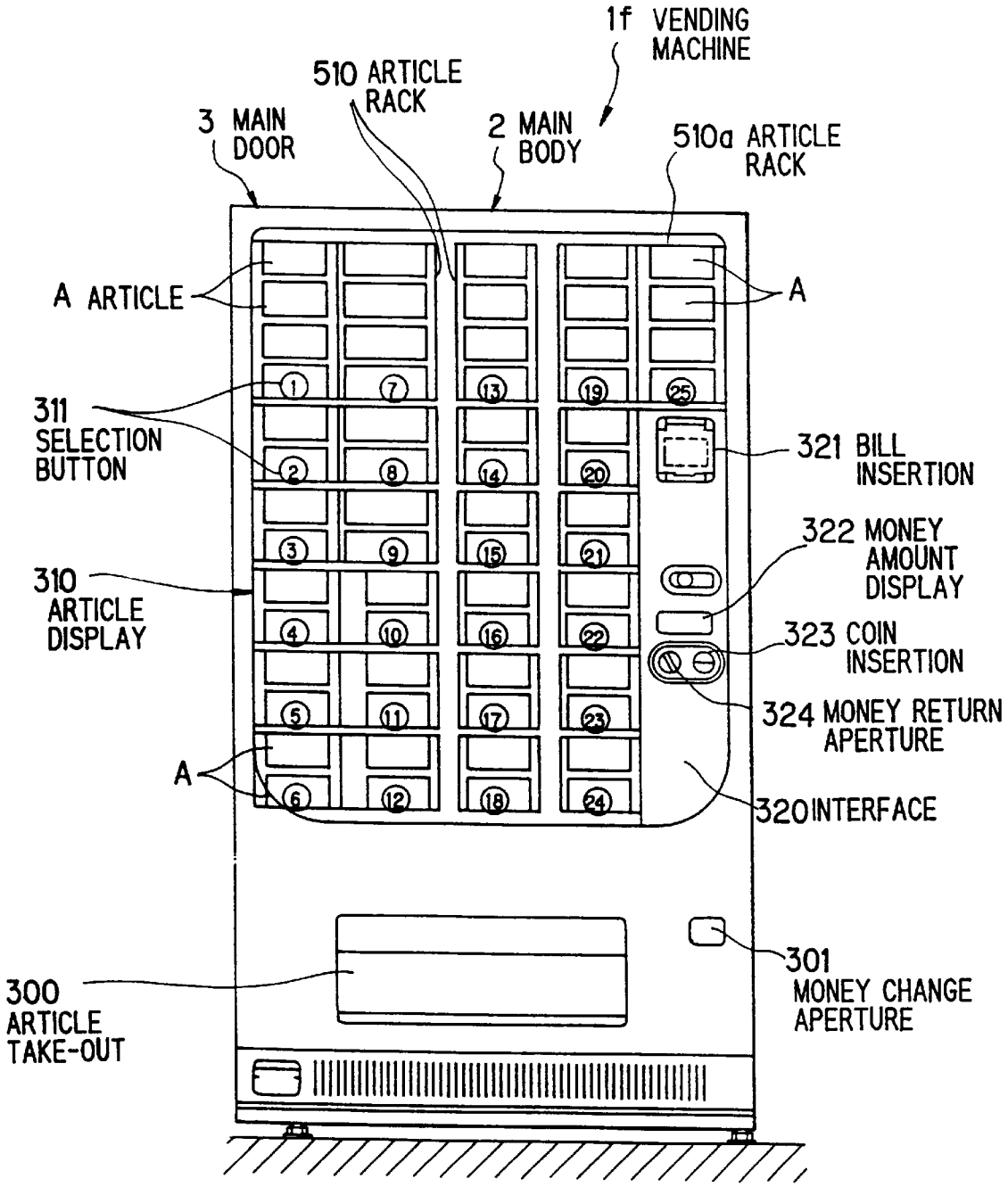
FIG. 11 is a front view of a vending machine according to the sixth embodiment of the invention.
Figure 12:
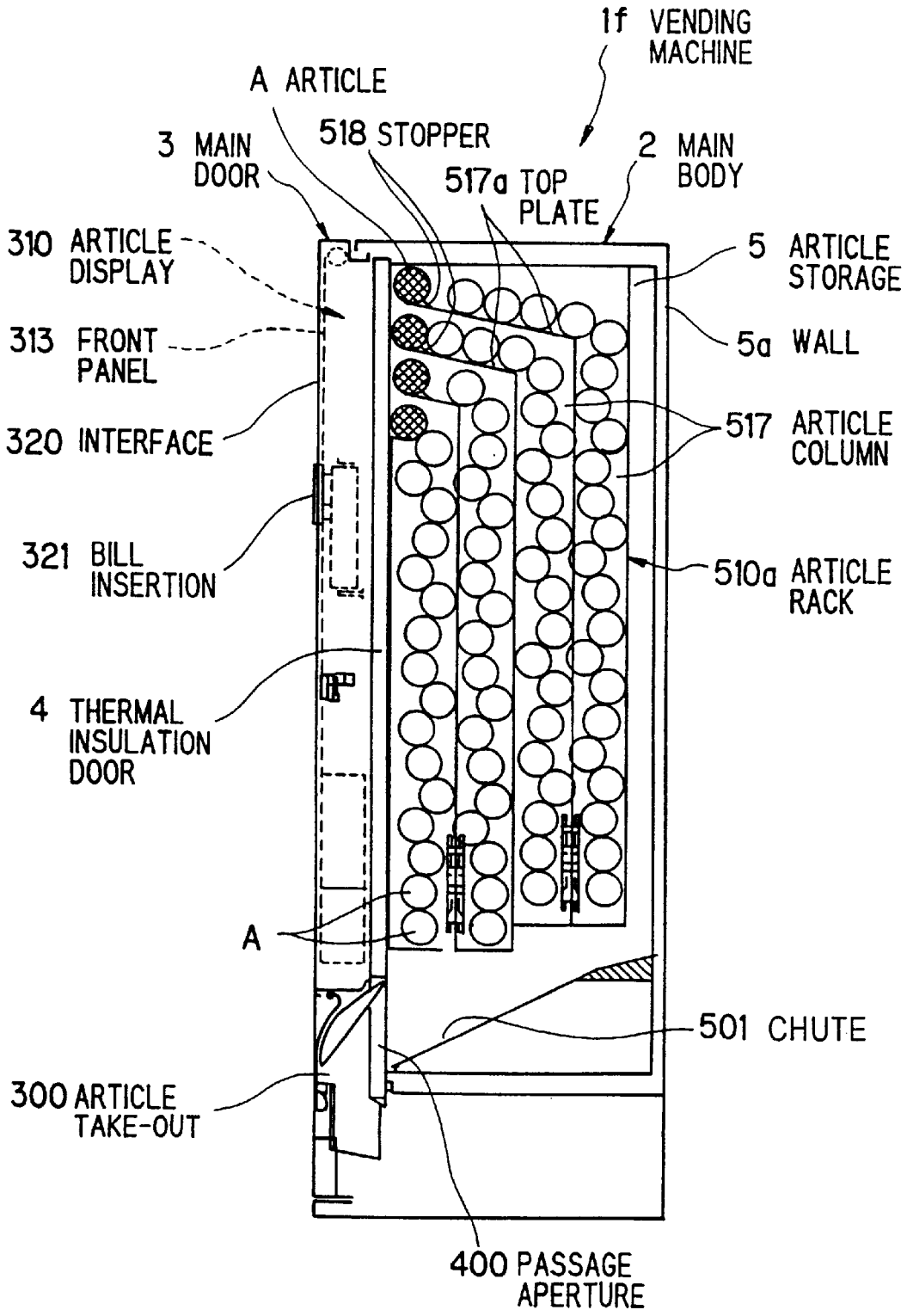
FIG. 12 is a longitudinal section view of the vending machine according to the sixth embodiment of the invention.

A see-through type vending machine in the sixth preferred embodiment according to the invention will be explained in FIGS. 11 and 12. In the sixth embodiment, the article rack 510*a* provided behind the interface 320 is composed of four rows of serpentine-type article columns(extended columns) 517. To the upper part of the interface 320, where corresponds to the advertisement board 320*a* explained above, the article display 310 is extended. Through the extended part, articles A on top plates 517*a* of the article columns 517 can be seen. To the four rows of article columns 517, which are defined as one column group C, a selection button 311 is assigned. In this case, the column group C can store so many like articles A which are preferably, for example, a recommended article or best seller article. It is preferable that the front article A on the top plate 517*a* is kept not to move by, for example, a stopper to be always left as an article sample even when the article A is sold out.

As explained above, since the article columns 517 behind the interface 320 are formed as serpentine-type, so many like articles A can be stored therein. Thus, when this place is used to store recommended articles or best seller articles, it can prevent one column group C in the entire article display 310 from being seen excessively enlarged.

Meanwhile, in the fifth and sixth embodiments, the interface 320 has a width as wide as an article rack. However, considering the space for a coin mechanism, it may have a width as wide as two article racks.

Figure 13:
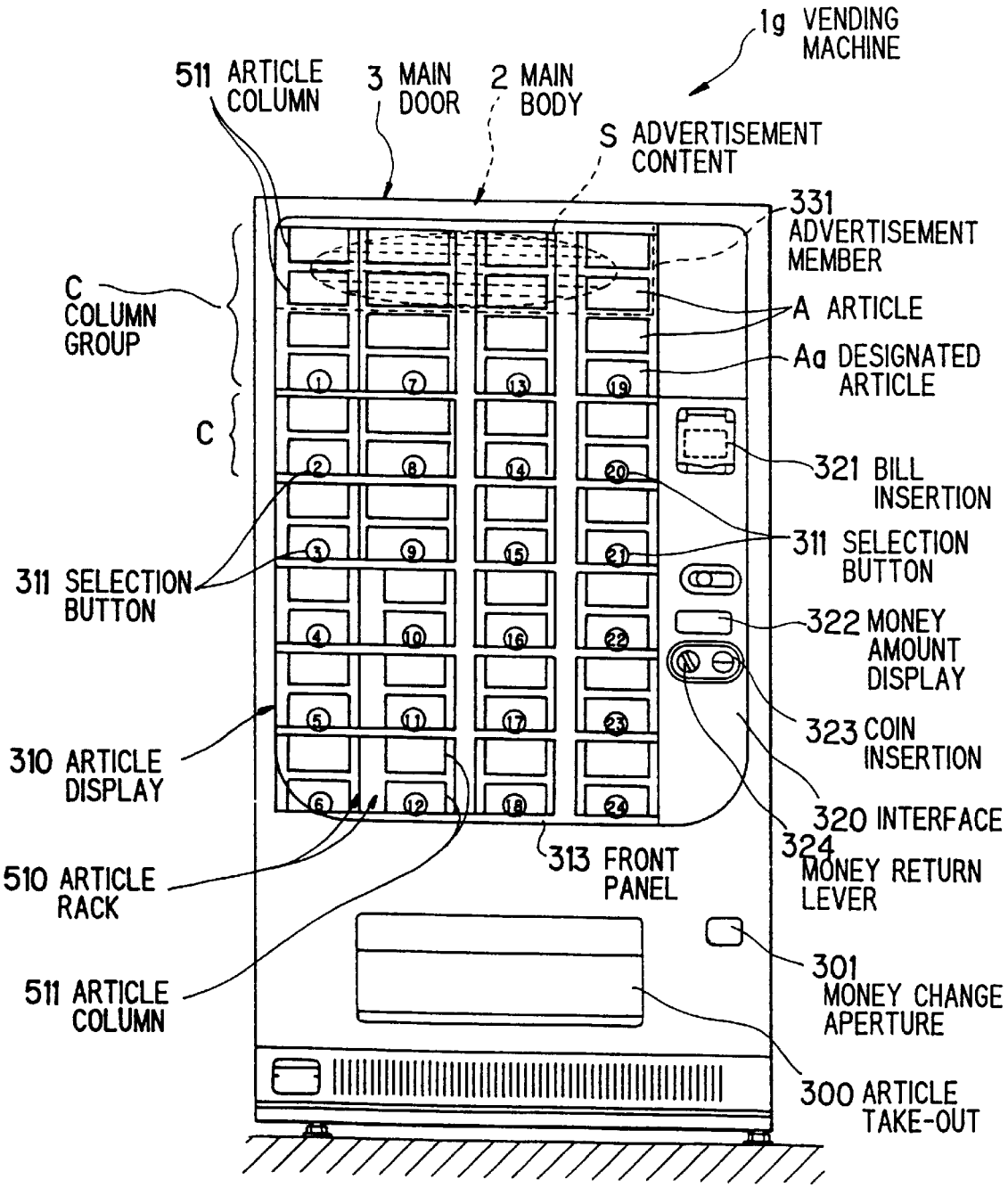
FIG. 13 is a front view of a vending machine according to the seventh embodiment of the invention.
Figure 14:
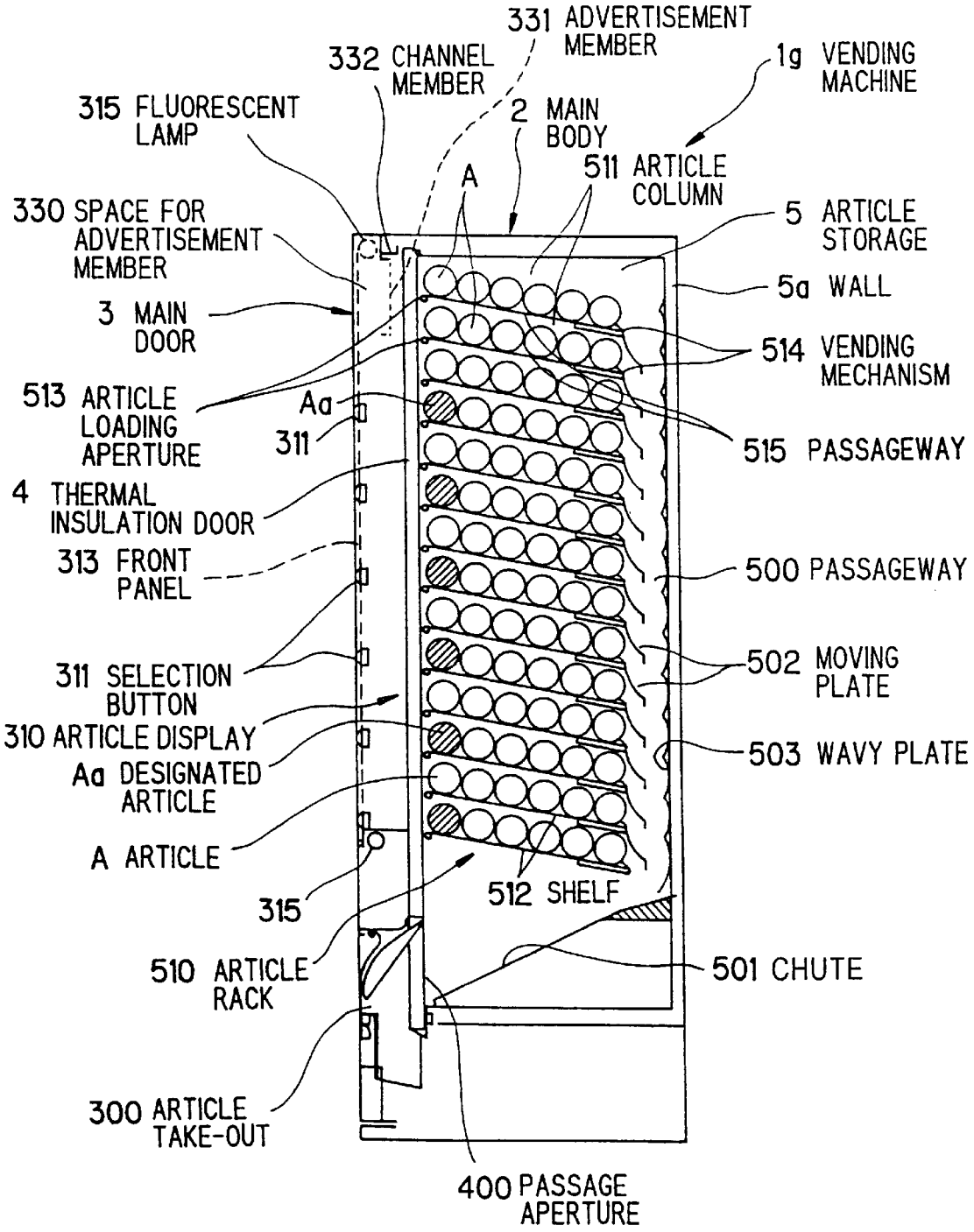
FIG. 14 is a longitudinal section view of the vending machine according to the seventh embodiment of the invention.
Figure 15:
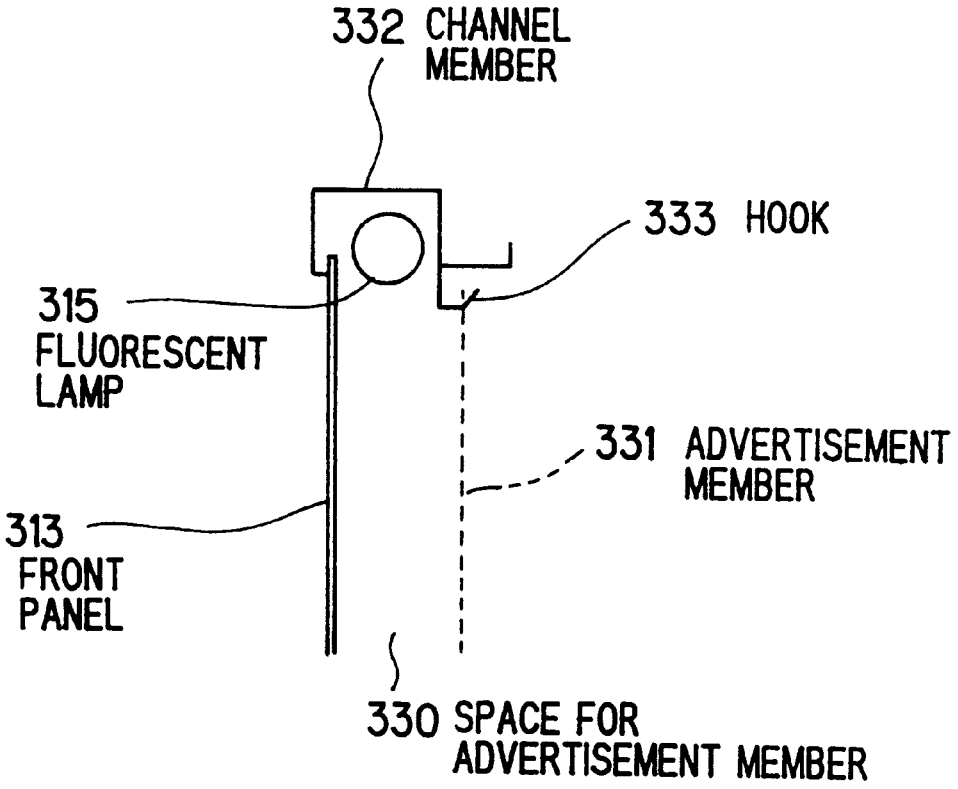
FIG. 15 is a grossly enlarged longitudinal section view of a surrounding of a signboard member of the vending machine according to the seventh embodiment of the invention.

A see-through type vending machine in the seventh preferred embodiment according to the invention will be explained in FIGS. 13 and 14 which are a front view and a longitudinal sectional view thereof, respectively. In the see-through type vending machine 1*g*, an advertisement member 331 is provided at the upper part of the article display 310 and in a space 330 between the front panel 313 and the thermal insulation door 4. The advertisement member 331 is composed of a transparent sheet on which an advertisement content S such as a name of manufacturer (logo) is printed. As shown in FIG. 15, it is releasably suspended on the hook 333 of a channel member 332 provided at the top of the space 330. In this case, if the advertisement is not necessary, the advertisement member 331 can be released or optionally be replaced by an advertisement member with another advertisement content S. Here, numerals 315 in FIGS. 14 and 15 indicate fluorescent lamps which light the article display 310 from the top and bottom.

Figure 17:
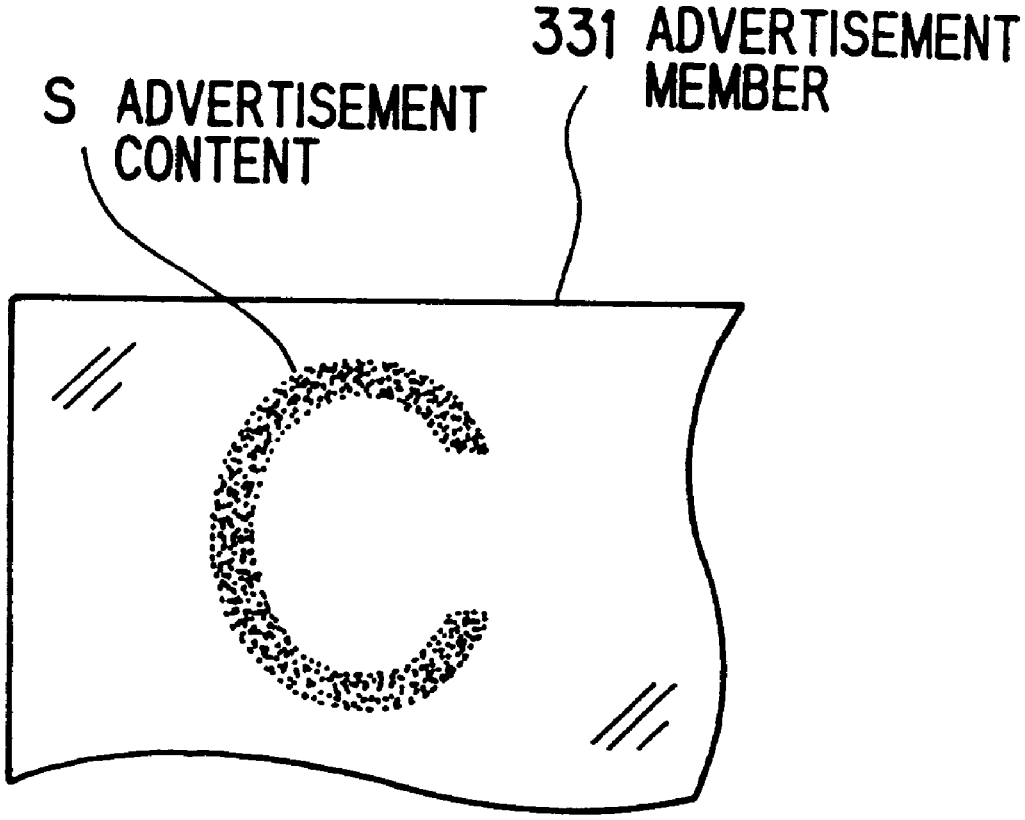
FIG. 17 is a plan view for representing a print state (2) of the advertisement content on the signboard member.

The advertisement content S printed on the adertisement member 331 is, for example, a pattern(or a character) which is composed of an assemblage of dots disposed with an interval, where the outline of the pattern or character is formed by the dots. Alternatively, the advertisement content S on the advertisement member 331 may be, as shown in FIG. 17, a semitransparent printed pattern As a resume, through the front panel 313, the advertisement content S printed on the advertisement member 331 can be seen, and articles A stored as displayed in the article racks 510 can be further seen as they overlap behind it.

Figure 16:
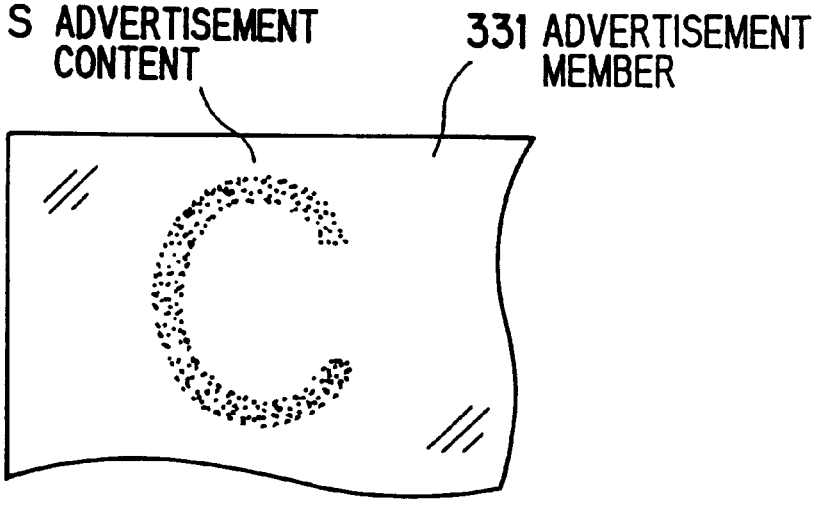
FIG. 16 is a plan view for representing a print state (1) of an advertisement content on the signboard member.
Figure 18:
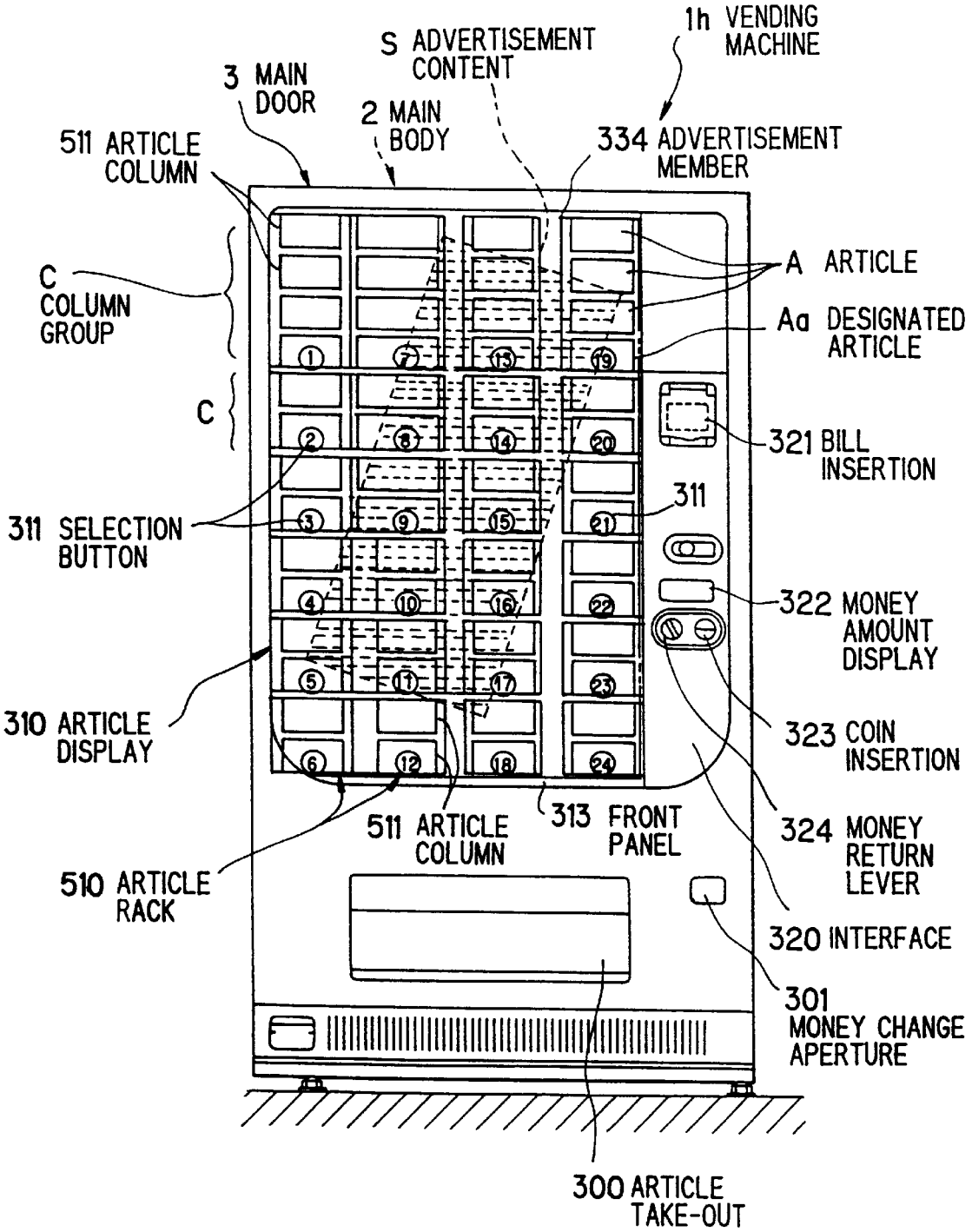
FIG. 18 is a front view of a vending machine according to the eighth embodiment of the invention.
Figure 19:
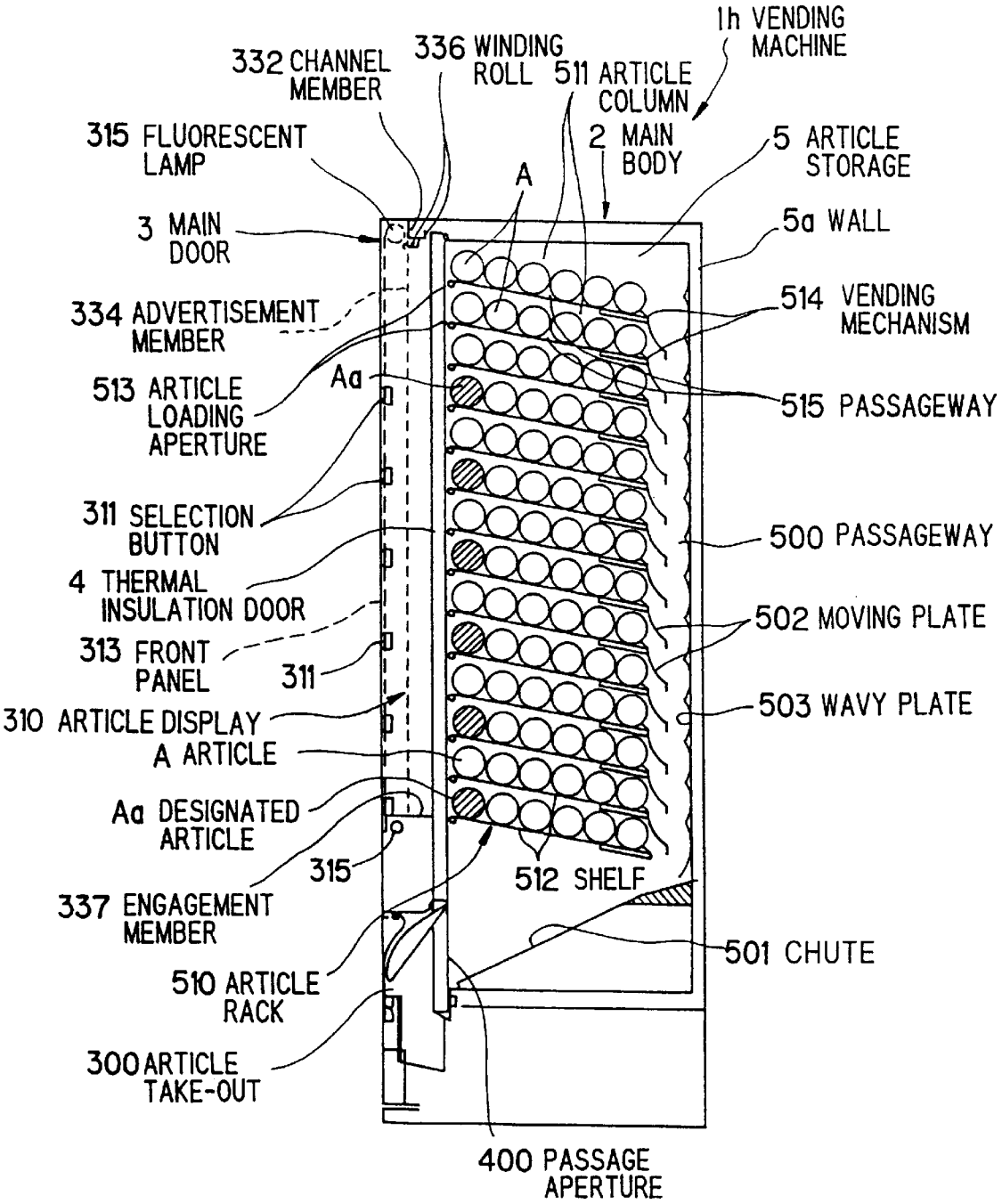
FIG. 19 is a longitudinal section view of the vending machine according to the eighth embodiment of the invention.

A see-through type vending machine in the eighth preferred embodiment according to the invention will be explained in FIGS. 18 and 19. In the see-through type vending machine 1*h*, the advertisement member 334 composed of a transparent sheer is provided to cover the entire surface of the article display 310. On the advertisement member 334, an advertisement content S is widely printed by the method explained above with reference to FIG. 16 or 17, where articles A stored can be seen overlapping behind this advertisement content S.

Figure 20:
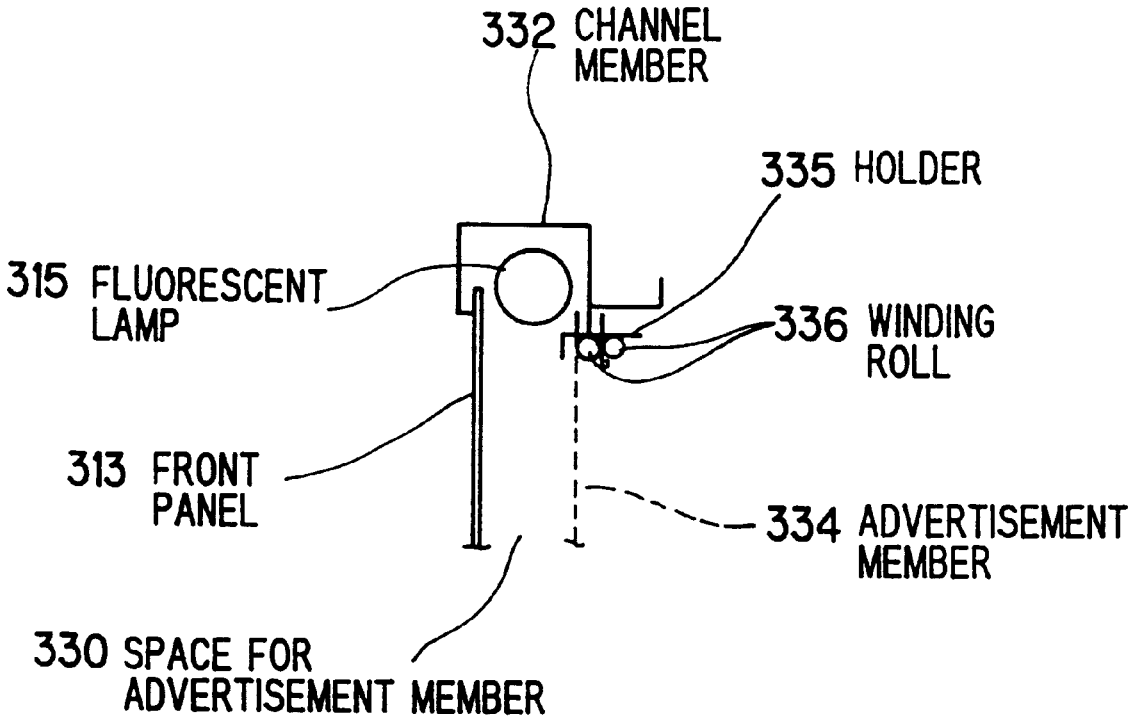
FIG. 20 is a grossly enlarged longitudinal section view of a surrounding of a signboard member of the vending machine according to the eighth embodiment of the invention.
Figure 20:
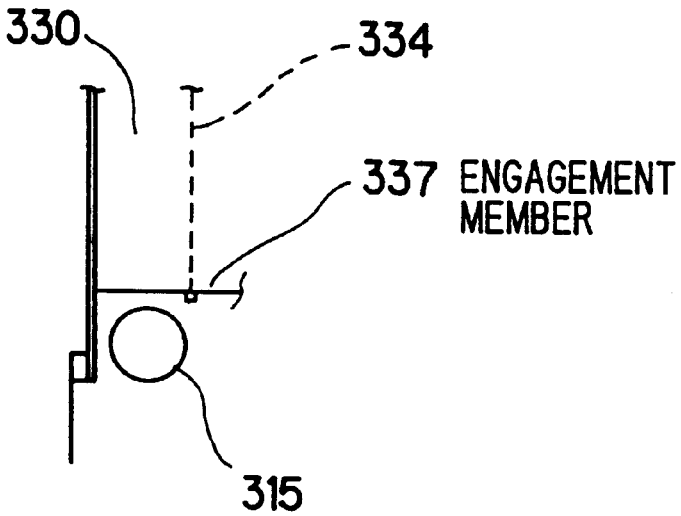

In this case, as shown in FIG. 20, the channel member 332 is provided with a holder 335 in place of the hook 333 and the holder 335 is provided with two winding rolls 336, 336. To each winding roll 336, the advertisement member 334 which can be wound up and off is connected while being forced in the direction of winding-up. The bottom end of the advertisement member 334 can be engaged to an engagement member 337 when it is wound off. The two advertisement members 334, 334 have different advertisement contents S printed on theme. Therefore, if the advertisement is not necessary, the advertisement member 334 can be wound up by the winding roll 336, and one of the advertisement members 334, 334 can be selectively wound off to be used for the advertisement of a name of manufacturer etc.

As explained above, in the see-through type vending machines 1*g*, 1*h* of the seventh and eighth embodiments, both the front panel 312 of the article display 310 and the thermal insulation door 4 are composed of transparent glass or the like so that articles A to be sold and the situation of selling can be actually observed through the article display 310. Therefore, article samples can be omitted as well as enhancing the appealability of articles A. Furthermore, the advertisement member 331 or 334 composed of a transparent sheet is provided in the space between the front panel 312 and the thermal insulation door 4 so that the advertisement content S can be widely displayed while seeing the article A through. As a result, the article A and the name of manufacturer etc. can simultaneously and equally appeal to a customer, and the appealability of the article display 310 itself can be enhanced.

Meanwhile, an advertisement content may be printed, which is not shown, inside the front panel instead of using the abovementioned advertisement member. In addition, the advertisement member may be composed of a panel or the like.

Figure 21:
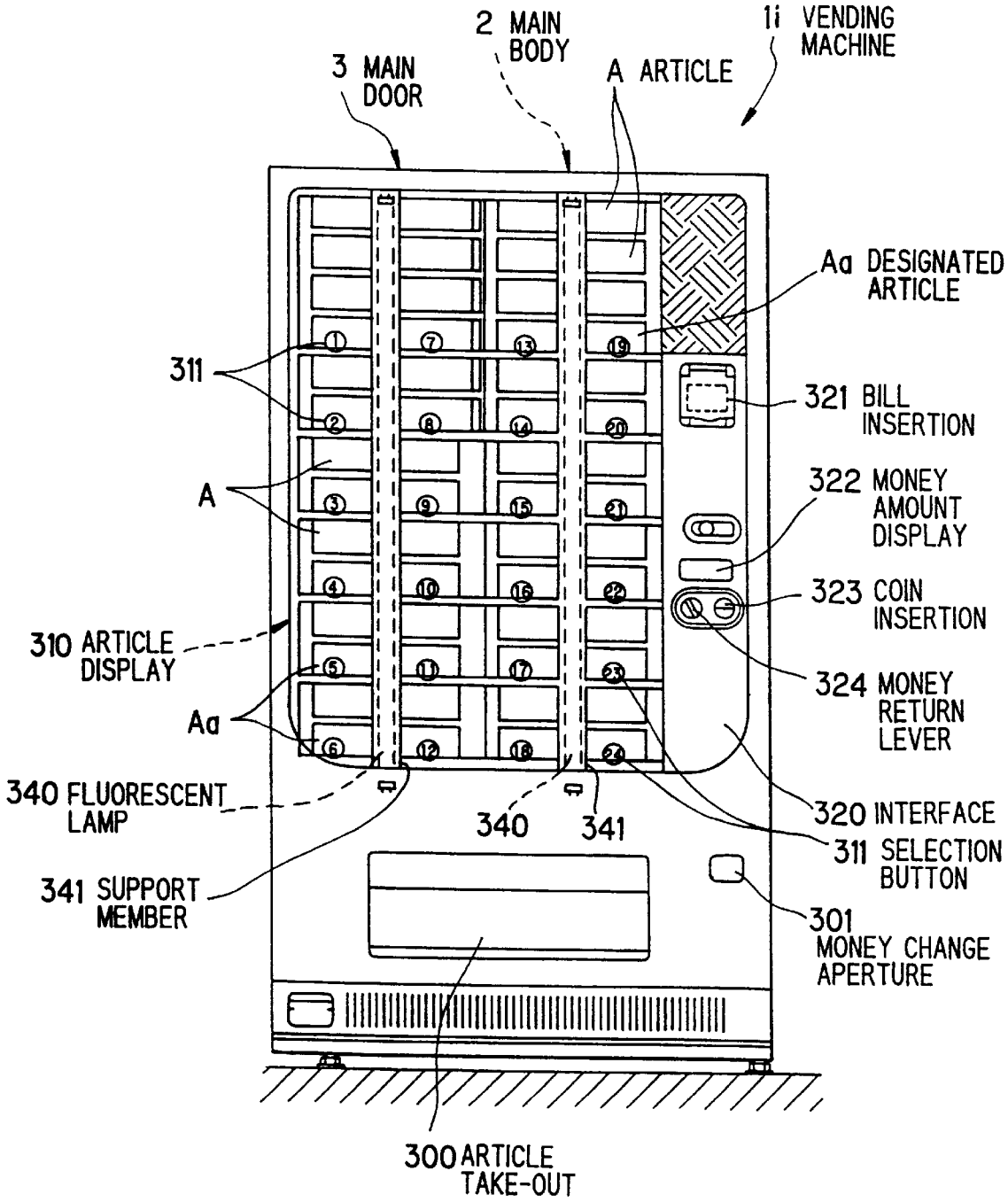
FIG. 21 is a front view of a vending machine according to the ninth embodiment of the invention.
Figure 22:
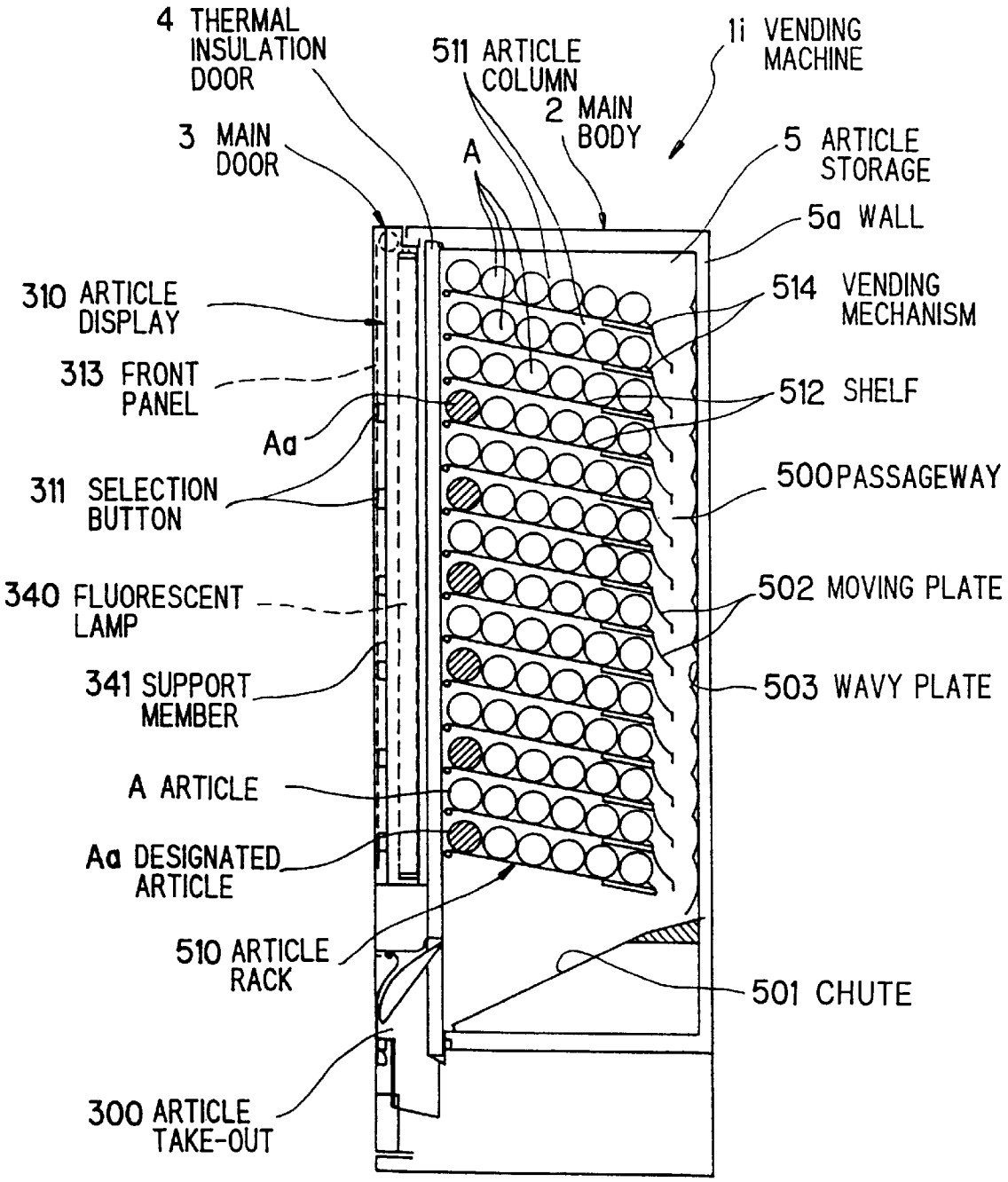
FIG. 22 is a longitudinal section view of the vending machine according to the ninth embodiment of the invention.
Figure 23:
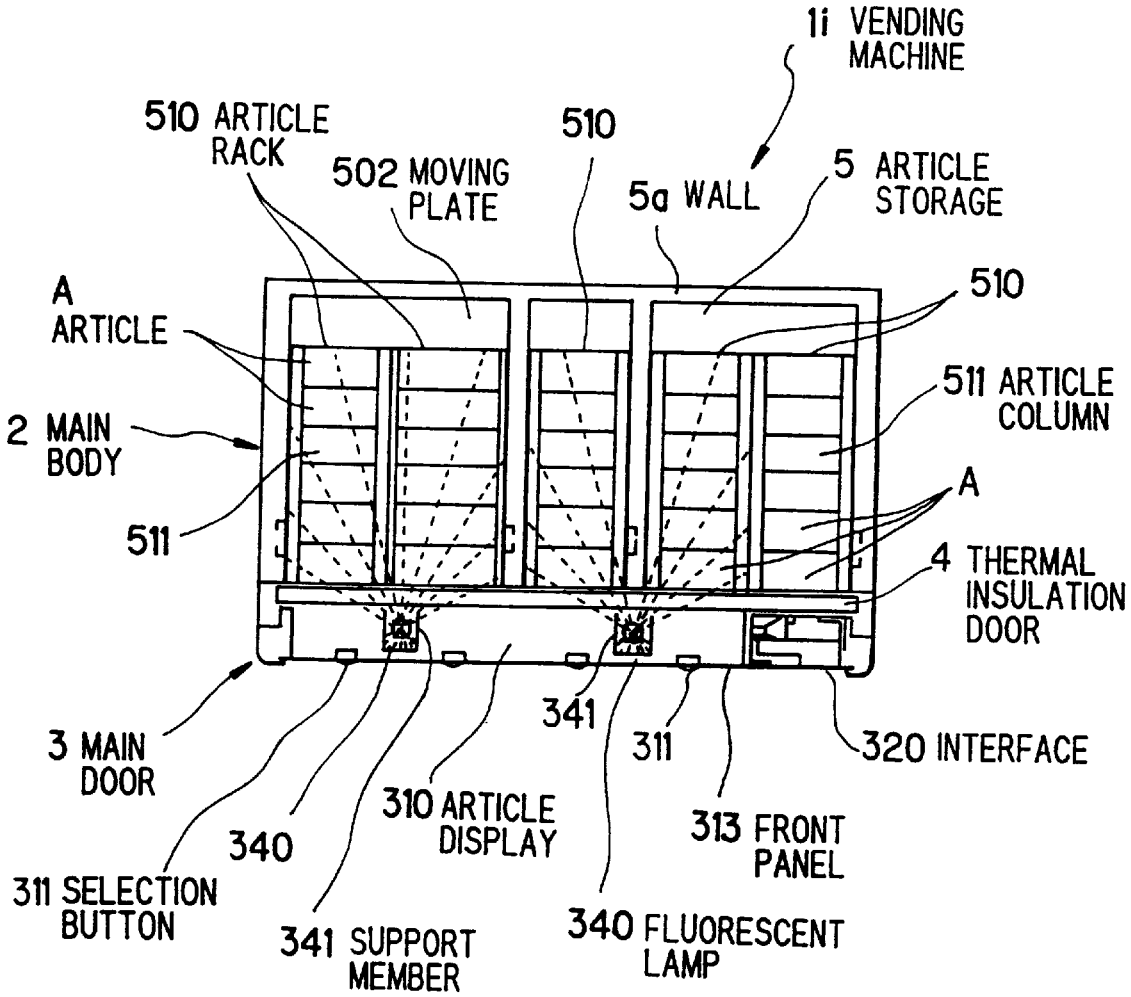
FIG. 23 is a transverse section view of the vending machine according to the ninth embodiment of the invention.

A see-through type vending machine in the ninth preferred embodiment according to the invention will be explained in FIGS. 21 to 23 which are a front view, a longitudinal sectional view and a cross sectional view thereof, respectively. In the see-through type vending machine 1*i*, the right-end article column 511 is located behind the interface 320 therefore not being seen from outside, and it is provided with no selection button 311. However, it is preferable that in the article column 511, a best-seller article, a recommended article or the like is optionally stored and it is corresponded to a selection button 311 and is sold prior to the article A to be seen.

On the other hand, in the main door 3, two fluorescent lamps 340, 340 which are used as a lighting device are provided vertically running through behind the article display 310 and between the front panel 313 and the thermal insulation door 4 and are surrounded by support members 341, 341. The fluorescent lamps 340, 340 are provided to light the inside of the vending machine 1*i*, especially articles A to be stored. They are located at the border area between the left-end article rack 510 and the nest article rack 510 and the border area between the third-file article rack 510 and the fourth-file article rack 510. Therefore, the fluorescent lamps 340 do not prevent the article A from being seen through and can light the article A to be seen with an almost equal brightness.

The support member 341 is composed of a channel member with a cross section formed like a square which is open only in the direction of the inside of the vending machine 1*i*. It supports the fluorescent lamp 340 inside and surrounds the fluorescent lamp 340 to be covered not to be seen from outside. The inner surface of the fluorescent lamp 340 has a metal color as it is or is coated with a white color material to reflect the light of the fluorescent lamp 340 to the inside of the vending machine 1*i*. Thus, the fluorescent lamp 340 can be disposed as it is covered and the light of the fluorescent lamp 340 can efficiently light the inside of the vending machine 1*i*. Optionally, inside the support member 341, harness(control wiring) for the selection button 311 may be disposed.

By the way, in such kind of canned beverages(article A), there are front and back sides, where the front side is defined as a side to be printed with a logo etc., and the distinguishability and appealability of the article A are suite different between the front side and back side. In the ninth embodiment, since the articles A loaded are seen through as they are, the articles A are not uniformly stored while showing the front or back side. Thus, there is a problem that the distinguishability and appealability of the article A are reduced, while the article and the situation of selling can be seen through. In addition, when the number of article A to be seen from outside is decreased due to the progress of selling, the correspondence between the article A to be bought and the selection button 311 may be unclear. Such problems are to be solved by a see-through type vending machine explained below.

Figure 24:
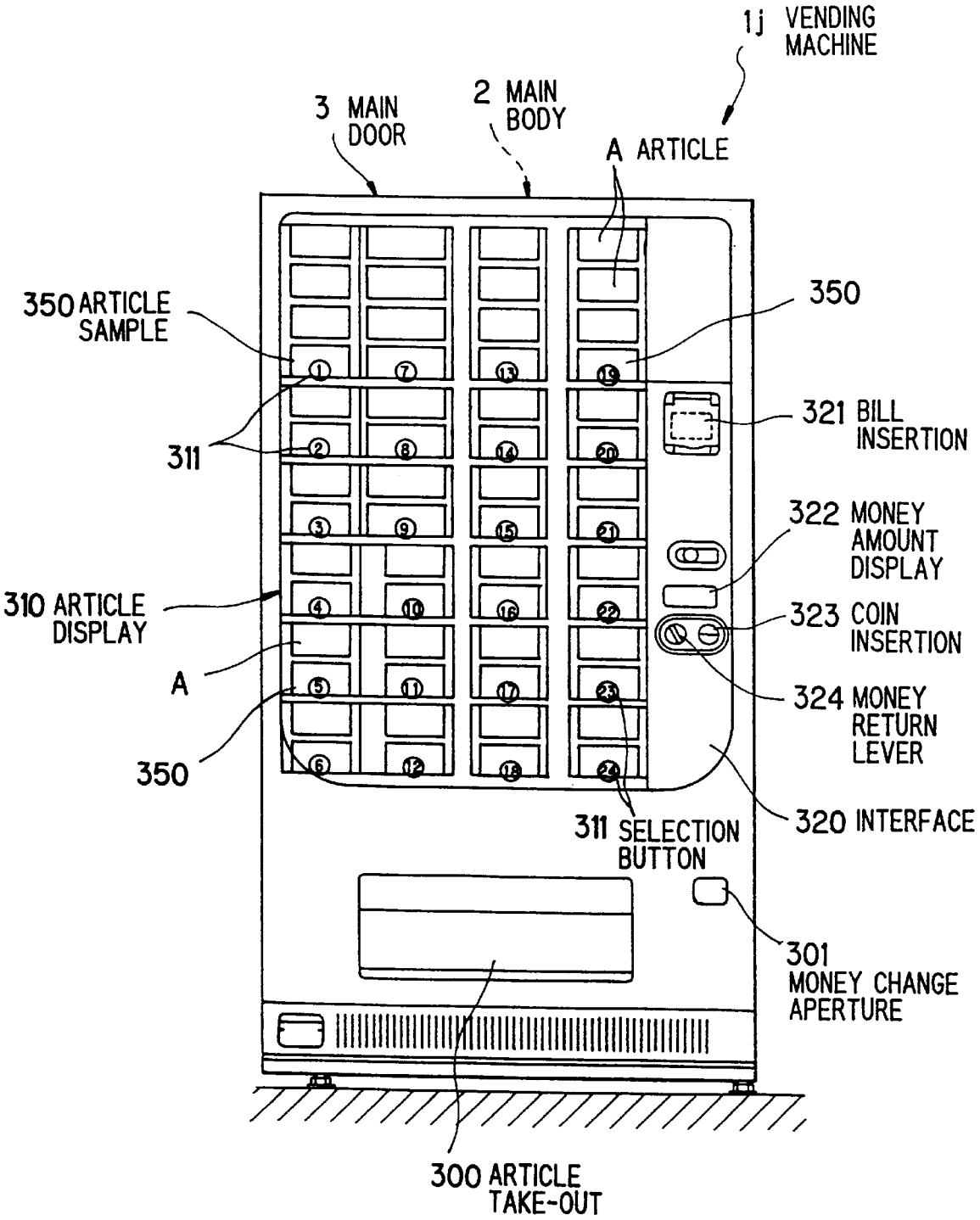
FIG. 24 is a front view of a vending machine according to the tenth embodiment of the invention.
Figure 25:
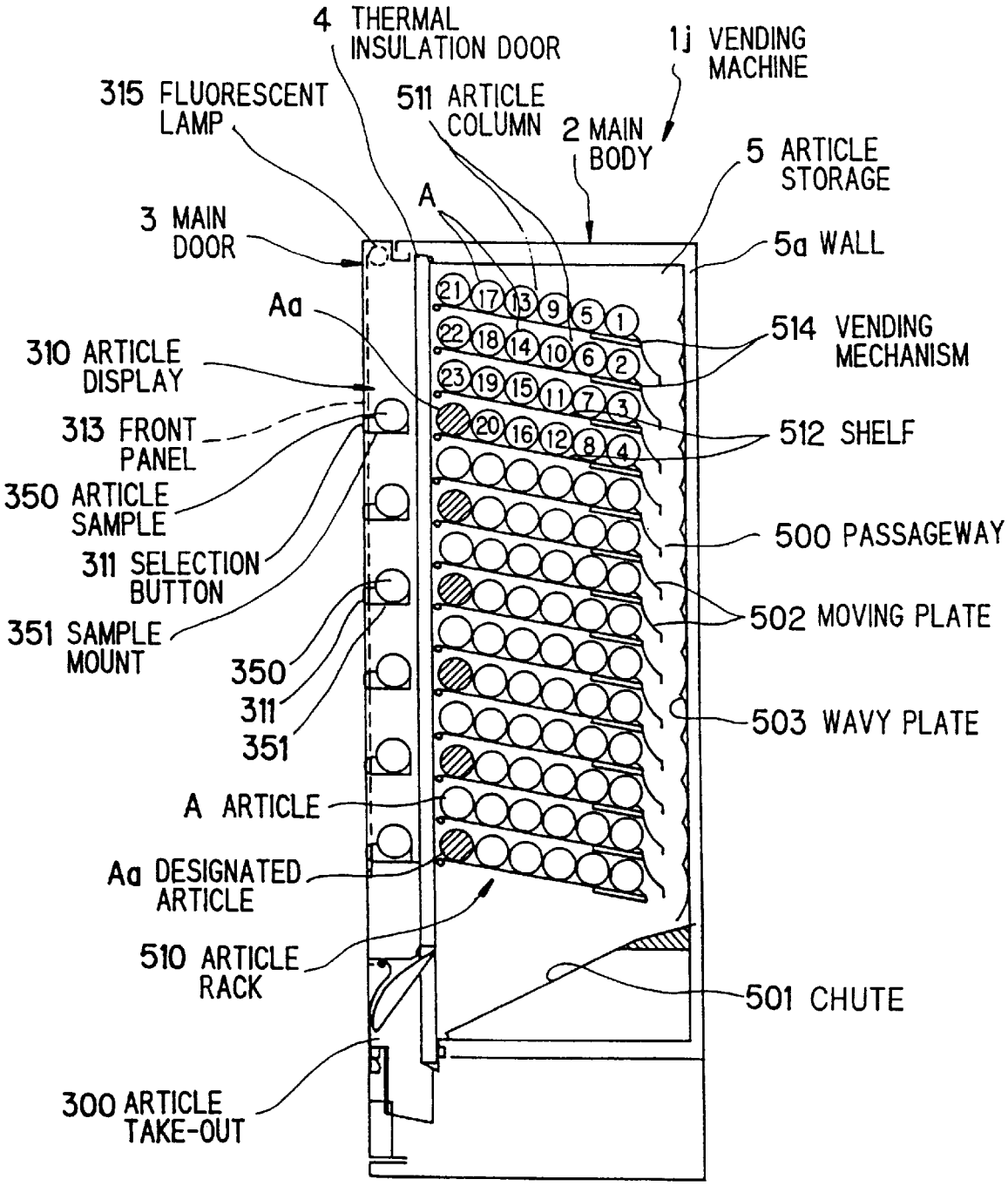
FIG. 25 is a longitudinal section view of the vending machine according to the tenth embodiment of the invention.
Figure 26:
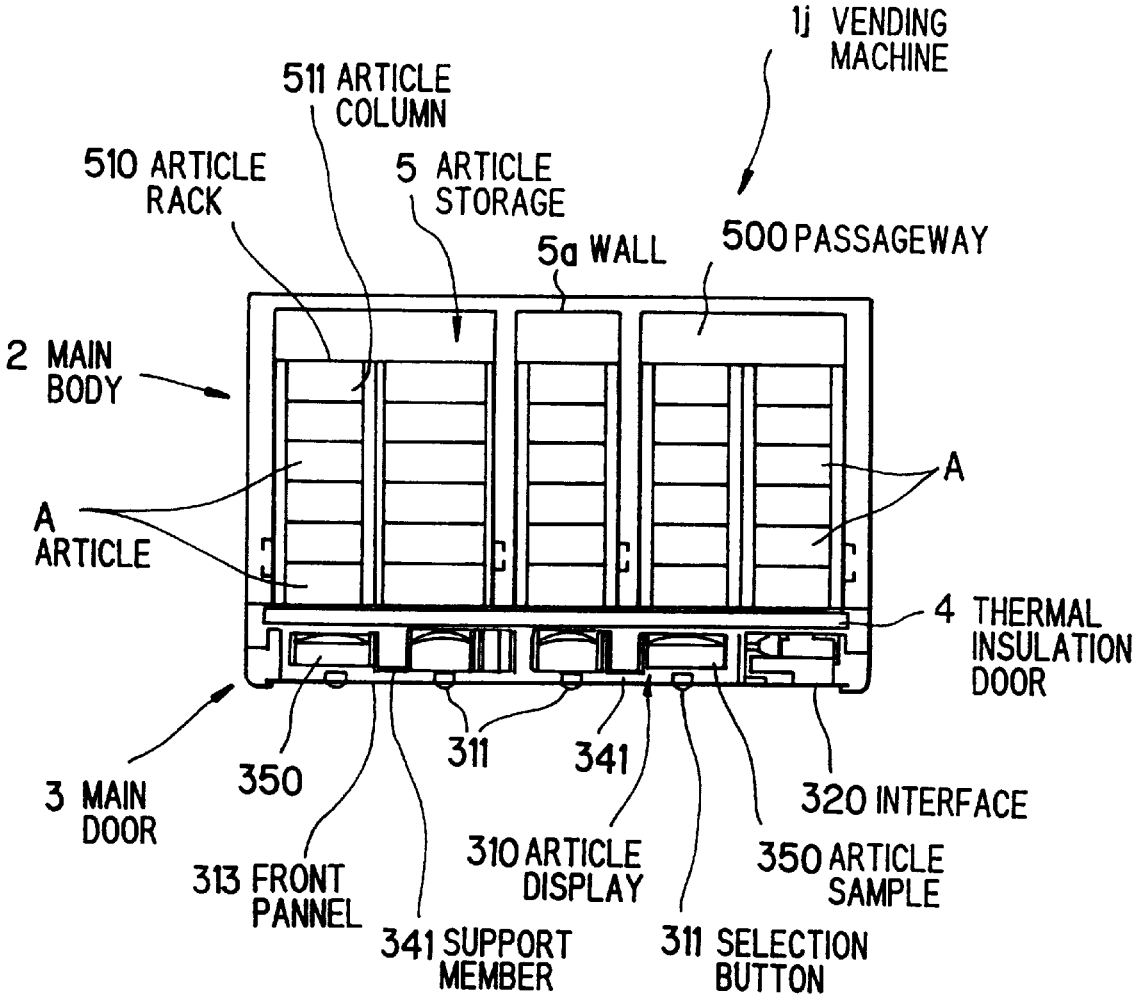
FIG. 26 is a transverse section view of the vending machine according to the tenth embodiment of the invention.

A see-through type vending machine in the tenth preferred embodiment according to the invention will be explained in FIGS. 24 to 26, wherein like parts are indicated by like reference numerals as used in the ninth embodiment and explanation thereof is omitted. In the see-through type vending machine 1*j*, inside the article display 310, article samples 350 are provided to correspond to the respective selection buttons 311. As described above, the selection buttons 311 are provided to correspond to the front article Aa of the lowest article column 511 of a column group C. The article samples 350 are placed fixed on sample mounts 351 each of which is provided between the front article Aa and the selection button 311.

In this case, the article sample 350 functions as a sample of the article A to be stored as well as representing the stock situation of article A. Thus, the article sample 350 is displayed lying down as the article A stored does. Namely, in the entire article display 310, a number of article samples 350 which are composed of a plurality of files and ranks are disposed lying down.

The sample mount 351 are provided horizontally extending from the support member 341 as described above, with a selection button 311 at the front end and a harness(not shown) for the selection button 311 inside thereof. In this case, the fluorescent lamp 315 is provided covered by the edge part of the article display 310.

As described above, since the article sample 350 is disposed behind the corresponding selection button 311, the correspondence between the article sample A and the selection button 311 become clear. In addition, at least the article sample 350 can be uniformly aligned showing the front side. Thus, even in the see-through type vending machine, the distinguishability and appealability of the article A can be enhanced.

Furthermore, to enhance the appealability of the article A, it is preferable that the front articles A are left even when the selling is progressed. In the tenth embodiment, it is preferable that, for example, in the top column group C, the rear article A of the top article column 511 is first sold, then in turn selling the rear articles A of the second, third and fourth-rank article columns 511, being repeatedly conducted as such, as shown in FIG. 25. Also in this case, to prevent an operator from erroneously loading another kind of article A into an article column 511, it is preferable that the article Aa behind the article sample 350 corresponding to the selection button 311 is left.

Figure 27:
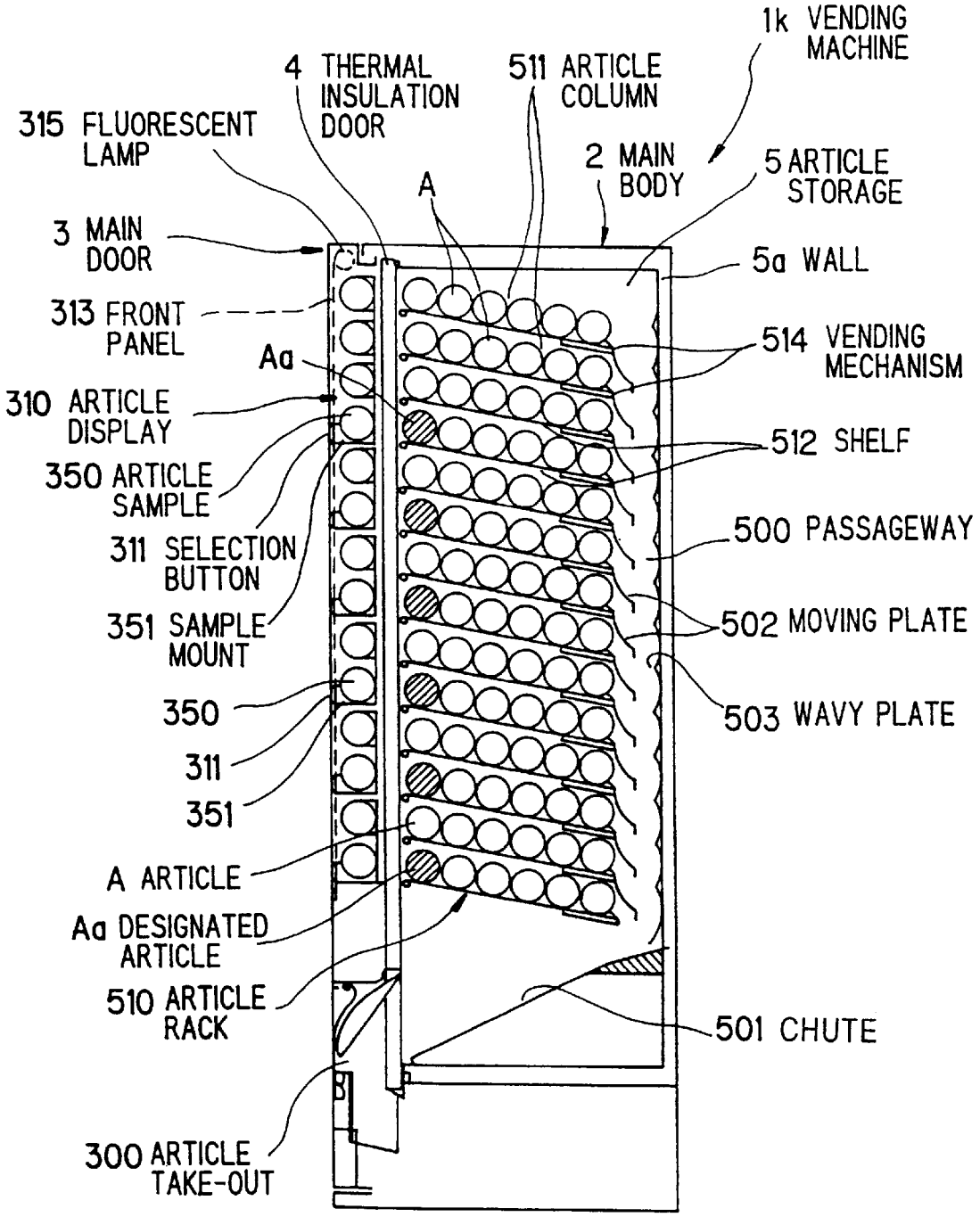
FIG. 27 is a longitudinal section view of a vending machine according to the eleventh embodiment of the invention.

A see-through type vending machine in the eleventh preferred embodiment according to the invention will be explained in FIG. 27. In the see-through type vending machine 1*k*, where the see-through type vending machine 1*j* in the tenth embodiment is further modified, article samples 350 are provided corresponding to the respective article columns 511. Namely, to represent the situation as the vending machine 1*k* is full of articles A, the article samples A are provided over the entire article display 310 and the respective article samples 350 are disposed showing the front side.

Therefore, a number of article samples 350 which are composed of a plurality of files and ranks are disposed lying down. Thus, they can always represent the fullness of article A, which gives an incentive to buy the article A to an user regardless of the number of remainder. Also, the appealability of the article A itself can be further enhanced. In addition, the display pattern by the article samples 350 becomes a novel and unique form, and the display pattern itself can he distinguished to enhance the appealability of the article display 310. Meanwhile, this display pattern is utilized in an embodiment explained hereafter.

Figure 28:
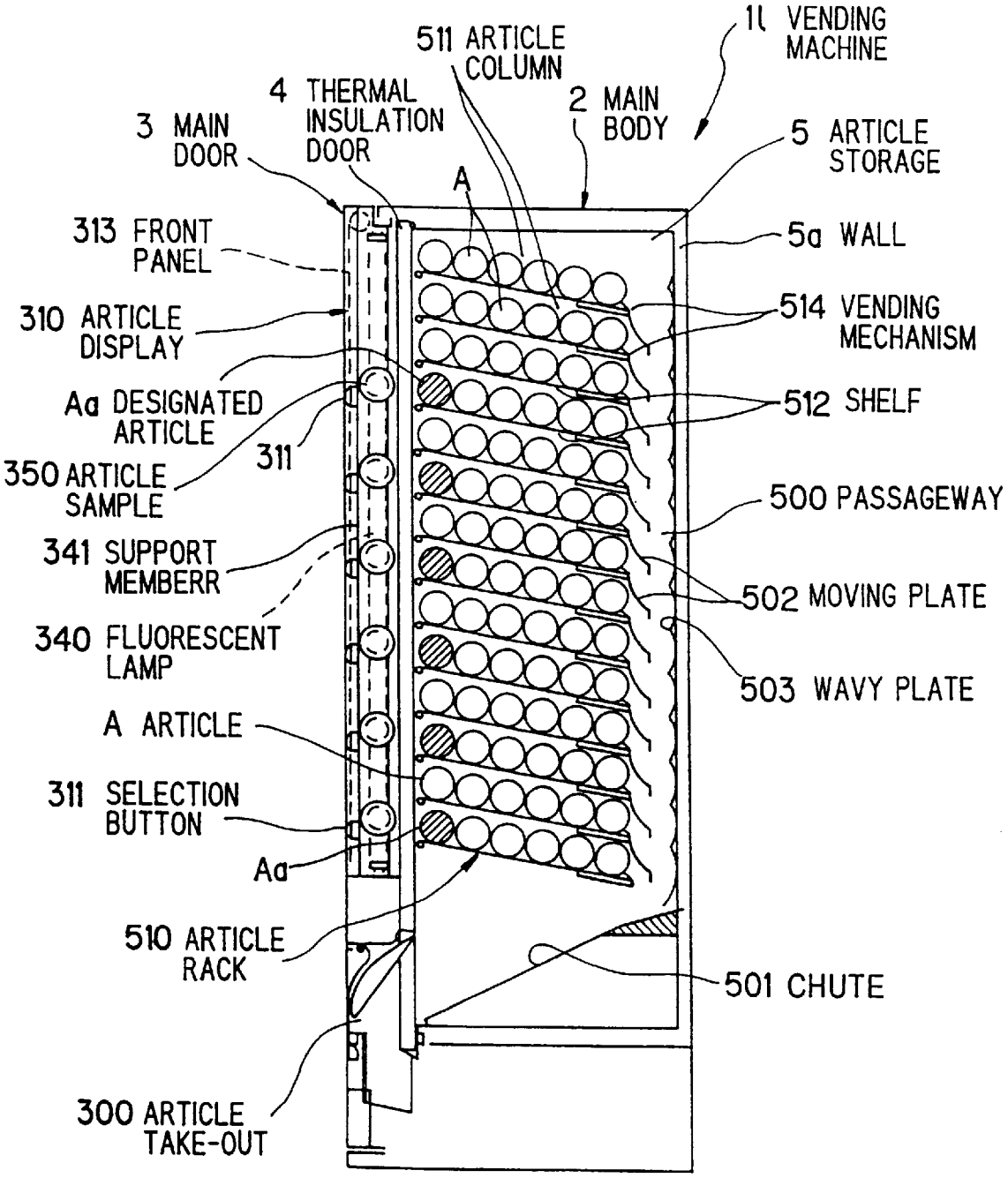
FIG. 28 is a longitudinal section view of a vending machine according to the twelfth embodiment of the invention.
Figure 29:
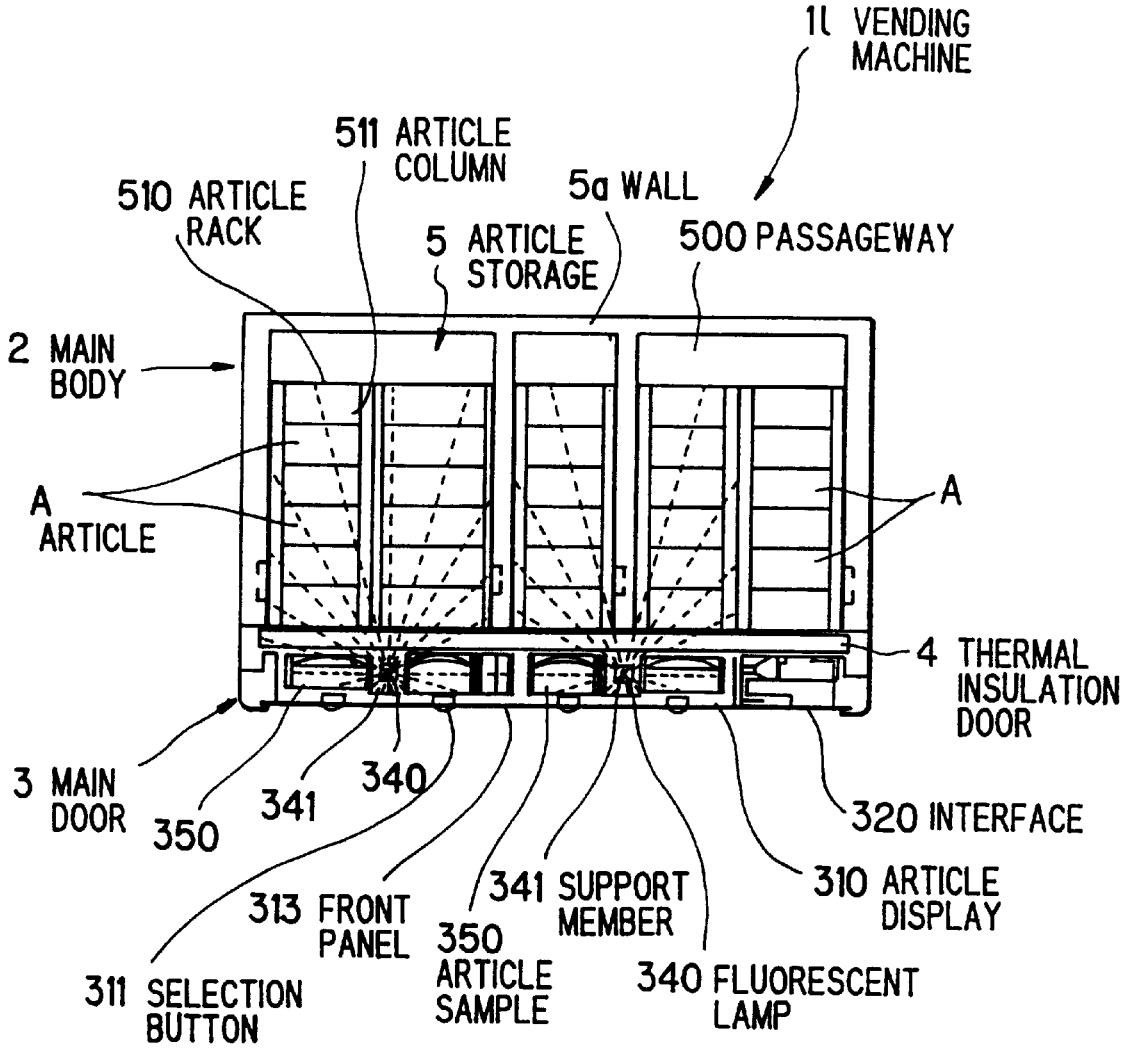
FIG. 29 is a transverse section views of the vending machine according to the twelfth embodiment of the invention.

A see-through type vending machine in the twelfth preferred embodiment according to the invention will be explained in FIGS. 28 and 29. In the see-through type vending machine 11, where the main parts of the vending machine 1*i* in the ninth embodiment and the vending machine 1*j* in the tenth embodiment are combined, the fluorescent lamp 340 is disposed inside the support member 341 and the article sample 350 provided corresponding to the selection button 311 is fixed to the support member 341. Namely, by the fluorescent lamp 340, both the article A to be stored and the article sample 350 are lighted.

Figure 30:
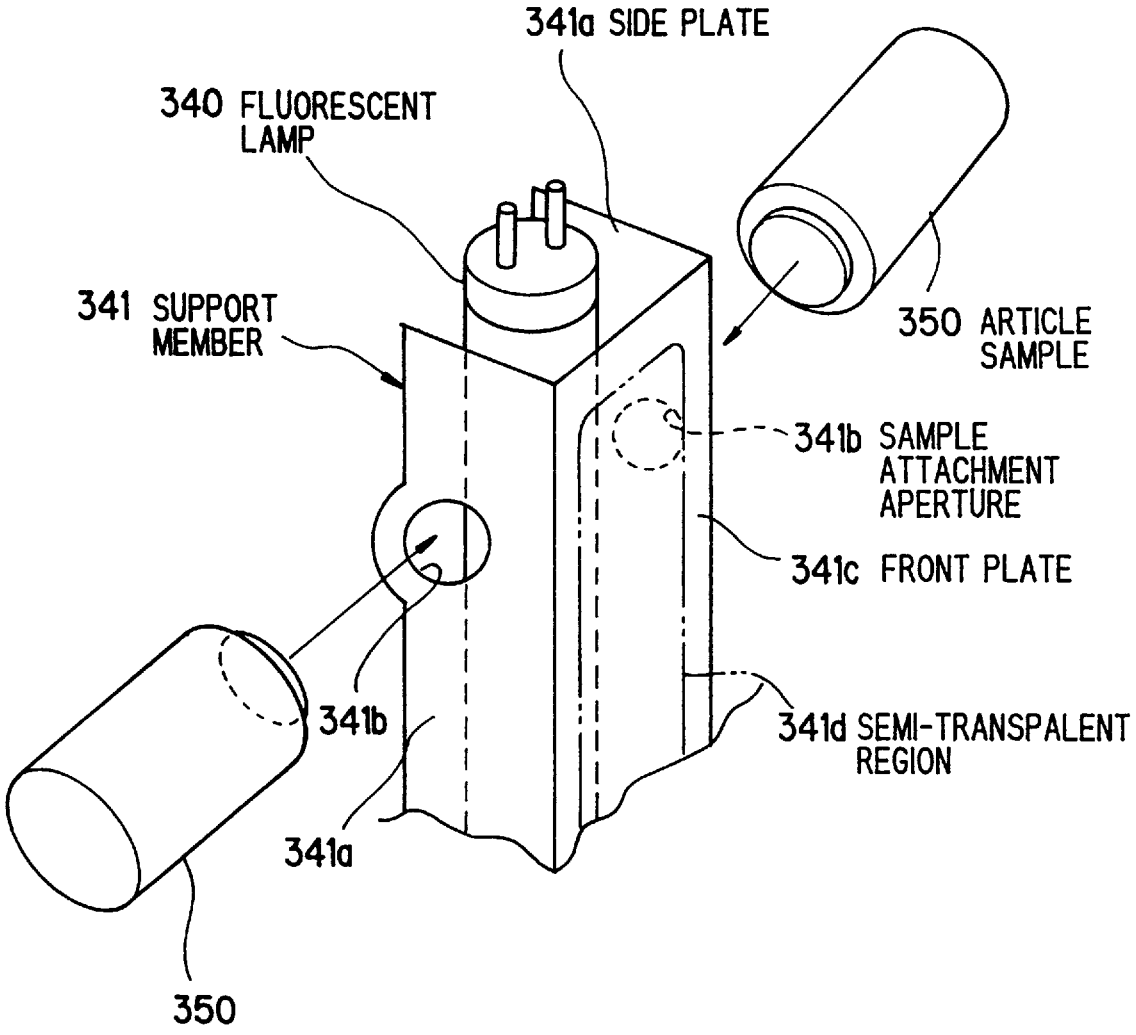
FIG. 30 is a perspective view of a surrounding of a supporting member of the vending machine according to the twelfth embodiment of the invention.

The article sample 350 is composed of a so-called underlight can from the lower part of which the light of the fluorescent lamp 340 can be taken into. As shown in FIG. 30, the article sample 350 is fixed to the support member 341 with the end thereof being inserted into sample attachment aperture 341*h* that is formed on the side plate 341*a* of the support member 341. Here, since two rows of article samples 350, 350 located at both sides of the fluorescent lamp 340 are lighted by the single fluorescent 340, the number of fluorescent lamps 343 can be reduced compared to the conventional case that a row of article samples are lighted by a fluorescent lamp. Also, the inside of the vending machine 11 can be properly lighted, whereby the merits of the see-through type vending machine can be assured. Optionally, a semi-transparent region 341*d*, which is shown by a two-dotted line in FIG. 30, may be formed on the front plate 341*c* of the support member 341 to simultaneously light the support member 341. In this case, it can prevent only the support member 341 from darkening, thereby uniformly lighting the inside of the article display 310.

Figure 31:
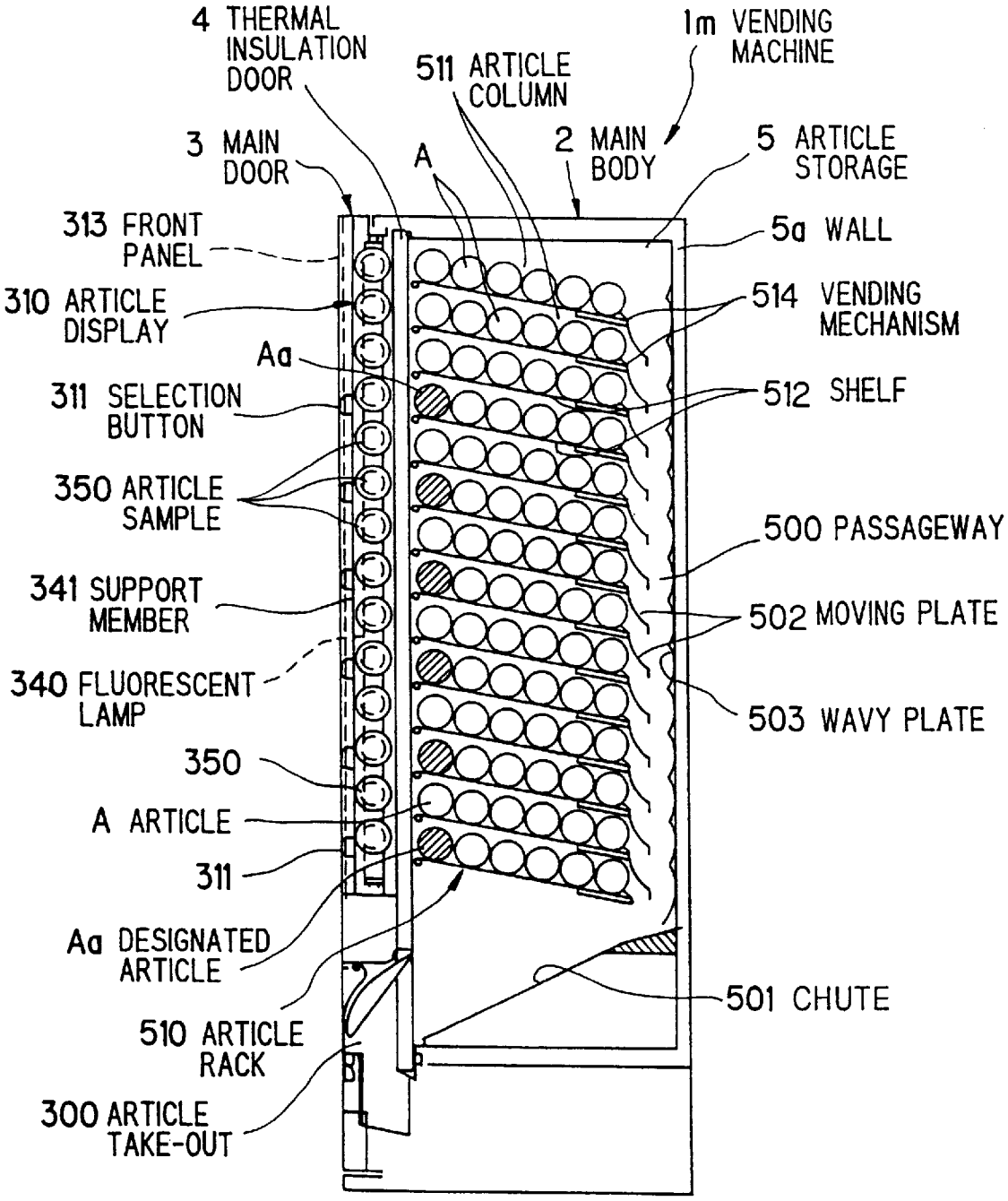
FIG. 31 is a longitudinal section view of a vending machine according to the thirteenth embodiment of the invention.

A see-through type vending machine in the thirteenth preferred embodiment according to the invention will be explained in FIG. 31. In the see-through type vending machine 1*m*, where the main parts of the vending machine 1*i* in the ninth embodiment and the vending machine 1*k* in the twelfth embodiment are combined, the fluorescent lamp 340 is disposed inside the support member 341 and the article sample 350 provided corresponding to the article column 511 is fixed to the support member 341. Namely, a number of article samples 350 which are composed of a plurality of files and ranks are disposed lying down to be displayed, where both the article A to be stored and the article sample 350 are lighted.

In this embodiment, the article samples 350 can form a novel and unique display pattern, and the see-through type vending machine 1*m* can demonstrate the merit that the article A to be stored and the situation of selling can be observed from outside.

Figure 32:
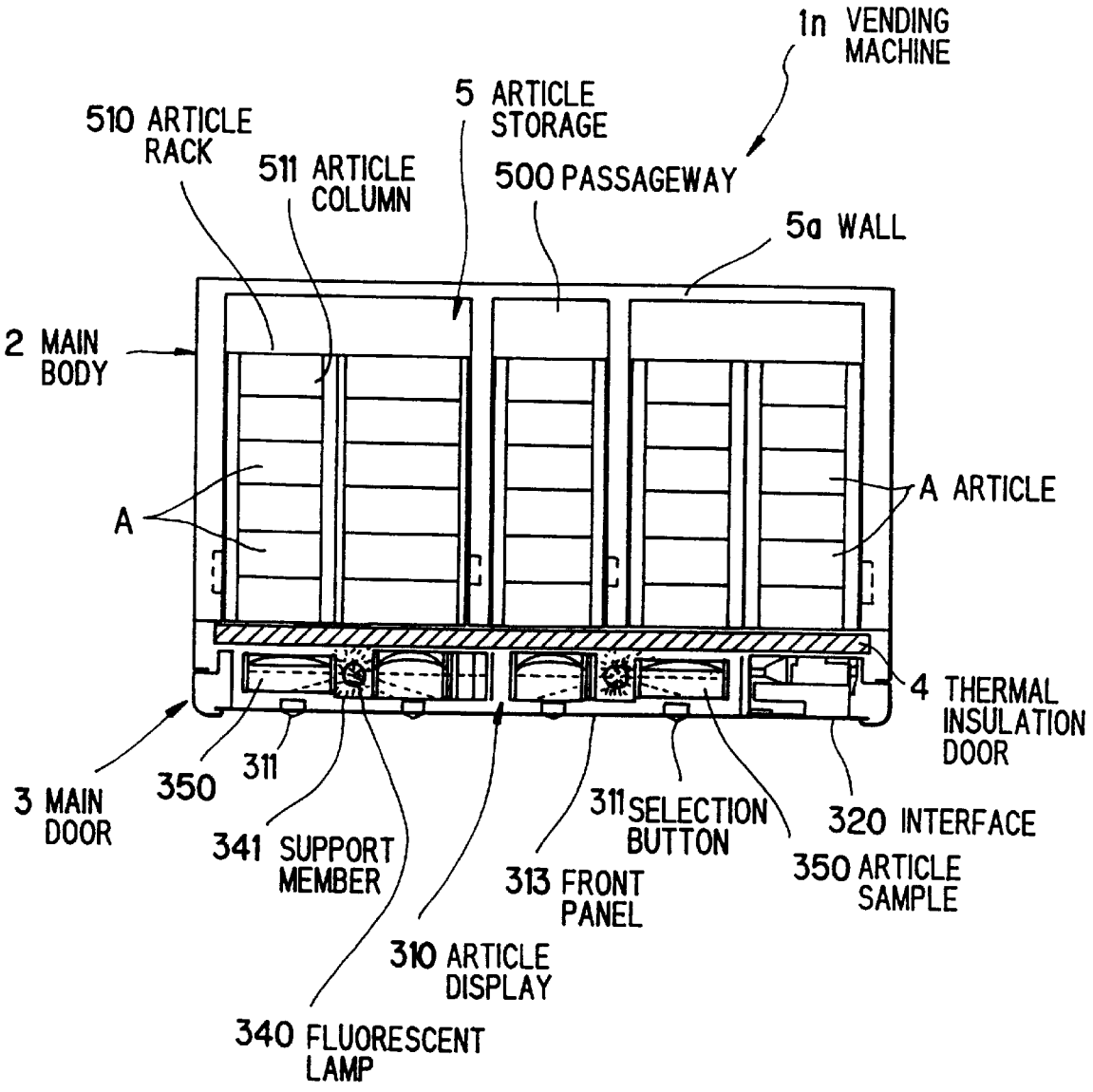
FIG. 32 is a transverse section view of a vending machine according to the fourteenth embodiment of the invention.

A vending machine in the fourteenth preferred embodiment according to the invention, to which the above display pattern is applied, will be explained in FIG. 32. In the vending machine 1*n*, the thermal insulation door 4 of the vending machine 1*m* in the thirteenth embodiment is composed of a standard thermal insulation door. Therefore, the article A stored cannot be seen from outside. Here, only the article samples 350 displayed on the article display 310 can be seen, while the article samples 350 which are composed of a plurality of files and ranks are disposed lying down over the entire article display 310. Thus, they can always represent the fullness of article A, which gives an incentive to buy the article A to an user regardless of the number of remainder. Also, the appealability of the article A itself can be further enhanced.

A vending machine in the fifteenth preferred embodiment according to the invention will be explained in FIGS. 33 and 34. The vending machine 1*o* is a standard type vending machine in which a plurality of serpentine-type article columns 520 are provided in the article storage 5, where only the display pattern of the article samples 360 in the article display 310 is composed like that in the fourteenth embodiment. Namely, the article samples 360 which are composed of a plurality of files and ranks are disposed lying down over the entire article display 310.

Thus, they can always represent the fullness of article A, which gives an incentive to buy the article A to an user regardless of the type of the article column 520. Namely, both the novel and unique display method in which the article samples 360 are displayed lying down and the novel appeal factor that the article samples 360 are displayed to show the fullness of article A can be very distinguished and give an incentive to buy the article A to an user.

On the other hand, this vending machine can sell both a can beverage and a bottle beverage. In addition, several kinds of slender cans represented by a 250 ml can and several kinds of bigger cans represented by a 350 ml can in the can beverage can be vended by this vending machine. Corresponding to the many kinds of articles different in the kinds and forms of such containers, preparation of exclusive article samples such as underwritten cans and the like are very complex. Accordingly, in this preferred embodiment, the can and bottle containers drawn out of their beverages are displayed as article samples 360 (referred to "can sample 360*a*" and "bottle sample 360*b*", respectively hereinafter).

Figure 33:
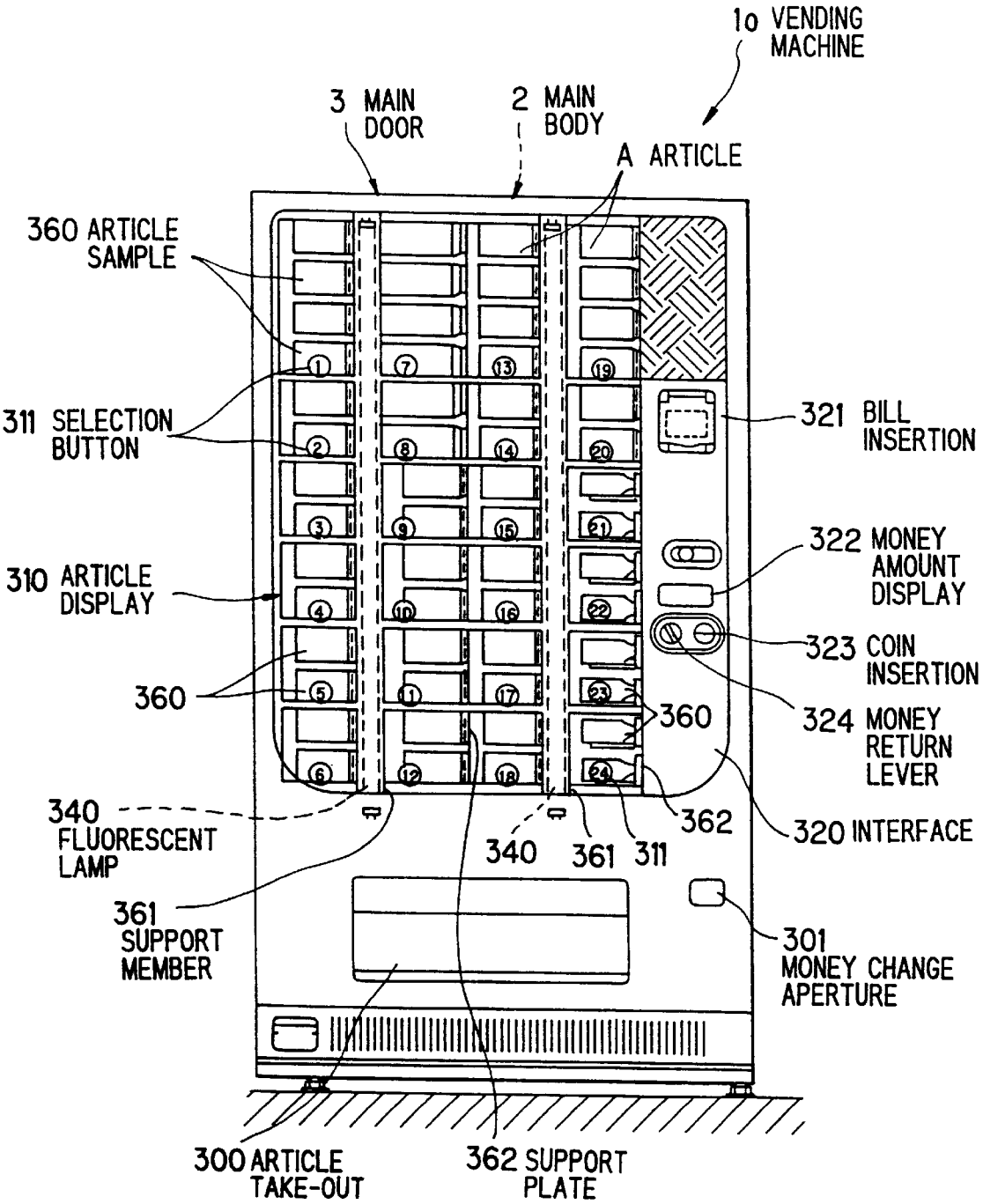
FIG. 33 is a front view of a vending machine according to the fifteenth embodiment of the invention.
Figure 34:
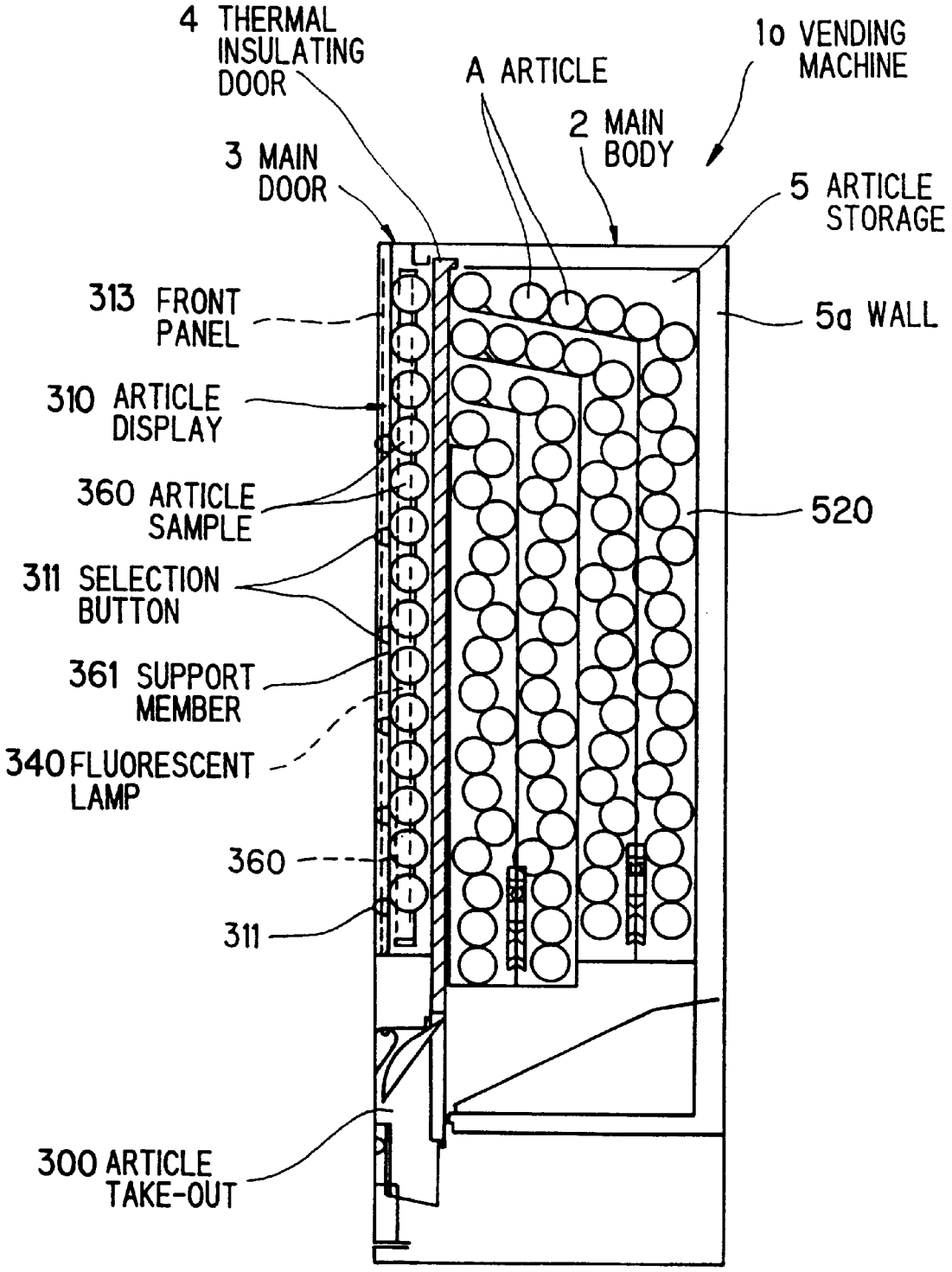
FIG. 34 is a longitudinal section view of the vending machine according to the fifteenth embodiment of the invention.

In this preferred embodiment similarly to other preferred embodiments, the can samples 360*a* and bottle samples 360*b* are mounted on two support members 361 which are disposed vertically intersecting an article display 310, and a part of them are mounted on support plates 362 (refer to FIG. 33). In this preferred embodiment, such can samples 360*a* and bottle samples 360*b* are mounted on the support members 361 and support plates 362 through attachments 363. Next, the structure for mounting the article samples with this attachment 363 will be described in detail.

Figure 35A:
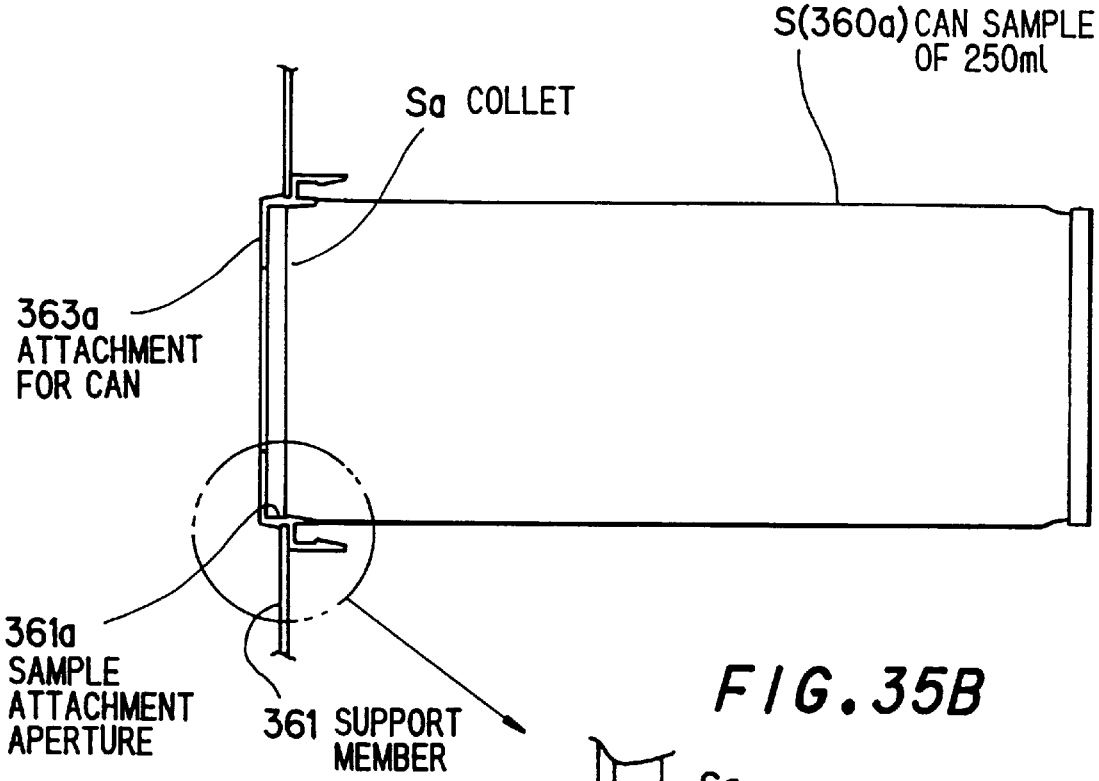
FIGS. 35A and 35B section views of an attachment state of a thin can of a can sample of the vending machine.
Figure 35B:
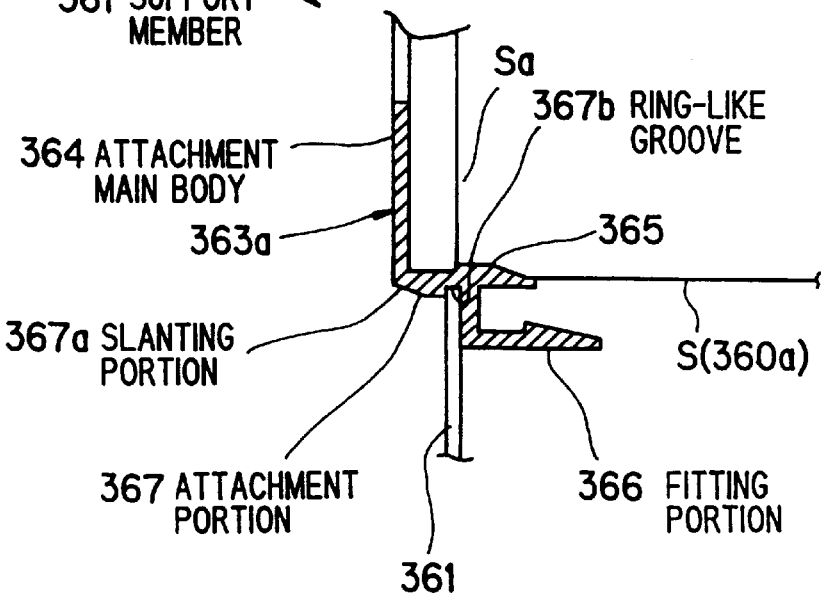
Figure 36:
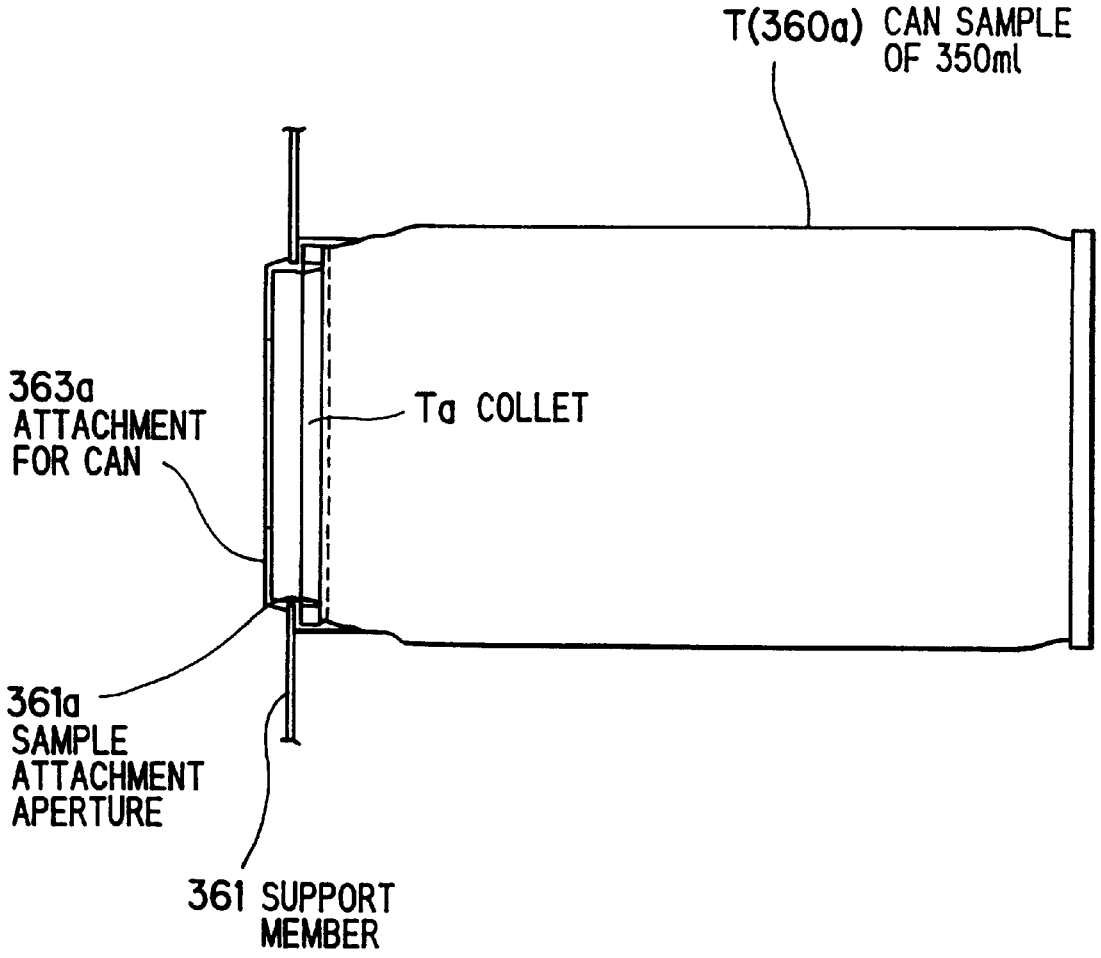
FIG. 36 is a section view of an attachment state of a thick can of a can sample of the vending machine.
Figure 37:
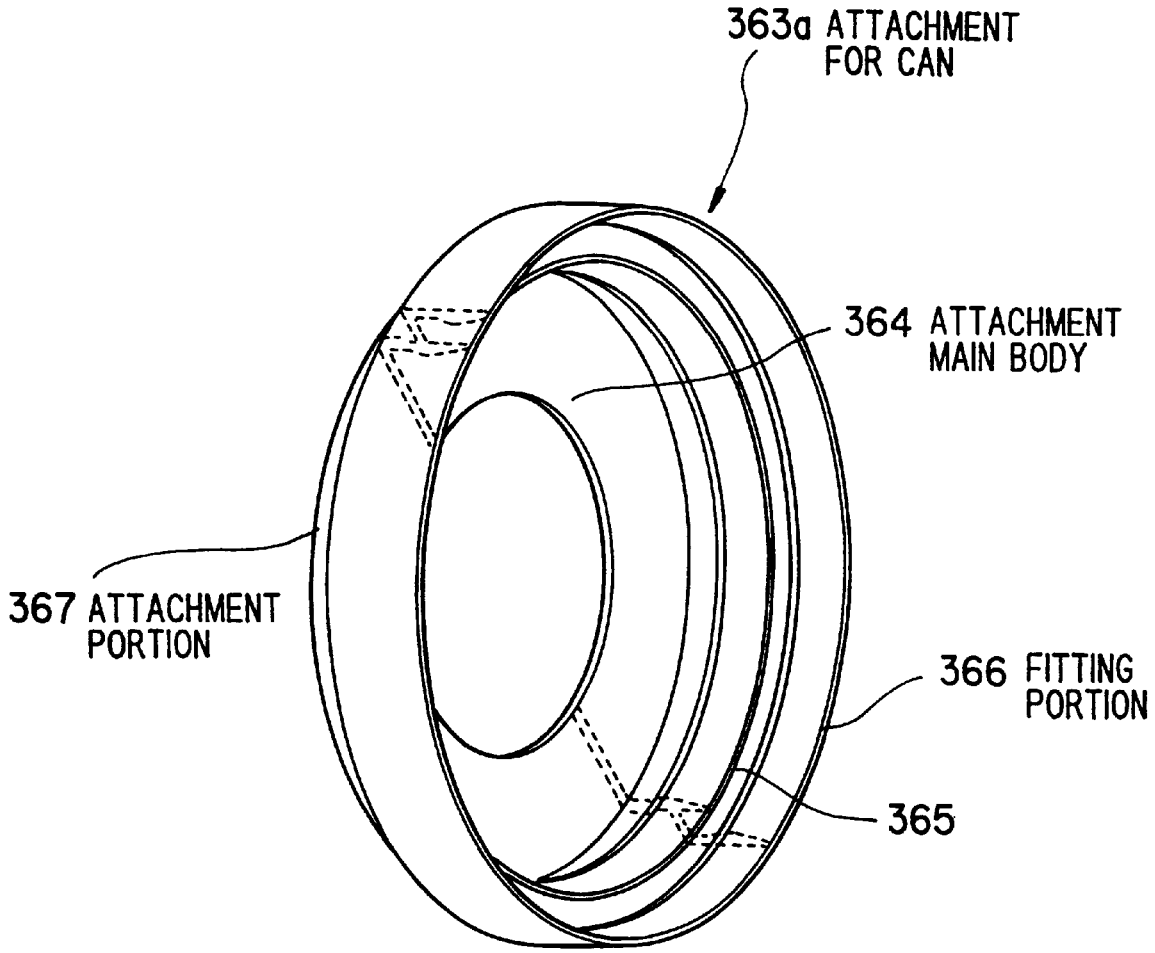
FIG. 37 is a perspective view of an attachment of the can sample of the vending machine.

First, referring to FIGS. 35–37, the structure for mounting a can sample 360*a* will be described. FIG. 35 is a sectional view of the state on which a can sample 360*a* of 250 ml(slender can S) is mounted on the support member 361. FIG. 36 is a sectional view of the state in which a can sample of 350 ml(bigger can T) is mounting on the support member 361. FIG. 37 is a perspective view of the attachment 363*a* for the cans. As shown in FIG. 37, the integrally formed an attachment for can 363*a* comprises a perforated disk type of attachment main body 364, an annular slender can fitting portion 365 extended perpendicularly from the peripheral edge of the attachment main body 364, an annular bigger can fitting portion 366 which is extended outwardly from the middle position of the slender can fitting portion 365 in the L-shaped section, and an attachment portion 367 formed on the outer peripheral surface of the base of the slender can fitting portion 365(refer to FIG. 35(*b*)).

As shown in FIG. 35, the annular attachment portion 367 has a slanting portion 367*a* inclined toward the attachment main body 364, and an annular groove 367*b*, and the annular groove 367*b* followed by the bigger can fitting portion 366. By applying the attachment portion 367 to a sample attachment aperture 361*a* of the circularly formed support member 361 and then forcing the attachment 363*a* into the opening 361*a*, the annular groove 367*b* can clear the slanting portion, 367*a* and engage an annular edge or the sample attachment aperture 361*a* thereby the can attachment 363*a* can be mounted on the support member 361 without being dislocated, and whereupon the bigger can fitting portion 366 functions as a stopper when the can attachment main body 363*a* is forced into the sample attachment aperture 361*a*.

The annular slender can fitting portion 365 has a wedge-shaped section and is formed in such a way that its inner diameter is slightly smaller than the outer diameter of a collet Sa of the slender can S. Therefore, by applying the collet Sa of the slender can S to the slender can fitting portion 365 and forcing it thereinto, the collet Sa is tightly engaged with the slender can fitting portion 365 and the slender can S is mounted on the attachment for can 363*a* in a substantially horizontal position.

Similarly, the thicker can fitting portion 366 has a wedge-shaped section and is formed in such a way that its inner diameter is slightly smaller than the outer diameter of a collet T a of the bigger can T. The bigger can fitting portion 366 projects in front of the slender can fitting portion 365 so that the collet Ta of the mounted bigger can T can not be interfered with the slender can fitting portion 365. As shown in FIG. 36, by applying the collet Ta of the bigger can T to the bigger can fitting portion 366 and forcing this thereinto, the collet Ta is tightly engaged with the bigger can Fitting portion 366 and the bigger can T is mounted on the can attachment 363*a* in a substantially horizontal position. In addition to the above mentioned 250 ml and 350 ml cans, a can type container includes various volumes of cans such as a 160 ml, 500 ml, and others, but the containers vended by this type of vending machine are limited to two kinds, that is, the slender can S and bigger can T.

In this manner, the can sample 360*a* is mounted on the support member 361 through the can attachment 363*a* having the slender can fitting portion 365 and bigger can fitting portion 366 and thus, exchange of the can samples 360*a* can simply and freely be effected. Further, with respect to the places where the can sample 360*a* is unnecessary, this vending machine can conveniently be used by removing the can attachment 363*a* and closing the sample attachment aperture 361*a* for support member 361 with an exclusive cap (not shown).

Figure 38:
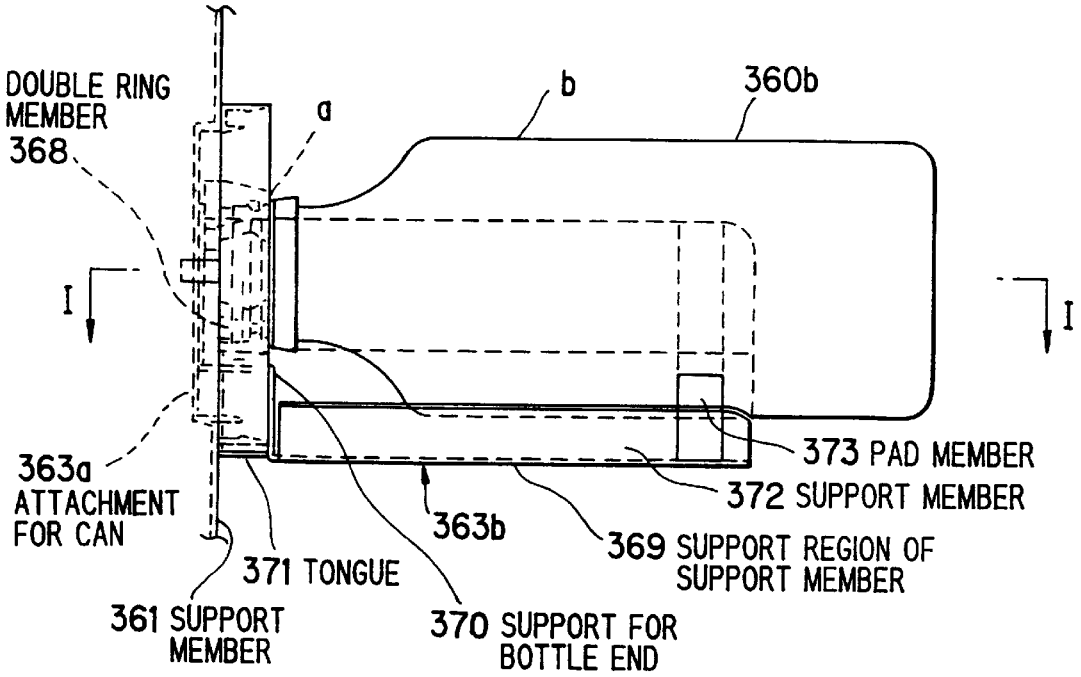
FIG. 38 is a front view of an attachment state of a bottle sample of the vending machine.
Figure 39:
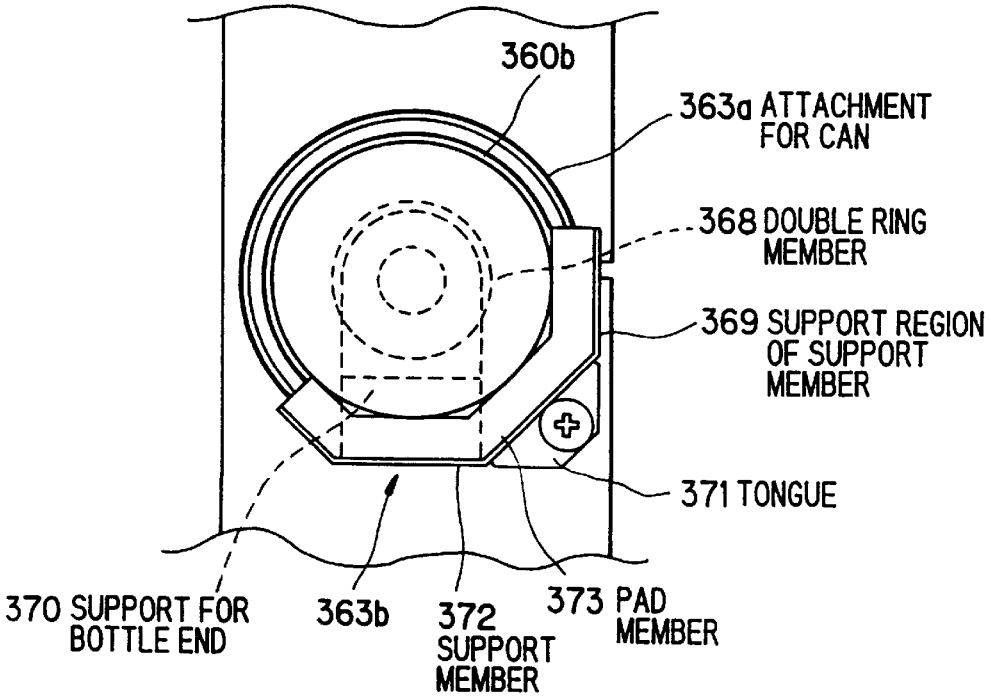
FIG. 39 is a side view of the attachment state of the bottle sample of the vending machine.
Figure 40:
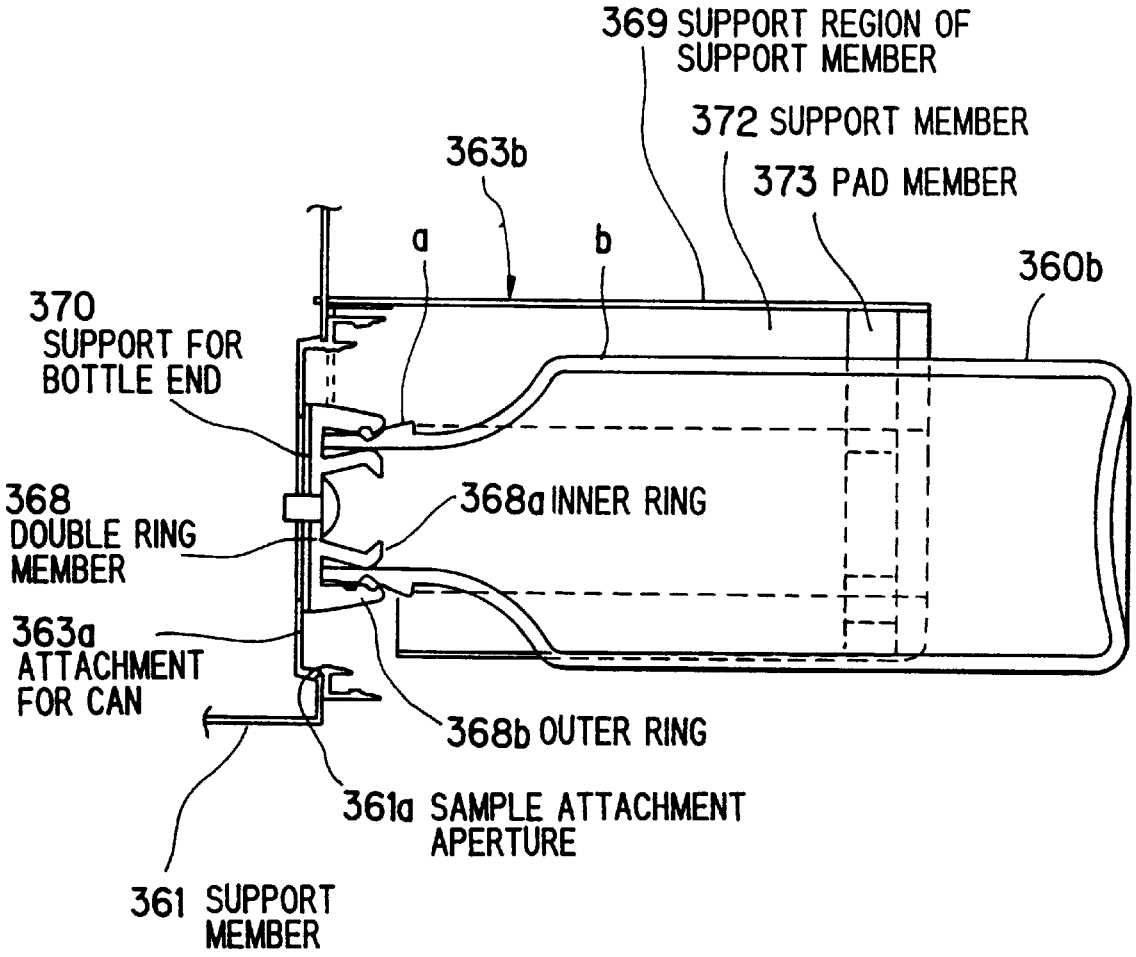
FIG. 40 is a section view taken along a line I—I in FIG. 38.

Next, referring to FIGS. 38–40, the structure for mounting a bottle sample 360*b* will be described. FIG. 38 is a side view of the state in which the bottle sample 360*b* is mounted on the support member 361, FIG. 39 is a front end view of the bottle sample shown in FIG. 38, and FIG. 40 is a top sectional view of the bottle sample shown in FIG. 38. As shown in these Figures, an attachment used for the bottle sample 360*b* (referred to as bottle attachment hereinafter) comprises a double ring member 368 supporting a spout of the bottle sample 369*b* and a support region 369 of support member 361 supporting the barrel cylinder b of the bottle sample 360*b*. The double ring member 368 is fixed to a double ring mounting piece 370 which is bent from the base of the support region 369 and extended with a screw, and the support region 369 is fixed to a support member 361 through a bent tongue 371 formed in the base of the support region 369 with a screw. That is, the bottle attachment 363*b* is mounted on the support member 361 by the support region 369 in a state which the double ring member 368 is pushed to the can attachment 363*a* above described.

The support region 369 of the support member 361 comprises a support main body 372 formed with a steel or stainless steel plate and a pad member 373 bonded to the inside of the front end of the body 372. The pad member 373 is directly contact with the barrel b of the bottle sample 360*b* and supports the barrel with a spacing from the support section. The body 372 of the support region 369 is formed along with the pad member 373 in such a way that it corresponds to the shape of from the underside to the back of the bottle sample 360*b* and the surface of the bottle sample 360*a* is not out of sight.

On the other hand, the double ring member 358 is made of rigid rubber, and is integrally formed with the outer link 368*b* to engage with the outer peripheral surface of the spout a of the bottle sample 360*b* and the inner link 368*a* to engage with inner peripheral surface of the spout a. In general, the sizes of spouts in bottle type containers are standardized. By inserting the spout a of the bottle sample 360*b* into the double ring member 368, the spout a is strongly nipped by the outer link 368*b* and inner link 368*a* and the bottle sample 360*b* is mounted on the bottle attachment 363*b* in a substantially horizontal position. In this manner, the bottle sample 360*b* is mounted on the support member 361 through the bottle attachment 363*b* comprising the double ring member 368 and the support region 369 and thus, the bottle samples 360*b* can be stably mounted on the support member 361 and can be simply and freely exchanged.

Figure 41:
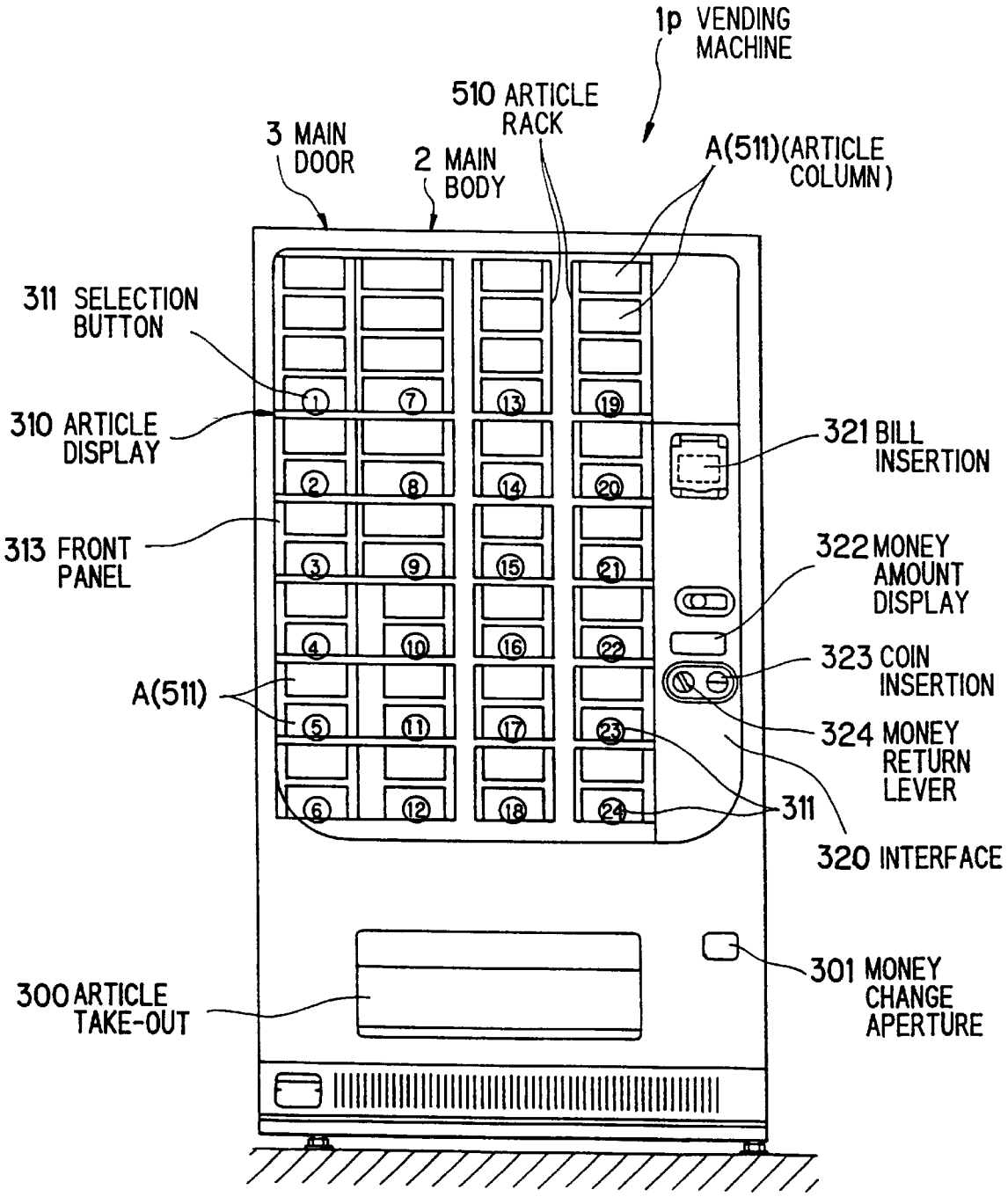
FIG. 41 is a front view of a vending machine according to the sixteenth embodiment of the invention.
Figure 42:
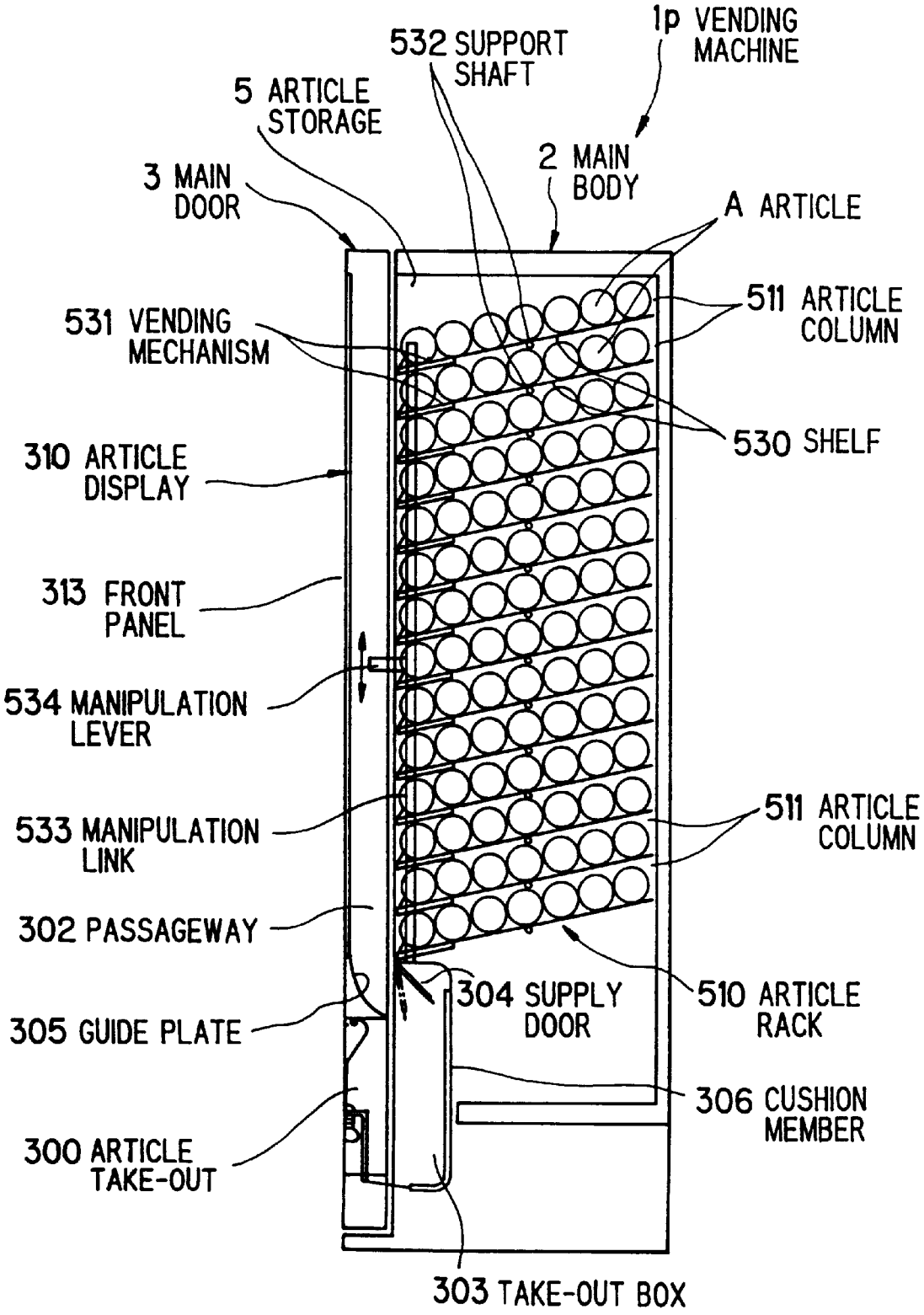
FIG. 42 is a longitudinal section view of the vending machine according to the sixteenth embodiment of the invention.
Figure 43:
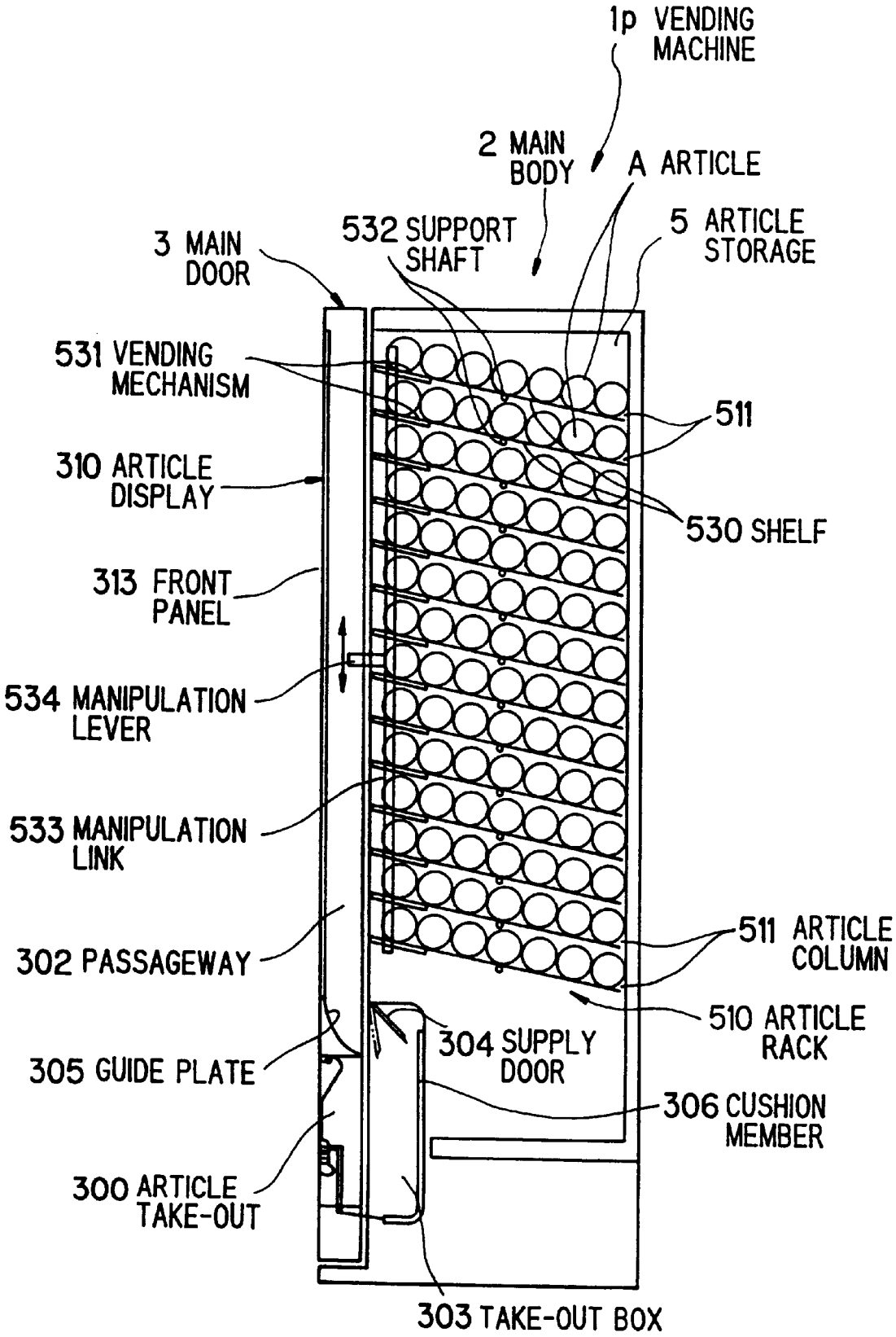
FIG. 43 is a longitudinal section view of the vending machine in a time of loading according to the sixteenth embodiment of the invention.

FIG. 41 is a front view of a see-through type of vending machine 1*p* according to the 16th preferred embodiment of the present invention, and FIG. 42 is a longitudinal sectional view of the vending machine shown in FIG. 41.

Within the pocket of a main door 3 of the vending machine 1*p*, a drop passageway 302 is disposed along the front of each article rack 510 and an article take-out box 303 disposed inside an article take-out mouth 300 in the down stream end of the drop passageway 302. The take-out box 303 is disposed in the interior side of the vending machine from the drop passageway 302 and a supply door 304 is mounted in the front upper portion of the take-out box 303. In the front of the supply door 304, is disposed a guide plate 305 and the article A dropped within the drop passageway 302 is introduced into the take-out box 303 by kicking the supply door 304. On the inner surface of the take-out box 303 is lined a cushioning material 306 such as rubber and the like to absorb a drop impact of the article A dropped through the drop passageway 302.

In the front of the main door 3 is disposed a large article display 310 corresponding to the article storage chamber 5 and a bill insert mouth 321, a money amount display 32, a coin insert mouth 323, a money return lever 324, etc. are disposed in the right side space of the article display 310. A necessary number of selection buttons 311 are also disposed in the front of the article display 310. Each selection button 311 is disposed corresponding to each column group which consists of the same kind of articles A accommodated in the upper and lower adjacent several article columns 511. Further an article take-out mouth 300 and a money change aperture 301 are disposed in the front lower portion of the main door 3.

The transparent front panel constituting the article display 310 is formed with a transparent plural layered glass or acrylic resin material by considering its heat insulation. Therefore, the articles A loaded into each article column 511*c* can be seen through the front panel 313, that is, the vending machine 1*p* has a see-through structure. Therefore, the states in which the articles A are stocked, successively supplied upon vending, dropped into the take-out mouth 300 upon vending and the like can visually be observed from the outside.

On the other hand, a number of article columns 511 are mounted on right and left side plates (not shown) constituting the article rack 510 by mounting the large number of shelves 530 aslantly on them. Each of the article columns 511 has the construction by which the articles A are accommodated in one rank and in the substantially horizontal position, and it comprises a forward inclined shelf 530 and a vending mechanism 531 mounted in the front end of the shelf 530. By the construction, the articles A are in turn expelled forward from the forefront article A and fallen down into the passageway 302 and when the forefront article A is expelled, other articles A are in turn sent forward while rolling.

Figure 44:
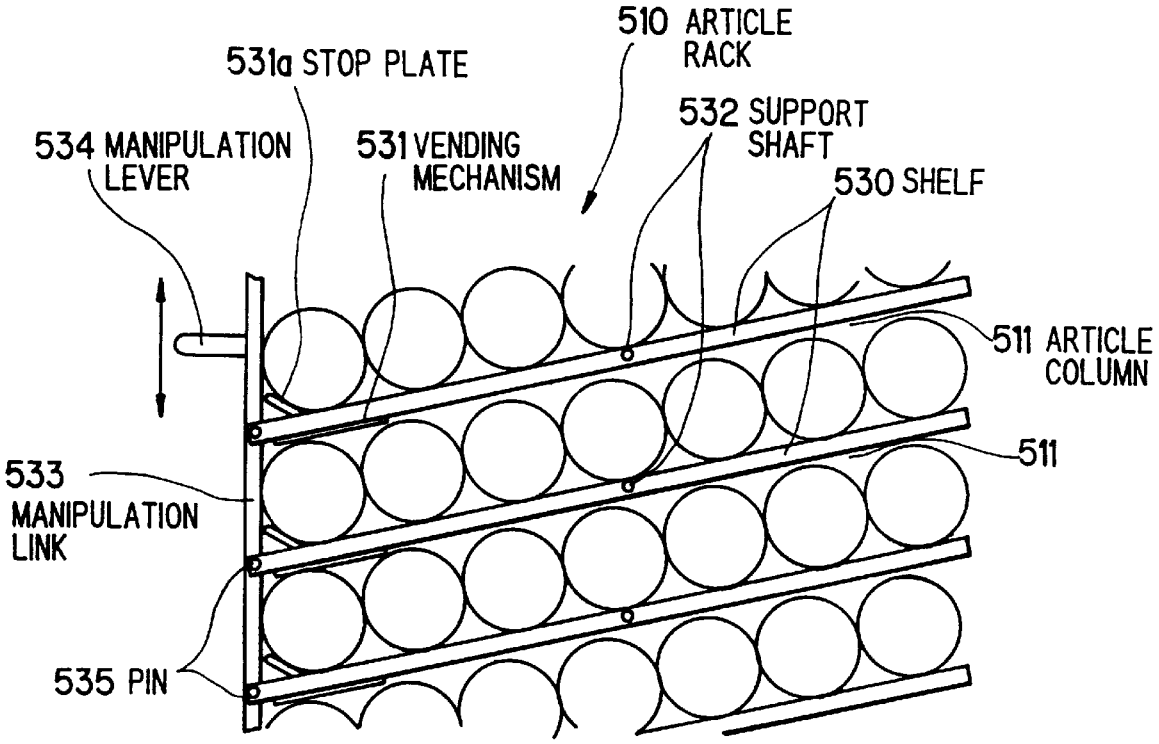
FIG. 44 is a partly grossly enlarged longitudinal section view of a structure of a surrounding of an operation link of the vending machine.

In this case, the number of shelves 530 can be seesawed between the front and back lowered states of them centered on a support shaft 532 disposed in the middle of the shelf 530. As shown in FIG. 44, a manipulation link 533 having a manipulation lever 534 is disposed in the front end of the number of shelves 530, and the front end of each shelf 530 is rotatably connected to the manipulation link 533 through a pin 535. On the other hand, in the middle position of in the front and back direction of each shelf 530 is disposed the support shaft 532 mounted on the both side plates of the article rack 510. By moving the manipulation link 533 up and down through the manipulation lever 534, the number of shelves 530 are simultaneously seesawed centered on the respective support shafts 532.

That is, the vending of the articles A is effected in the situation where the shelves 530 have been lowered forward while sending the accommodated articles A in turn forward, and the loading of the articles A into the shelves 530 is effected by lowering the shelves 530 backward. In this manner, the shelves are lowered backward upon loading the articles A and thus, the articles A are in turn filled into the interior of the shelves 530 only by throwing the articles A into the space between the shelves 530 from the front end thereof. The loading of the articles A can very easily be performed compared with the case of the shelves lowered forward. Preferably the stop plate 531*a* of the vending mechanism 531 is fallen down upon the loading of the articles A in such a way that it get out of the way for the articles A.

Next, referring to FIG. 45, a vending machine relating to the 17th preferred embodiment of the present invention will be described. In this Preferred embodiment, each support shaft 532 supporting the shelf 530 described above is interlocked to the seesaw motion of the shelf 530 to move back and forth. Each support shaft 532 is mounted movably in the horizontal direction on a guide aperture 536 formed in a side plate of the article rack 510. To this support shaft 532 is engaged one end of a shaft moving link 537. The shaft moving link 537 has a substantially L-shaped form, and is rotatably mounted on the middle of the side plate. On the other hand, other end of the shaft moving link 537 is slidably engaged with a slender aperture 530*a*. The up and down movement of the manipulation link 533 is guided by a pair of guide members 538.

Figure 45:
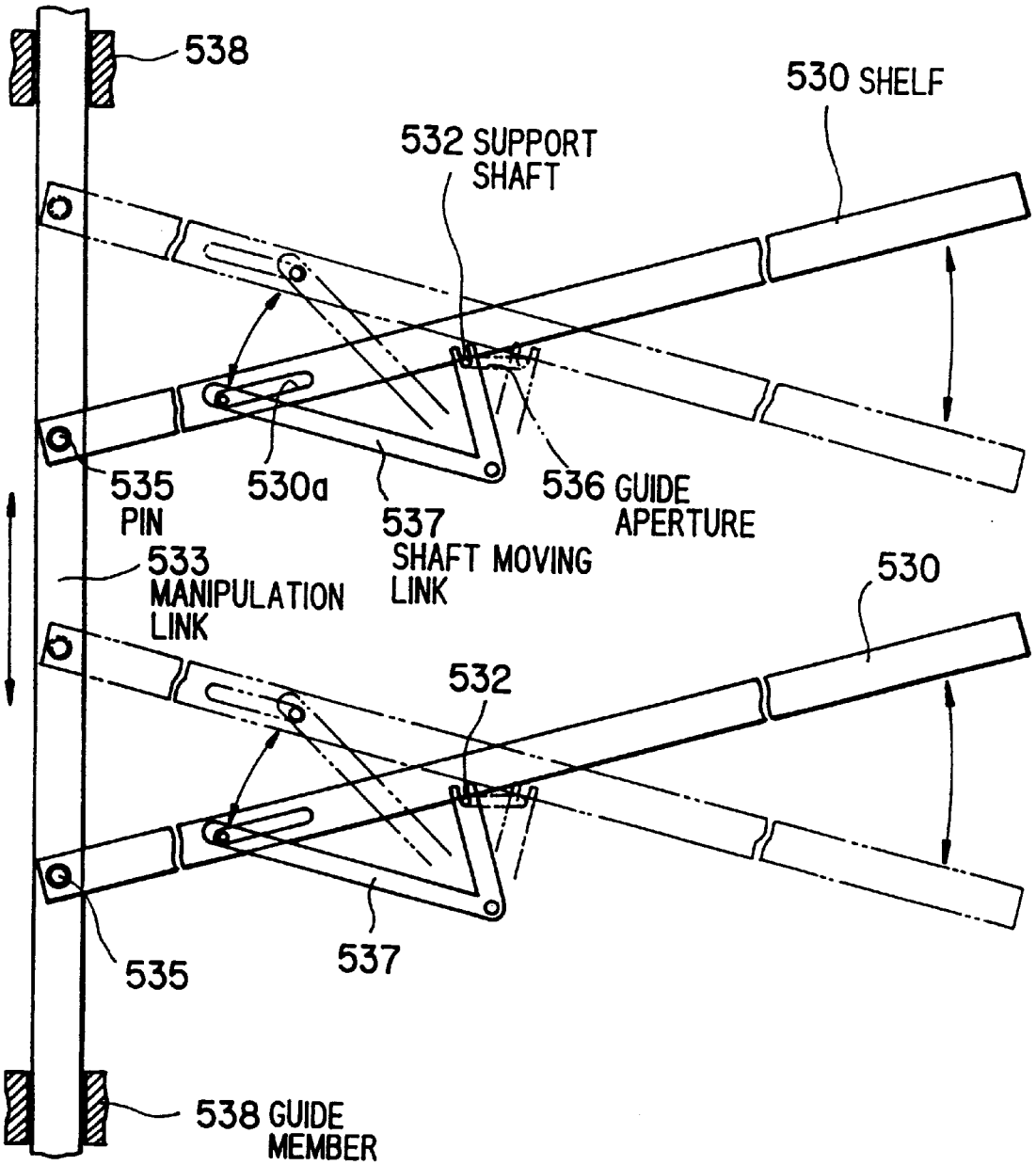
FIG. 45 is a partly grossly enlarged longitudinal section view of a vending machine according to the seventeenth embodiment of the invention.

Therefore, from the front-lowering situation shown by a solid line in FIG. 45, when moving up the manipulation link 533 to allow the shelf plate 530 to rotate in the back-lowering direction while interlocking with this, the shaft moving link 537 is rotated clockwise to move the support shaft 532 backward. Inversely, from this situation when moving down the manipulation link 533 to allow the shelf plate 530 to rotate in the front-lowering direction, while interlocking with this, the shaft moving link 537 is rotated counterclockwise to move the support shaft 532 forward. In this case of the situation that the shelf plate 530 has been rotated in the rear lowered direction, it is set in such a way that the support shaft 532 is moved to the approximately middle position in the front and rear direction. That is, when the shelf plate 530 is lowered forth, the support shaft 532 lies toward the front side from the middle position of the shelf plate 530, and when the shelf plate 530 is lowered back, the support shaft 532 lies in the middle position of the shelf plate 530.

Upon the loading of the articles A, the remained articles A have been sent to the forth section of the shelf plate 530, so that it requires a considerable force to rotate the shelf plate 530 clockwise. However, when the support shaft 532 lies in the forward side from the middle position of the shelf plate 530, the back and forth load centered on the support shaft 532 can easily be balanced and thus the seesaw motion of the shelf plate 530 can be effected with a relatively small force. On the other hand, after the shelf plate 530 have ben filled up with the articles A, the middle position of the shelf plate 530 lies in the approximately center position for the back and forth loads and thus the loads between the back and forth are balanced because the support shaft 532 lies on the middle position. Also, in this case, the seesaw motion of the shelf plate 530 can be effected with a relatively small force. Therefore, the seesaw motion of the shelf plate 530 can simply be effected by a relatively small force and a series of loading operations can effectively be effected.

Figure 46:
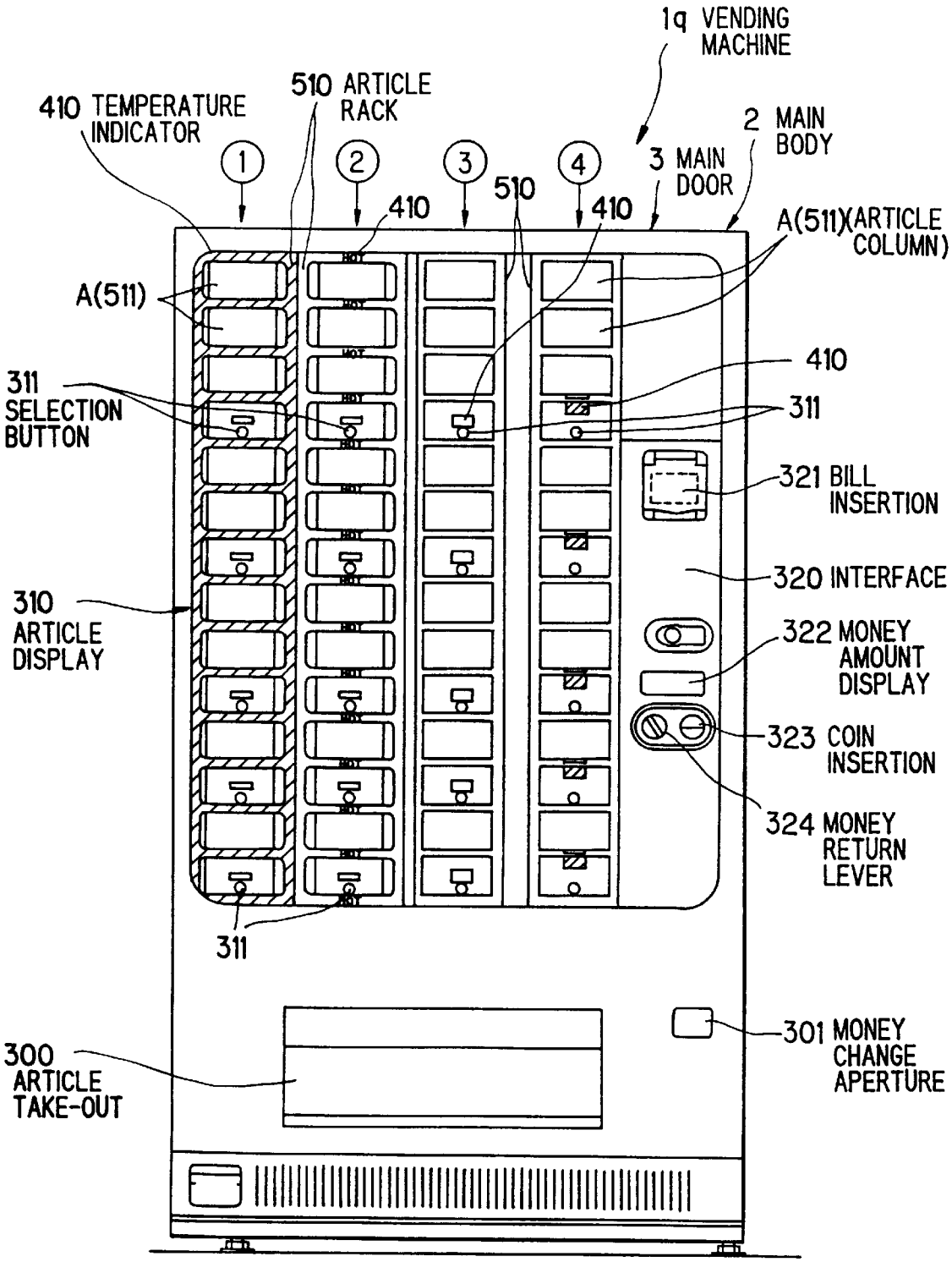
FIG. 46 is a front view of a vending machine according to the eighteenth embodiment of the invention; FIG.
Figure 47:
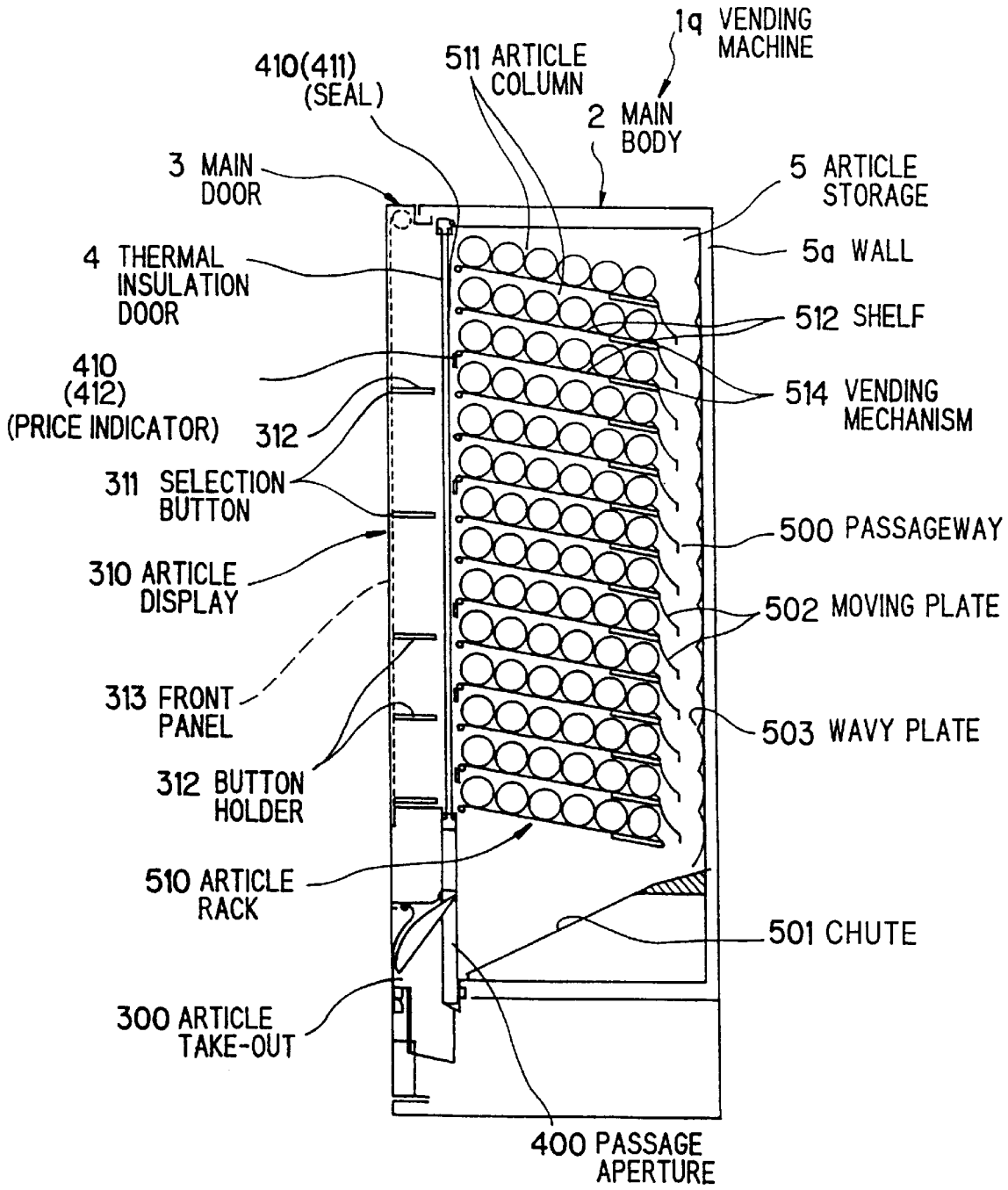
FIG. 47 is a longitudinal section view of the vending machine according to the eighteenth embodiment of the invention.

FIG. 46 is a front view of a see-through type vending machine relating to the 16th preferred embodiment of the present invention and FIG. 47 is a longitudinal sectional view of the vending machine shown in FIG. 46. The article storage house 5 of this vending machine 1*q* are divided into a plurality of compartments by longitudinally extended bulkheads, and four column article racks 510 are arranged within the compartments. Into at least ore compartment among the plural compartments is incorporated only a cooling apparatus, but both the cooling apparatus and a heating apparatus (not shown) are incorporated into each of the other compartments so as to make the switching between a HOT state to heat articles A and a COLD state to cool articles A.

With respect to this HOT/COLD stitching) for example, all of the compartments, that is, all article racks 510 are switched to the COLD state in summer, the HOT article racks 510 are increased one by one with deepening autumn, and all article racks 510 except remained one article rack are switched to the HOT state in winter. Inversely, with proceeding from winter to summer, the COLD racks 510 are increased one by one. The indication in these HOT/COLD switchings in this preferred embodiment is effected by using a temperature indicator (thermosheet) instead of exchanging of a conventional red or blue plate.

The temperature indicator 410 is a known sheet material which its color changes with changes in temperature. The temperature indicator 410 in this preferred embodiment indicates a warm color such as a red color, etc. at temperatures higher than 50° C. (HOT side), indicates a cold color such as a red color, etc. at temperatures lower than 10° C. (COLD side), and indicates a black color at temperatures between 11° C. and 49° C. That is, in the HOT operation, when the temperature surrounding the temperature indicator 410 becomes 50° C. or higher, the color of the temperature indicator 410 changes from black to red and further increase its clearness. In the COLD operation, when the temperature surrounding the temperature indicator 410 becomes 100° C. or lower, the color of the temperature indicator 410 changes from black to blue and further increase its clearness. The color of the temperature indicator 410 between 11° C. and 49° C. may take a color other than the black color, but preferably it is colorless.

Using such a temperature indicator 410, the display of HOT/COLD can be effected by various methods, so that with respect to four article racks 510, respective display methods will be described using sign "1", "2","3", and "4" shown in FIG. 46.

In the first modified example shown by the sign "1", the temperature indicator materials 410 are incorporated into a transparent sheet having a size corresponding to the front surface of the one article rack 510 leaving an area which the articles A can be visible, in other words, corresponding to visible respective articles A. This transparent sheet is bonded on the back surface of a thermal insulation door 4. That is, the temperature indicator material 410 is disposed so that the forefront articles A are enclosed in the front view. In this case, all of each article A and the article storage compartments are displayed by HOT/COLD, the color in the periphery of each article A changes from black to red (NOT) or from black to blue (COLD) to display the HOT/COLD.

Therefore, when an article A does not reach an appropriate temperature, the article A is enclosed by a conspicuous black color. On the other hand, when it has been kept at an appropriate HOT state, it is enclosed by a red color, and when it has been kept at an appropriate COLD state, it is enclosed by a blue color. Thus, the HOT/COLD of the articles A are clearly displayed and it is also clearly displayed whether it is a suitable temperature or not. Band-like temperature indicator materials 410 can also disposed in the upper and lower positions of the article A. Further, in a vending machine combining a front panel 313 for the article display 310 and a heat insulation door 313, the temperature indicator materials 410 can, of course, be bonded on the back surface of the front panel 313.

In the second modified example shown by the sign "2", the temperature indicator materials 410 formed into letters "HOT" and "COLD" are incorporated into a transparent sheet having a size corresponding to the front surface of the one article rack 510 leaving an area which the articles A can be visible. This transparent sheet is bonded on the back surface of a thermal insulation door 4. In this case, the whole of the article storages (respective compartments) 5 are displayed by HOT/COLD and each article A is positively displayed with the HOT/COLD. When the article storage compartments 5 reach an approximate temperature, the letter "HOT" and "COLD" looms as a red or blue color, respectively. Thus, the HOT/COLD can be displayed by both a color and a letter, whereby the HOT/COLD for the articles A can more clearly be displayed. Further by combining the first and second examples, a darker red or blue color can loom on the background of red or blue color, respectively.

Figure 48:
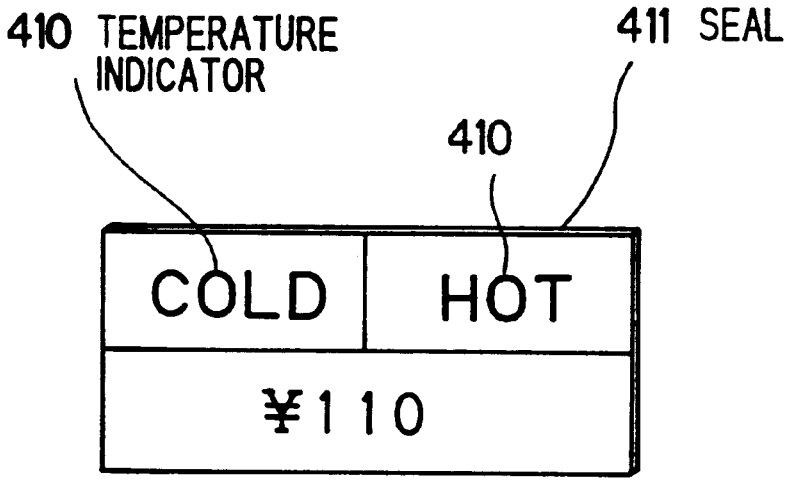
FIG. 48 is a perspective view of a seal for representing a cost of the article in the vending machine.

In the third modified example shown by the sign "3", the temperature indicator material 410 formed into letters "HOT" and "COLD" are incorporated into a money amount display seal for an article A 411 (refer to FIG. 48). In this case, the temperature indicator material 410 incorporated seal 411 are bonded on the back surface of a heat insulation door 4 corresponding to selection buttons 311. In this seal 411, the background for the area having at least temperature indicator material 410 incorporated therein is black, and when the article storage compartments 5 reach an approximate temperature, the letter "HOT" or "COLD" looms as a red or blue color, respectively. That is, the above mentioned column group as one unit is displayed as HOT/COLD by both a color and a letter.

Figure 49:
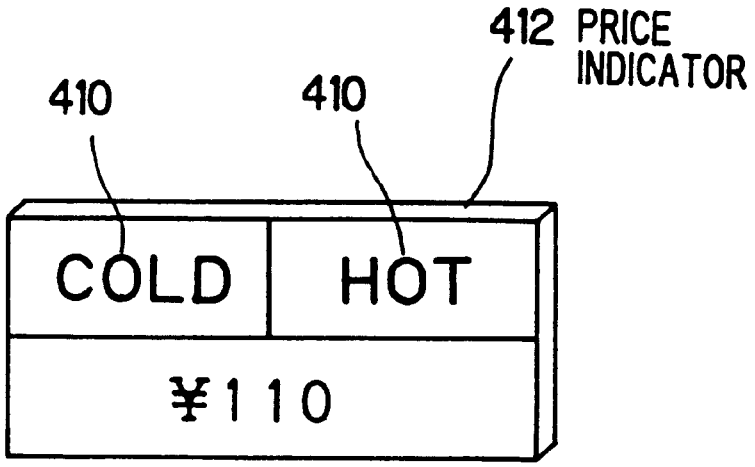
FIG. 49 is a perspective view of a label for representing a cost of the article of the vending machine.

In the fourth modified example shown by the sign "4", the temperature indicator materials 410 formed into letters "HOT" and "COLD" are incorporated into a money amount display label 412 for an article A (refer to FIG. 49). This label 412 is removably bonded on the front end of article columns 511 (shelves 512) corresponding to selection buttons 311. In this label 412, the background of the area having at least temperature indicator material 410 incorporated therein is black, and when the article storage compartments 5 reach an approximate temperature, the letter "HOT" or "COLD" looms as a red or blue color, respectively. This label 412 can be mounted on the front end of each article column 511 corresponding to each article A.

As described above, the vending machine 1*q* of the 18th preferred embodiment utilizes the advantages of a see-through type which the interior of the article storage chamber 5 can be seen and uses the temperature indicator material 410 indicating temperatures by means of changes in color as a HOT/COLD display, and thus, it is entirely unnecessary to exchange the parts for HOT/COLD display. Therefore, the switching works of the HOT/COLD display can easily be carried out and a situation to forget the switching of the HOT/COLD display can also be avoided. In addition, the HOT/COLD display indicates the temperature within the article storage chamber 5, so that the display does never differ from the temperature of the article A, and when the temperature indicator material does not indicate a desired color for HOT/COLD, it represents that the article storage chamber 5 (article A) does not have an appropriate temperature, whereby an elaborate service can be effected for consumers of articles A.

Further, the HOT/COLD display using such a temperature indicator material 410 provides an additional appeal to a see-through type of vending machine to give a strong desire to buy such articles A.

The temperature indicator material 410 may have arbitrary forms and colors, as well as infinite forms using as means for displaying a temperature of the article storage chamber. Therefore, the present invention does not be limited to the preferred embodiment described above so far as it is limited to a see-through type of vending machine.

Figure 50:
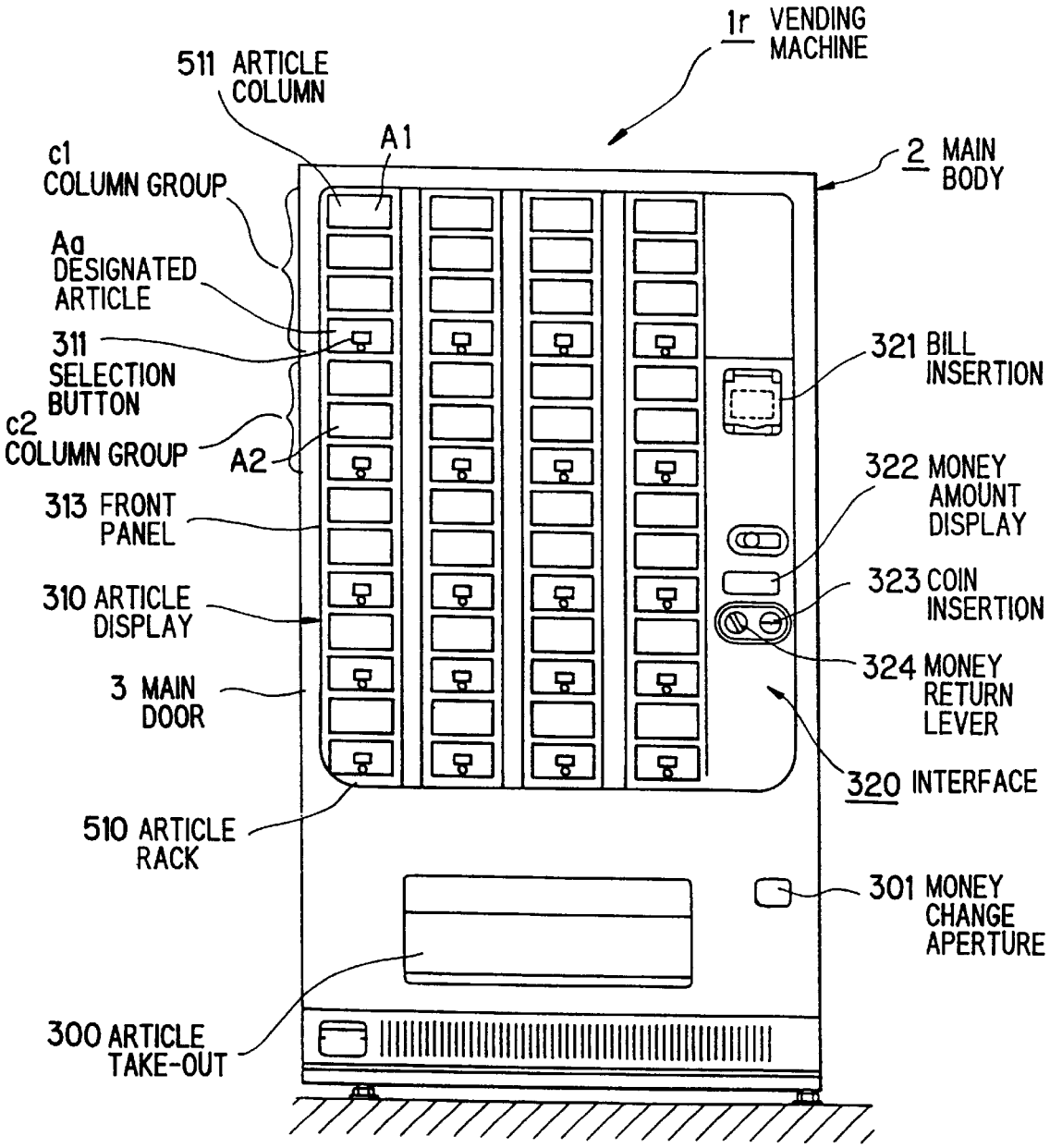
FIG. 50 is a front view of a vending machine according to the nineteenth embodiment of the invention.
Figure 51:
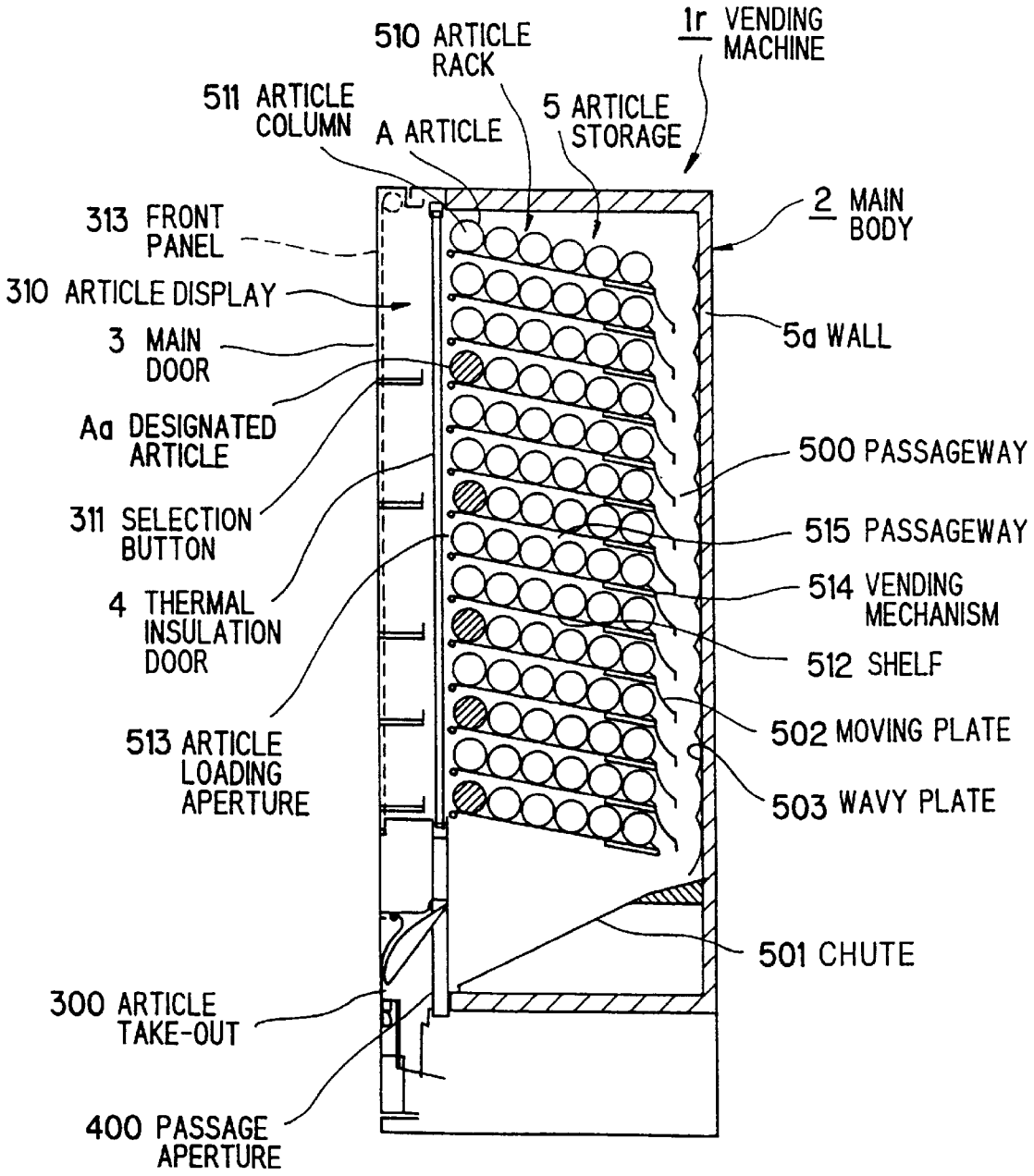
FIG. 51 is a longitudinal section view of the vending machine according to the nineteenth embodiment of the invention.

FIG. 50 is a front view of a see-through type vending machine relating to the 19th preferred embodiment of the present invention and FIG. 51 is a longitudinal sectional view of the vending machine shown in FIG. 50.

Figure 52:
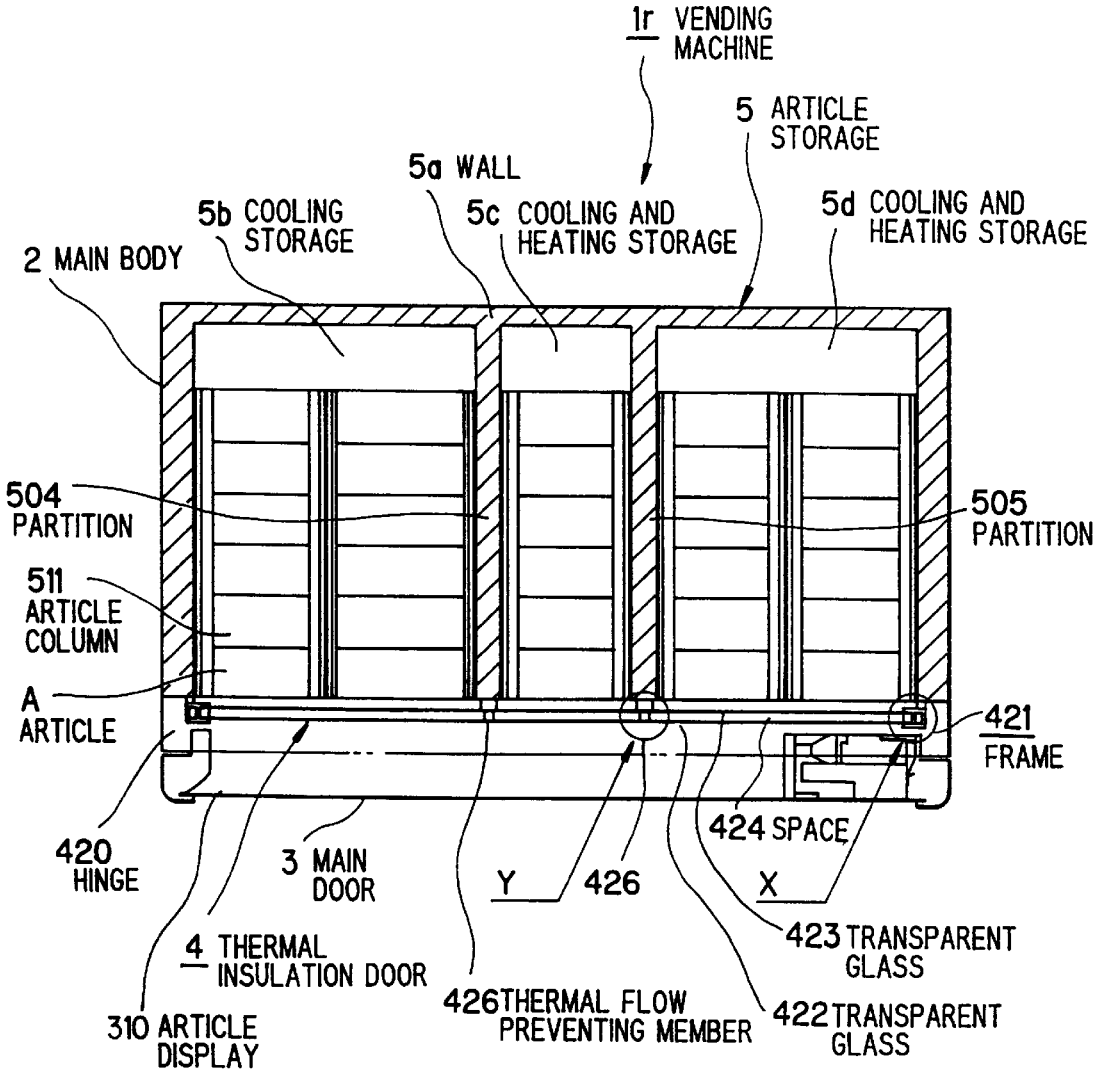
FIG. 52 is a transverse section view of the vending machine according to the nineteenth embodiment of the invention.

As shown in FIG. 52, an article storage chamber 5 is divided into a cooling exclusive storage chamber 5*b*, a cooling and heating chamber 5*c*, a cooling and heating chamber 5*d* by partitions 504 and 505 which have a heat insulation material filled therein, respectively The cooling storage chamber 5*b* is disposed on the left side of the article storage chamber 5 and stores cooling articles, the cooling and heating chamber 5*c* is disposed in the middle of the chamber 5, is formed by the partitions 504 and 505 and can store either of cooling and heating articles by an arbitrary switching, and the cooling and heating chamber 5*d* is disposed on the right side.

The cooling exclusive chamber 5*b* has two right and left article columns 511 each of which has six rows of articles A arranged back and forth, the cooling and heating chamber 5*c* has one article rack 510 storing six rows of articles A arranged back and forth, and the cooling and heating chamber 5*d* has two right and left article columns 511 each of which has six rows of articles A arranged back and forth.

Figure 53:
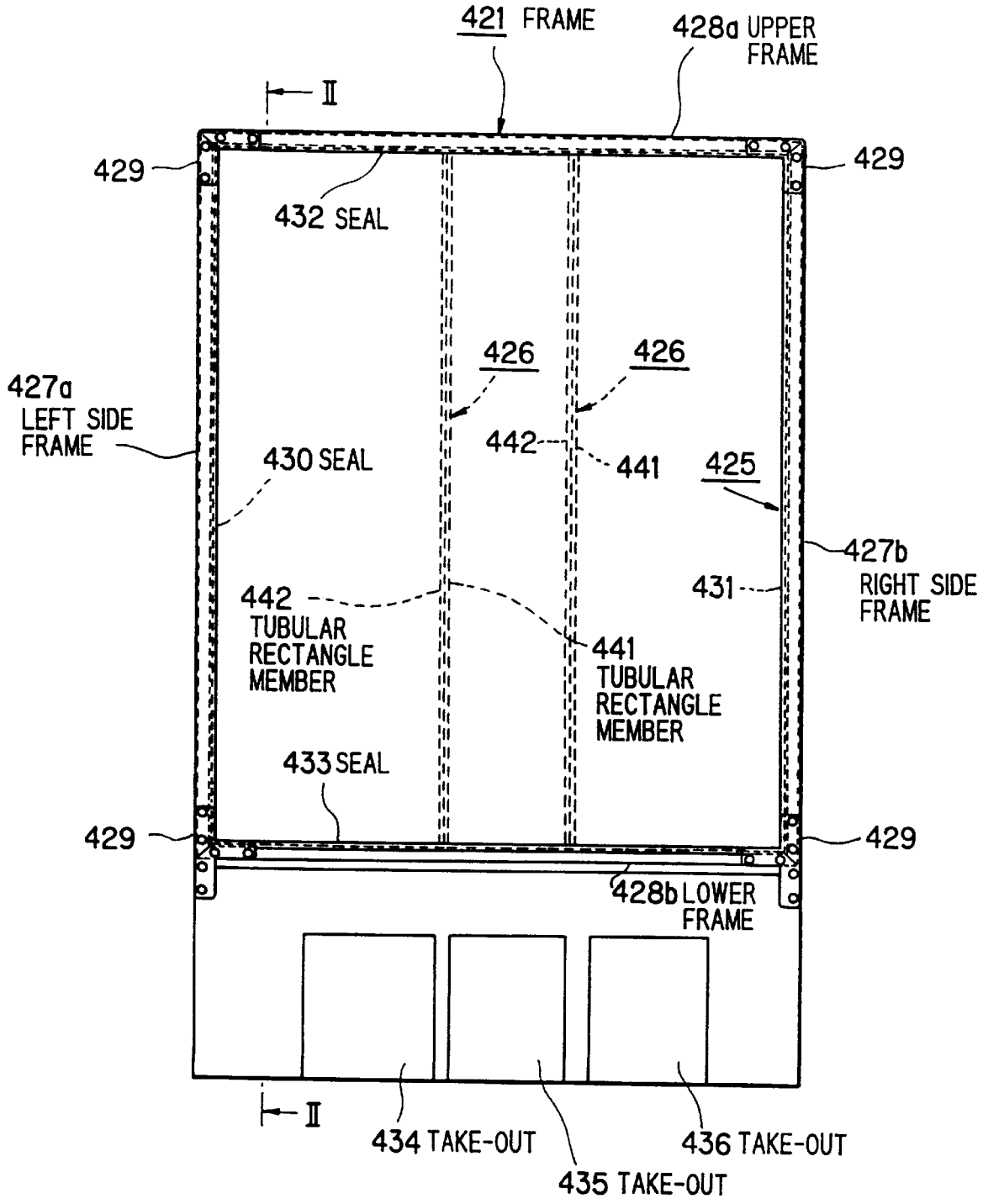
FIG. 53 is a view for explaining a frame of an adiabatic door in FIG. 51.
Figure 54:
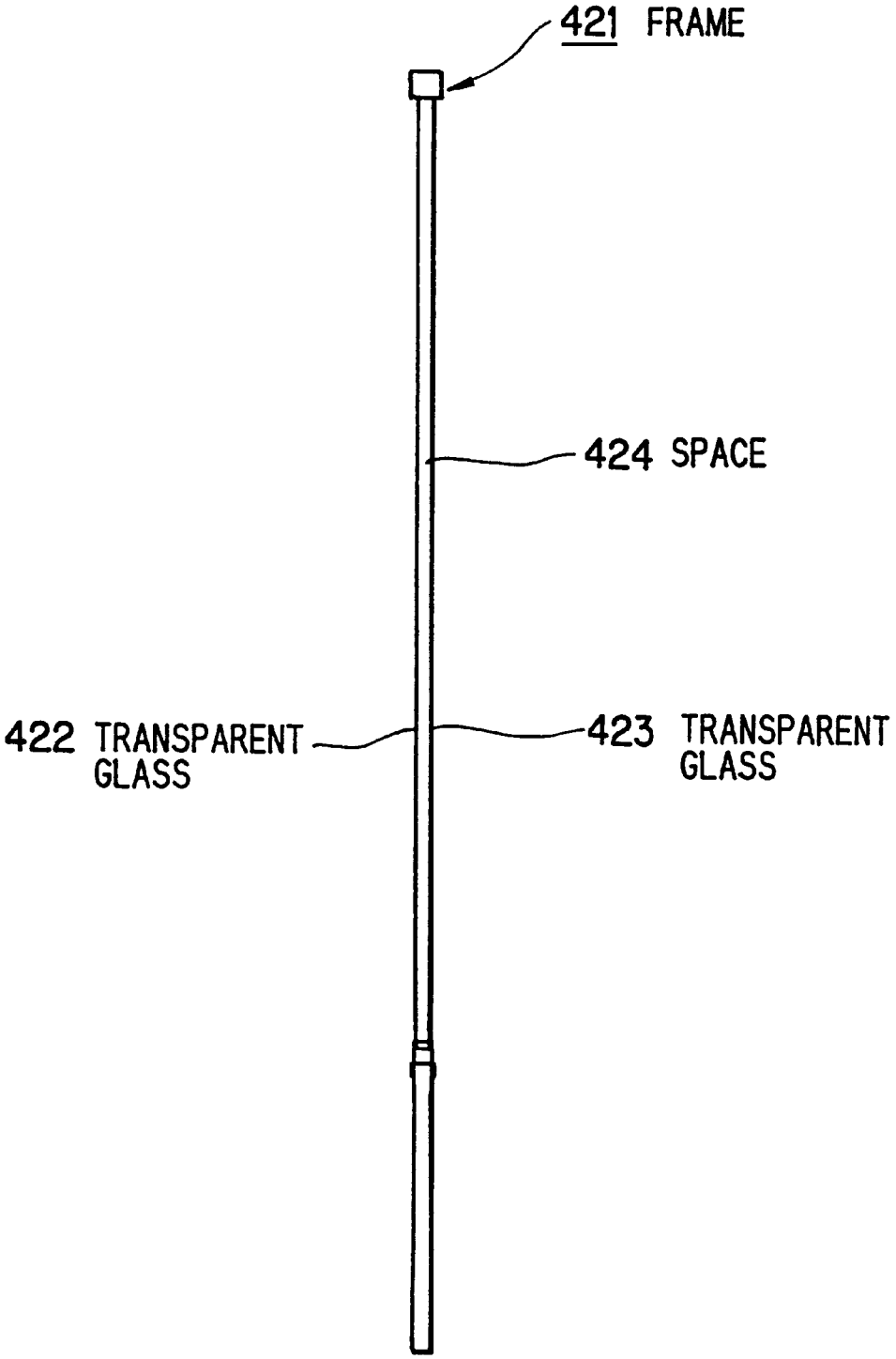
FIG. 54 is a section view taken along a line II—II in FIG. 53.

As shown in FIGS. 52–54, a thermal insulation door 4 disposed on the inner side of a front main door 3 has two sheets of transparent glass 422 and 423 having a required interval therebetween mounted on the inner periphery of a square frame 421 which can open and close the front of the article storage chamber 5 by means of a hinge 420 disposed on the left end of the door 4, has an outer peripheral thermal sealing member 425 disposed on the space 424 in such a way that it is contact with the inner periphery of the frame 421, and has a partition member 426 to prevent the convection of heat into the space 424 corresponding to the partitions 504 and 505 disposed therein.

Concretely, as shown in FIGS. 53 which is a front view of the thermal insulation door 4 and FIG. 54 which is a sectional view of the door 4 along a line A—A shown in FIG. 53, the frame 421 of the thermal insulation door 4 comprises a left side frame 427*a*, a right side frame 427*b*, an upper frame 428*a* and a lower frame 428*b* and forms an outer frame by connecting respective corners of such frames. The frame 421 is formed with a rigid plastic material, and as shown in FIG. 55 which is a partial enlarged sectional view of a X portion shown in FIG. 52, the periphery of the right side frame 427*b* has a hollow portion 427*b* of square in section and a concave portion 427*b*, and similarly, the other left side frame 427*a*, upper frame 428*a*, and lower frame 426*b* have the same sectional form, and thus, the frame 421 has the entire concave-shaped inner peripheral edge.

As shown in FIG. 53, corresponding to the frame 421, the outer peripheral seal 425 is disposed on the concave portion of the inner peripheral edge of the frame 421 and comprises a left side seal 430, a right side seal 431, and upper seal 432 and a lower seal 433, and these seals are connected by a joining member using a thermal insulating resin. The take-out mouths 434, 435, and 435 disposed on the under side of the vending machine correspond to the cooling exclusive chamber 5*b*, the cooling and heating chamber 5*c* and 53, respectively.

Figure 55:
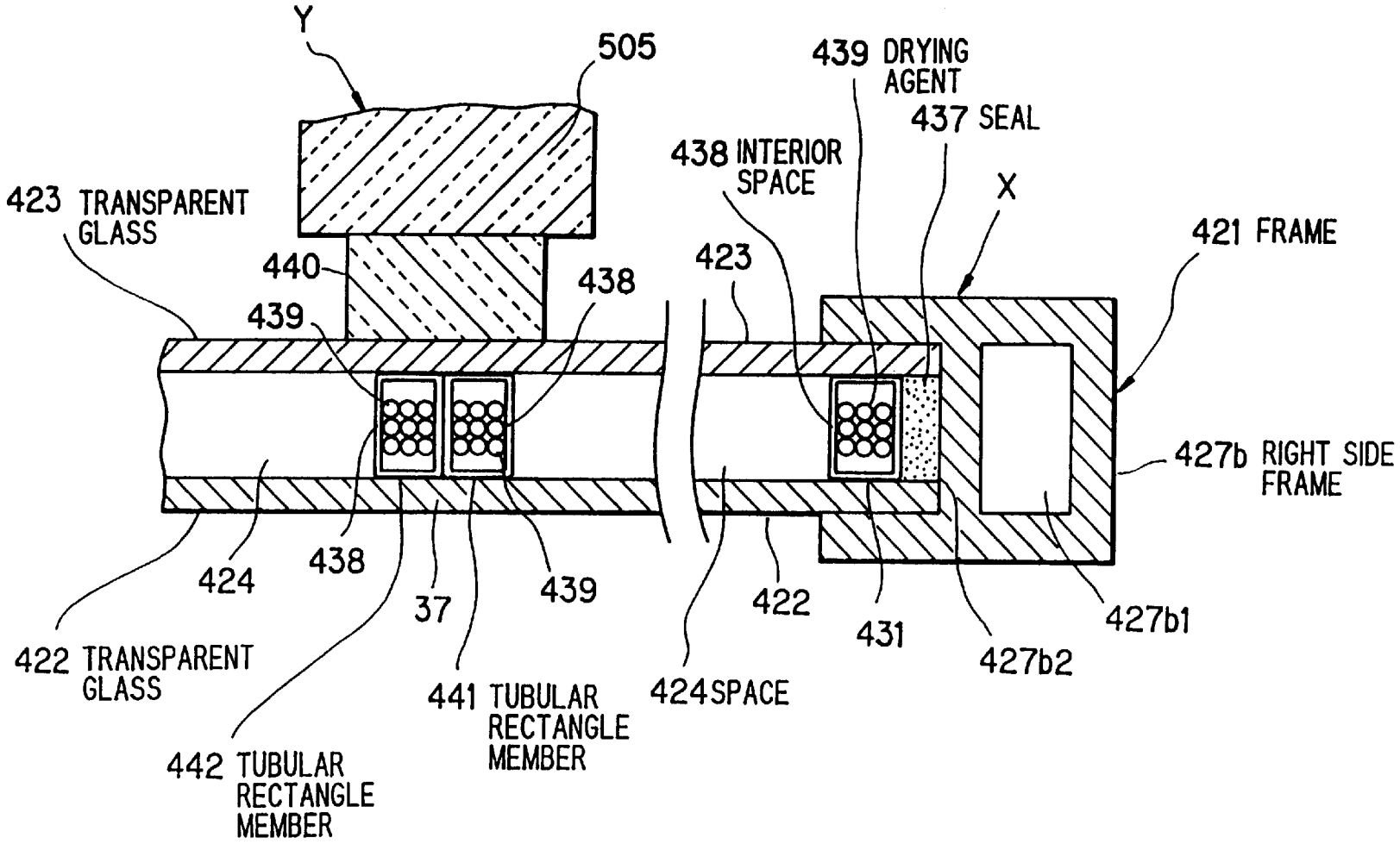
FIG. 55 is a grossly enlarged view of a portion of X and a portion of Y in FIG. 52.

For example, as shown in FIG. 55, the concave portion 427*b*2 formed in the right side frame 427*b* has coal tar 437 as a seal material filled therein, and the right side seal 431 which is one side body of the outer peripheral seal 425 is disposed in the space 424 between the transparent glass sheets 422 and 423 fit into the concave 427*b*2. The right side seal 431 is formed by forming slender aluminum sheet into a tube or hollow cylinder of square in section and a drying agent 439 is filled into the inner space 438 of the tube. Similarly, the other left side seal 430, upper seal 432, And lower seal 433 nave the same form as that of the right side seal 431. Therefore, the outer peripheral seal 425 prevents the leak of heat to the exterior through the inner peripheral seal of the frame 421 and reinforces the strength of the entire frame.

As shown in FIG. 55 which is partial enlarged view of the portion Y shower in FIG. 52, the partition member 426 is disposed in the space 424 formed between the transparent glass sheets 422 423 which are mounted In the front direction of a packing 440 mounted on the end of the partition 505. The partition member 426 consisting of two hollow cylinders 441 and 442 of square in section each of which is formed from a slender aluminum sheet, and the inner space 438 of each cylinder is filled with a drying agent 439.

That is, the square cylinders 441 and 442 have the same cross section and quality of the material as those of the outer peripheral seal 425, and they have a high dimensional precision and the minimum occurrence in the deformation and clearance caused by expansion and contraction due to temperature difference. The square cylinders 441 and 442 cross the transparent two glass sheets 422 and 423 at right angles, are disposed contact with each other through their back surfaces, are adhered each other with a double-coated tape, and have respective spaces 438 formed along their cylindrical axes. Therefore, the moisture generated in the space 424 partitioned by the partition member 426 is absorbed with the drying agent 439. The upper and lower ends of the square cylinders 441 and 442 are connected to the outer seal 425 through a thermal isolating resin material In this manner, according to the vending machine 1*q* of the present invention, the heat convention of an air layer within the inner space 424 is prevented and the lea of heat in the adjacent chamber is inhibited to the minimum limit by the partition 426 disposed in the inner space, and thus the adiabatic chamber for storing heated and cooled articles are provided by a pair of transparent glass sheets, whereby providing an inexpensive vending machine with a good external appearance. In addition, because the outer peripheral seal 425 and partition member 426 have the same construction, a high dimensional precision can be obtained, the occurrence of clearance caused by warping the entire door due to the expansion and contraction of respective parts based on temperature difference can be prevented, and the moisture generated within the inner space 424 can be absorbed by a drying agent 439.

Although the examples applied to the automatic vending machines are described in the above preferred embodiments of the present invention, they can be applied to other vending machines such as a showcase and the like.

What is claimed is:

1. A vending machine, comprising:

a main body having a predetermined height and a predetermined width;

an article display installed on a front side of said main body to occupy a predetermined portion of said predetermined width of said main body;

an interface installed on said front side of said main body to occupy a remaining portion of said predetermined width of said main body;

an article storage being extended behind said interface;

a plurality of article columns in said article storage and articles in said plurality of article columns being visible through said article display an additional column in an extended area of said article storage, front portions of said additional column being covered by said interface:

a plurality of article selection buttons for selecting respective visible articles;

a vending mechanism being actuated by operating said article selection buttons each corresponding to selected articles provided for said article columns; and wherein said plurality of article columns comprise a plurality of shelves each being slanted to be directed to said vending mechanism, and accommodating said articles in a row thereon.

2. A vending machine, according to claim 1, wherein:

a plurality of additional columns are provided with a vending mechanism.

3. A vending machine, according to claim 2, wherein:

said plurality of article columns and additional columns comprise a plurality of shelves each being slanted to be directed to said vending mechanism, and accommodating said articles in a row thereon.

4. A vending machine, according to claim 3, wherein:

each of said plurality of shelves is slanted to be lower at its tail end; and there are further provided a slanted chute under a lowest shelf among said plurality of shelves, and an article storage between said lowest shelf and said slanted chute, said slanted chute forwarding articles supplied from said plurality of article columns and additional columns, and said article storage storing precooled articles.

5. A vending machine, according to claim 2, wherein:

each of said plurality of additional columns is serpentine shaped.

* * * * *